US011938372B1

(12) United States Patent
Roberts et al.

(10) Patent No.: US 11,938,372 B1
(45) Date of Patent: Mar. 26, 2024

(54) EXERCISE ASSEMBLY

(71) Applicants: Larry Roberts, Ft. Lauderdale, FL (US); Bertho Boman, Plantation, FL (US)

(72) Inventors: Larry Roberts, Ft. Lauderdale, FL (US); Bertho Boman, Plantation, FL (US)

( * ) Notice: Subject to any disclaimer, the term of this patent is extended or adjusted under 35 U.S.C. 154(b) by 0 days.

(21) Appl. No.: 17/480,720

(22) Filed: Sep. 21, 2021

Related U.S. Application Data

(63) Continuation-in-part of application No. 16/785,980, filed on Feb. 10, 2020, now abandoned, which is a continuation-in-part of application No. 15/405,926, filed on Jan. 13, 2017, now abandoned, which is a continuation of application No. 14/924,340, filed on Oct. 27, 2015, now Pat. No. 9,839,827.

(60) Provisional application No. 62/918,661, filed on Feb. 8, 2019, provisional application No. 62/918,656, filed on Feb. 8, 2019, provisional application No. 62/918,658, filed on Feb. 8, 2019, provisional application No. 62/236,503, filed on Oct. 2, 2015, provisional application No. 62/177,730, filed on Mar. 23, 2015, provisional application No. 62/122,685, filed on Oct. 27, 2014.

(51) Int. Cl.

| | |
|---|---|
| ***A63B 23/12*** | (2006.01) |
| ***A63B 69/22*** | (2006.01) |
| *A63B 71/00* | (2006.01) |
| *A63B 71/02* | (2006.01) |

(52) U.S. Cl.
CPC ..... *A63B 23/12* (2013.01); *A63B 69/22* (2022.08); *A63B 2071/0063* (2013.01); *A63B 71/023* (2013.01); *A63B 2225/093* (2013.01)

(58) Field of Classification Search
CPC ..... A63B 23/12; A63B 69/22; A63B 71/023; A63B 2071/0063; A63B 2225/093; A63B 69/004; A63B 69/215; A63B 69/20–34
See application file for complete search history.

(56) References Cited

U.S. PATENT DOCUMENTS

| | | | |
|---|---|---|---|
| 26,685 | A | 1/1860 | Lee |
| 2,140,487 | A | 12/1938 | Waechter |
| 2,435,864 | A | 2/1948 | Adams |
| 2,702,191 | A | 2/1955 | Lemelson |
| 2,993,587 | A | 7/1961 | Stone et al. |

(Continued)

FOREIGN PATENT DOCUMENTS

| | | |
|---|---|---|
| EP | 0403514 | 1/1994 |
| WO | WO2015152950 | 10/2015 |

*Primary Examiner* — Nyca T Nguyen
(74) *Attorney, Agent, or Firm* — MALLOY & MALLOY, P.L.; Peter A. Matos

(57) ABSTRACT

An improved exercise assembly structured to be struck by a user includes a base supporting a shaft on a supporting surface. A support shaft extends outwardly from the supporting surface. At least one target is connected to the support shaft and extends outwardly. The at least one target is connected to a breakaway mechanism, which is connected to a rotational fitting, which connects to the support shaft. The target is able to be struck and rotate around the shaft via the rotational fitting. Upon a misdirected striking (force) inflicting on the target, the breakaway mechanism mitigates forces away from the shaft and rotational fitting in order to reduce total stress on the assembly.

17 Claims, 40 Drawing Sheets

(56) References Cited

U.S. PATENT DOCUMENTS 3,027,062 A 3/1962 Huss et al.
D198,513 S 6/1964 Caprioll
D214,487 S 6/1969 Reichl
3,521,743 A 7/1970 Sposito, Jr.
3,853,220 A 12/1974 Luray
3,955,315 A 5/1976 Goodman
4,221,385 A 9/1980 Nidy
4,470,538 A 9/1984 Heathcock et al.
4,564,192 A 1/1986 Lebowitz
4,606,460 A 8/1986 Luray
4,620,701 A * 11/1986 Mojden ..... A63B 3/00 482/142
4,749,184 A 6/1988 Tobin
4,817,941 A 4/1989 McCorry
4,852,743 A 8/1989 Ridgeway
4,865,200 A 9/1989 Sullivan et al.
5,153,402 A 10/1992 Quick et al.
5,218,510 A 6/1993 Bradford
5,251,760 A 10/1993 Smith et al.
5,277,679 A 1/1994 Wells
5,323,896 A 6/1994 Jones
5,342,267 A 8/1994 Adams et al.
5,352,170 A * 10/1994 Condo ..... A63B 69/32 482/83
5,388,701 A 2/1995 Ridgeway
5,405,000 A 4/1995 Hagedon et al.
5,538,251 A 7/1996 Harper
5,678,695 A 10/1997 Ridgeway et al.
5,722,541 A 3/1998 Lofgren et al.
5,722,920 A 3/1998 Bauer
5,741,535 A 4/1998 Cope et al.
5,762,200 A 6/1998 Goudreau
5,894,932 A 4/1999 Harding et al.
5,899,835 A 5/1999 Puranda
5,901,852 A 5/1999 Simpson
5,967,327 A 10/1999 Jones
5,975,307 A 11/1999 Harding et al.
5,984,842 A 11/1999 Chu
6,006,917 A 12/1999 Loeffler
6,033,348 A 3/2000 Warshauer
6,073,761 A 6/2000 Jones
6,158,589 A 12/2000 Smith et al.
6,223,901 B1 5/2001 Lofgren et al.
6,241,640 B1 * 6/2001 Chu ..... A63B 69/222 482/86
6,289,655 B1 9/2001 Ridgeway et al.
6,302,274 B1 10/2001 Ridgeway
6,311,843 B1 11/2001 Smith et al.
6,675,973 B1 1/2004 McDonald et al.
6,685,025 B1 2/2004 Kari
7,085,534 B2 8/2006 Bentley
7,086,534 B2 8/2006 Roesel et al.
7,086,997 B1 8/2006 Fields et al.
7,147,591 B2 * 12/2006 McAvoy ..... A63B 21/4047 482/148
7,290,062 B2 10/2007 Henrion
7,290,662 B2 11/2007 Lofgren et al.
7,300,365 B2 * 11/2007 Taylor ..... A63B 69/0002 473/422
7,329,210 B1 2/2008 Marano
7,427,069 B2 * 9/2008 Bateman ..... F41J 1/10 273/406
7,591,768 B1 9/2009 Geeting
7,743,924 B2 6/2010 McDonald et al.
7,862,485 B2 1/2011 Luigi
7,882,956 B2 2/2011 McDonald et al.
7,922,628 B2 4/2011 Gonzalez
D667,305 S 9/2012 Kuhn et al.
8,617,034 B2 12/2013 Eem
8,684,361 B2 * 4/2014 Henson ..... F41J 1/01 273/389
8,727,123 B1 5/2014 Roberts
D706,136 S 6/2014 Roberts
8,955,846 B2 * 2/2015 Frickey ..... F41J 1/10 248/183.1
9,126,743 B2 9/2015 Roberts
9,150,343 B2 10/2015 Roberts
9,744,420 B1 8/2017 Bergamini
9,839,827 B1 12/2017 Roberts
10,252,135 B1 4/2019 Roberts
10,293,234 B1 * 5/2019 Schlegel ..... A63B 69/22
10,493,346 B2 12/2019 Hall
2001/0047950 A1 12/2001 Beneroff et al.
2002/0193211 A1 12/2002 Kao
2005/0003936 A1 1/2005 Schwendemann
2007/0167297 A1 7/2007 Stevenson
2008/0029419 A1 2/2008 Appelbaum
2009/0098985 A1 * 4/2009 Gonzalez ..... A63B 69/22 482/83
2009/0176620 A1 7/2009 Reynolds
2009/0247374 A1 10/2009 Chen
2009/0272667 A1 11/2009 McDonald et al.
2011/0240515 A1 10/2011 Ridgeway
2012/0129660 A1 5/2012 Eem
2013/0296143 A1 * 11/2013 Staten ..... A63B 21/078 482/98
2014/0128227 A1 5/2014 Ladas
2014/0246352 A1 9/2014 Roberts
2014/0302969 A1 10/2014 Chen
2014/0329646 A1 11/2014 Johnson
2014/0339129 A1 11/2014 Roberts
2014/0357455 A1 12/2014 Feng et al.
2016/0023078 A1 1/2016 Haselrig
2016/0107078 A1 4/2016 Lattin et al.
2016/0206943 A1 * 7/2016 Campbell ..... A63B 69/32
2017/0348577 A1 12/2017 Chen
2018/0021650 A1 1/2018 Hoover
2018/0099199 A1 4/2018 Rita
2018/0161657 A1 6/2018 Direnzo
2019/0344145 A1 11/2019 Rita
2020/0155913 A1 5/2020 Chen
2020/0254320 A1 8/2020 Hall
2021/0178239 A1 6/2021 Chen
2021/0283482 A1 * 9/2021 Wu ..... A63B 69/20
2021/0308547 A1 10/2021 Allred

* cited by examiner

10

10

200

EXERCISE ASSEMBLY

The present application is a continuation-in-part application of previously filed U.S. patent application having Ser. No. 16/785,980, which is a continuation-in-part of previously filed U.S. patent application having Ser. No. 15/405,926 filed on Jan. 13, 2017, which is a continuation application of U.S. patent application having Ser. No. 14/924,340 filed on Oct. 27, 2015, which matured into U.S. Pat. No. 9,839,827 on Dec. 12, 2017, which claims priority to a provisional patent application having U.S. Ser. No. 62/236,503 and a filing date of Oct. 2, 2015, which claims priority to provisional patent application having U.S. Ser. No. 62/177,730 and a filing date of Mar. 23, 2015, which also claims priority to provisional patent application having U.S. Ser. No. 62/122,685 and a filing date of Oct. 27, 2014. This present application also claims priority to provisional patent application 62/918,658 which has a filing date of Feb. 8, 2019, also, provisional patent application 62/918,656 which has a filing date of Feb. 8, 2019, also, provisional patent application 62/918,661, which has a filing date of Feb. 8, 2019. The contents of each of the above are incorporated herein in their entirety by reference.

BACKGROUND OF THE INVENTION

Field of the Invention

The present invention is directed to an exercise assembly which also may be used for training purposes when practicing certain sports activity including, but not limited to, boxing, the martial arts, etc. As such, the exercise assembly includes a plurality of targets, adjustably mounted and disposed on a supporting shaft, wherein each target is structured to be individually and repeatedly struck by the hands, feet, and/or limbs of a user when performing the exercising and/or training routine.

Description of the Related Art

Numerous individuals seek out training devices wanting to exercise or train using self defense techniques. As a result, such individuals frequently require some type of device in order to facilitate their goals. Known devices which are readily available on the commercial market include stationary training products including the heavy punching bag. However, there is always a risk of injury since the bag is by nature heavy and dense, and can damage wrists and ankles if the user does not properly protect his/her body. Other known devices such as reactive training products including various speed bag assemblies allow an individual to practice not only punches and/or kicks, but also speed and accuracy.

Training devices have independently developed to a point where their use is more multi-purpose, where a target can rotate on contact back to the individual, which simulates the unpredictable nature of a real-life sparring partner. However, there appears to be an absence of a combined structure having multi-purpose uses such that a single exercise training device may be utilized as both a stationary training product and a simulated interactive sparring partner where a target can rotate around a shaft on contact from the user. Accordingly, despite the developments and advancements in training devices of the type set forth above, there is still a need for an improved training apparatus which provides targets that simulate an interactive sparring partner with a high enough threshold for absorbing impact, while remaining safe to the user.

SUMMARY OF THE INVENTION

The present invention is directed to an exercise assembly including structural and operative features which facilitates its versatility, thereby allowing it to be used for both exercise and training. More specifically, the exercising and/or training assembly of the present invention is structured with the intent of being repeatedly "struck" by a participating user, as the user simulates activities relating to boxing techniques, the performance of various types of martial arts and/or similar activities.

Accordingly, at least one preferred embodiment of the exercise assembly includes an elongated support shaft or support stanchion which may be mounted on or otherwise connected to different supporting surfaces. As primarily but not exclusively used, the support shaft may be disposed in a vertically upright orientation resting on a supporting surface such as a floor, ground surface or the like. Further, a base may be removably connected to a lower or proximal end of the support shaft while being fixedly or removably connected to the supporting surface. Other anticipated operative orientations of the exercise assembly include the support shaft being mounted in what may be referred to as a substantially "inverted orientation" such as by depending from a ceiling or other raised surface area. Similarly, the support shaft and an appropriately structured base may be secured to a vertical wall so as to extend transversely outward therefrom. In yet another preferred embodiment, the support shaft may be mounted on a "door shaft system." This door shaft system may act as a plurality of braces that fixedly attach to a door while the door is either open or closed so as to provide structural support and space for the support shaft to be mounted thereto. While the support shaft is mounted to the door shaft system, the exercise assembly may then be used accordingly and have full functionality. The door shaft system may allow a user yet another versatile way of utilizing the present invention by virtue of the support shaft having the ability to operate in conjunction with the door shaft system.

The versatility of the exercise and/or training assembly of the present invention is enhanced by the utilization of a plurality of different types of target structures. Each of the targets may be adjustably mounted along the length of the shaft so as to be positioned at various heights and be variably spaced relative to one another. As such, the specific disposition of each of the plurality of targets may be at least partially dependent on the stature of a user. Similarly, the space between and/or relative positioning of the various targets on the shaft may also be dependent on the type of training and/or exercise activity intended to be performed. By way of example, if a user is intending to practice boxing, the plurality of targets are relatively disposed on the shaft so as to facilitate the user throwing different types of punches with the arms and hands. However, if the user is intending to practice different types of martial arts and/or a combination of boxing and martial arts, the plurality of targets may be arranged along the height or length of the shaft at different locations to facilitate the performance of such activity.

Therefore, the exercise assembly of the present invention includes at least one but a possible plurality of fixed, moving, rotating targets adjustably mounted, relative to one another, along the length of the shaft at appropriate positions. In at least one preferred embodiment, the exercise assembly may include at least one but possibly a plurality of rotating targets. Each of the one or more rotating targets includes an elongated arm having both a weighted construction and a safety portion. Further, the targets may reside on a multitude of different mounting mechanisms, of which may facilitate orientations of a target to a user, by virtue of angles, orientations, or distances. In one embodiment, the mounting mechanism may be a bracket system wherein targets may be able to be quickly moved in vertical or horizontal directions by virtue of a bracket comprising apertures for pins structured for selective orientation about the shaft. As explained in greater detail hereinafter, the weighted construction provides the proper overall weight to the elongated arm so as to facilitate its rotation about the shaft in an intended manner, after being struck by the user. Such a weighted construction may include an elongated rigid material member, such as an elongated dowel, disposed within the interior of the arm and extending along a length thereof, substantially intermediate the proximal and distal ends of the arm.

In contrast, the safety portion of the arm of the rotating target may be located along a length contiguous to the distal end of the arm. Further, in order to eliminate or at least restrict the possibility of damage or harm to the user, the safety portion is preferably made of a cushioning material. Such cushioning material may be in the form of a flexible material foam or the like. The safety features associated with the flexible cushioning material are such as to offer at least an appropriate minimal resistance to a punch or blow from the user. Such resistance should be sufficient to facilitate the rotation of the rotating target, once struck, but should be such as to not cause damage to the user's hand, arm, etc. In order to further facilitate the safety features of the one or more rotating targets, the corresponding elongated arm may include an outer sleeve of similarly flexible cushioning and/or foam material. This is due, at least in part to the fact that a continuous rotation of the arm may possibly result in its striking or otherwise engaging the user after completion of a substantially 360° path of rotation about the central axis of the shaft.

As explained in greater detail hereinafter, structural and operative features associated with at least one embodiment of the one or more rotating targets and corresponding arms include the intended rotation thereof through a plurality of continuous rotational paths, in order to provide a greater challenge to the user when performing certain exercises and/or training programs. Accordingly, additional features which facilitate the rotation of the one or more arms defining the one or more rotating targets include the provision of a rotational fitting. Each of the rotational fittings include a one piece and/or integrally formed primary portion and outwardly extending connecting segment. As such, the primary portion and connecting segment may collectively define a substantially T-shape configuration. Moreover, the primary portion has a hollow interior which allows its disposition in surrounding, concentric relation to an exterior of the shaft. However, the relative dimensions between the interior of the primary portion of the rotational fitting and the exterior dimensions of the shaft should be such as to allow the aforementioned intended rotation.

As will also be explained in greater detail hereinafter, the continuous and/or intended rotation of the one or more rotating targets is facilitated by the rotational fitting including two bearing assemblies each disposed at an opposite open end of the primary portion. Further, each bearing assembly is secured by a correspondingly disposed one of two locking collars. Additional features of the preferred bearing assembly include two spaced apart bearing washers disposed in sandwiching relation with an inner bearing structure, such as a thrust bearing.

As set forth above, one intended operation of the rotating target is for the overall structuring, including the weighted construction and the rotational fitting to facilitate a continuous rotation of the elongated arm through a predetermined plurality of preferably three to four complete rotations once being struck by the user. This will further facilitate the performance by a user of a relatively quick or rapid response movement when practicing either a boxing or martial arts technique, since the user will have to respond to the continuously rotating arm of the rotating target.

However, yet another operative feature of the rotating target is its intended restricted rotation through a rotational path of less than 360° or less than a complete circular path about the longitudinal axis of the shaft. Accordingly, the exercise and/or training assembly of the present invention further comprises a resistance assembly which is adjustably but fixedly secured in a predetermined location relative to the rotational path of one or more of a possible plurality of arms of one or more rotating targets. Therefore, the resistance assembly may be purposefully disposed in an "interruptive position" relative to the rotational path of the arm. As such rotation of the arm will be restricted and/or prevented from accomplishing a complete 360° arc of rotation.

Further, the resistance assembly may include a biasing or spring structure which is disposed to engage the arm during its rotation. In addition, the biasing structure is disposed and structured to direct a directional, biasing force on the rotating arm, which will not only stop its rotation, but force it to rotate in an opposite direction, back towards the user. More specifically, the biasing structure of the resistance assembly will exert a force on the rotating arm in a direction which is substantially opposite to the initial direction of rotation of the arm along its intended rotational path of travel. This will serve to redirect the rotating arm back towards the user. In turn, the user can appropriately react by purposefully "ducking" the returning rotating arm and or delivering an additional defensive blow thereto, dependent on the particular exercise or training activity which the user is practicing.

The versatility of the exercise assembly of the present invention is further demonstrated by the provision of a head target. The head target includes a support member which is preferably a rigid arm segment adjustably secured along the length of the shaft and thereby disposed at any preferred or appropriate height. A target section defines a distal end of the head target and is structured to be struck or receive a blow from the user. In addition, a spring segment is included in the head target and is disposed in movably, resiliently interconnecting relation between an outer end of the support arm segment and the inner or proximal end of the target section. Further, the spring segment may have a substantially conical configuration. As such, the conically configured spring extends divergently is corresponding outward in at least partially surrounding and/or gripping relation to the proximal end of the target section. Such structuring of the head target also facilitates its use as a "speed bag". In order to provide a more realistic appearance and disposition of the head target it may be disposed at an acute angle relative to the length of the shaft and be directed either upwardly or downwardly at such an acute angle.

The exercise assembly of the present invention may also include a scoring element in which a user gets "scored" by his/her performance. Scoring will be calculated based on how a user hits a prospective target or how a user gets hit by a prospective target. For each time a user hits a prospective target, the user's score will go up, but each time a user gets hit by a target, a user's score goes down. The exercise assembly may be able to calculate this score based on the inclusion of a sensor within a prospective target or embedded elsewhere on the exercise assembly. The sensor may be able to detect a force of impact to further quantify score. Essentially, if a user hits a target with embedded sensor, the sensor will detect a larger force which signifies an addition of points. On the other hand, the sensor may detect a lesser force which signifies a user has been hit by the target, resulting in a loss of points.

The exercise assembly of the present invention may also include one or more fixed targets which may be similarly structured to the head target by the inclusion of a support arm segment, a target portion or section structured, to receive a blow from the user, and a resilient, spring segment. The spring element in both the head target and one or more fixed targets will be calibrated and/or otherwise structured to absorb the force of a blow exerted on the target section, but cause a return the target section to an original orientation. Such one or more fixed targets may be strategically or appropriately placed along the length of the support shaft at any one of a plurality of angles which facilitate the practice of any boxing, martial arts or like activities being performed by the user.

Yet additional features of the exercise assembly of the present invention includes an enhanced structuring of the base. As such, the base may be dimensioned and configured to support the shaft in an outwardly and/or upright orientation concurrently to allowing a user to stand on an exposed or outer surface or face of the base. Such positioning of the user is further facilitated by the inclusion of a slip-resistant and/or traction enhancing structure mounted on the outer exposed surface or face. Such a slip-resistant structure would be disposed so as to engage the feet of the user while practicing the intended exercise and or training activity. Other features of one or more additional embodiments of the base may include it being removably but fixedly attached to a supporting surface using any of a variety of connectors. Such connectors may include one or more adhesive type connectors or similarly structured connectors, attachment structures, etc. which allows the fixed positioning of the base on the supporting surface but also allows for its removal from the supporting surface, when not being used.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The invention now will be described more fully hereinafter with reference to the accompanying drawings in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
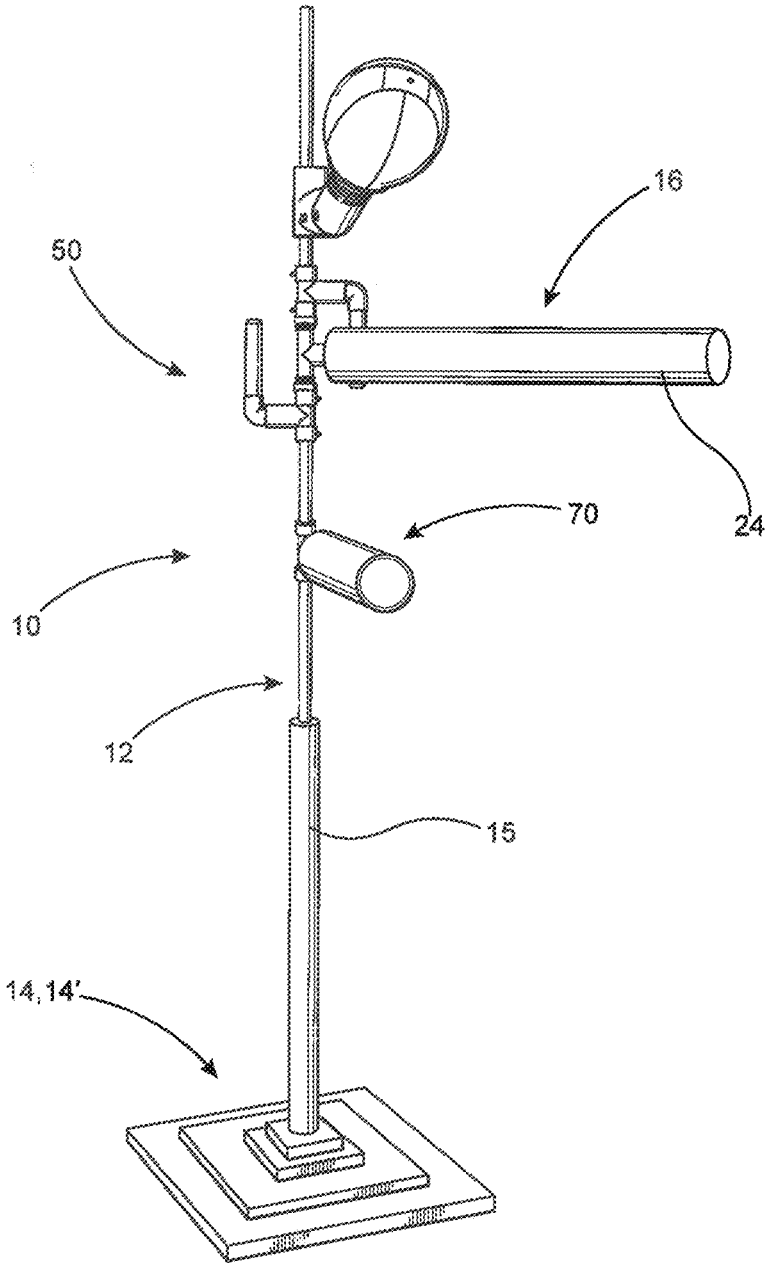
FIG. 1 is a perspective view of one preferred embodiment of an exercise assembly of the present invention.
Figure 2:
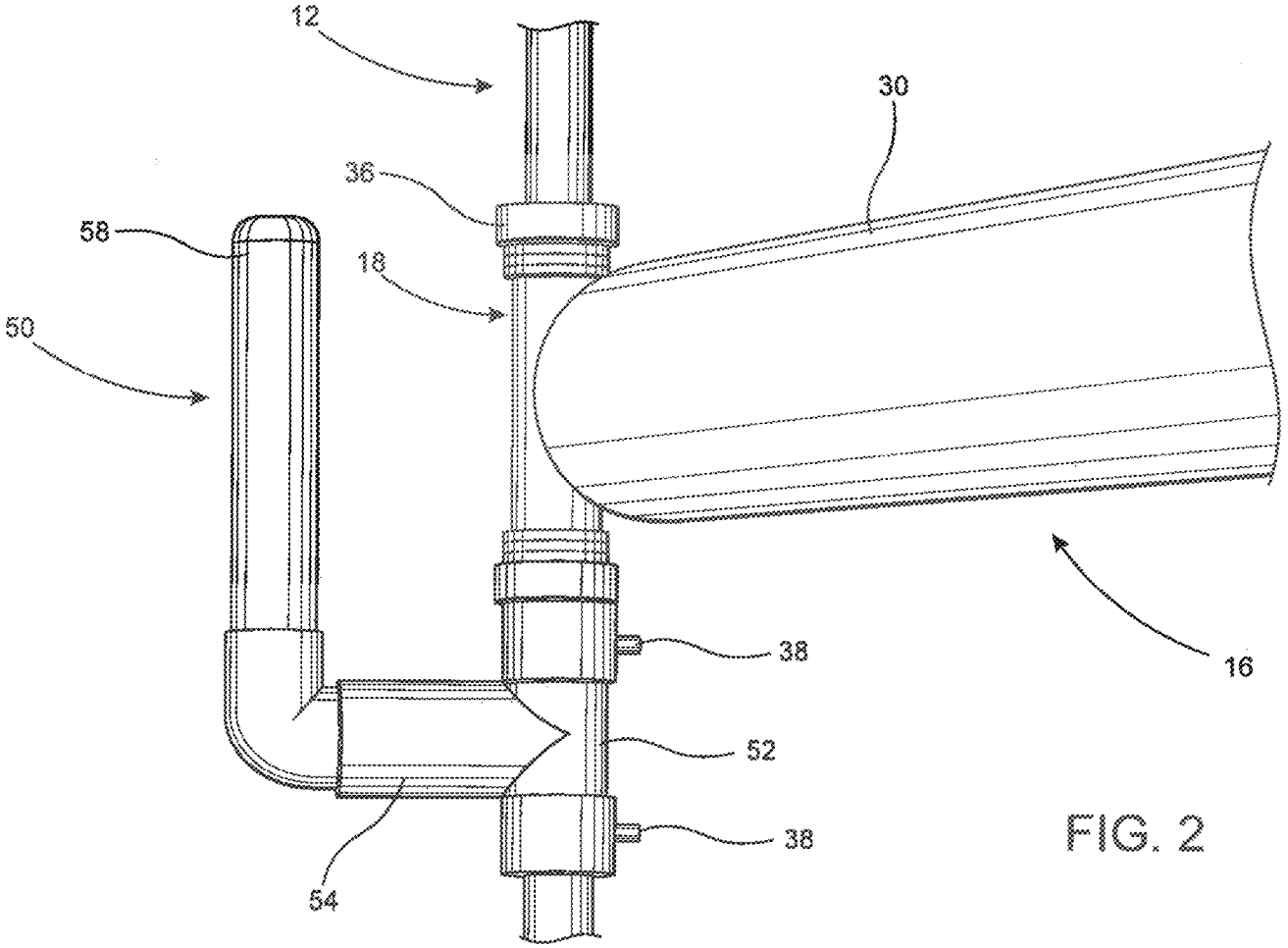
FIG. 2 is a perspective view in partial cutaway disclosing relative positions of the rotating target of the embodiment of FIG. 2 and a resistance assembly which may be cooperatively used therewith.

As represented in the accompanying Figures and with initial, reference to FIG. 1, the present invention is directed to a training assembly generally indicated as 10. The training assembly 10 includes sufficient structural and operative versatility to facilitate its use for both training and exercising. More specifically, the training assembly 10 includes an elongated support shaft or stanchion, generally indicated as 12. In cooperation therewith, a base 14, 14' may be fixedly or removably mounted on a supporting surface such as a floor, ground surface, etc. However, while the vertically upright operative orientation of the exercise assembly 10, as represented in FIG. 1, may be the most popular position of use, the support shaft 12 and cooperative, supporting base 14, 14' may be structured to be oriented in an "inverted orientation", such as by depending from a ceiling surface or extending transversely outward from a side wall or the like.

As also represented in FIG. 1, a reinforcing member 15 may be integrally connected to or otherwise associated with a lower portion of the shaft 12 so as to facilitate its support and mounting on the base 14, 14'. Such reliable mounting of the support shaft, as well as a plurality of target structures mounted thereon is important due to the fact that the support assembly 10 is intended to be repeatedly "struck" as a user performs various boxing, martial arts and/or like activities, while utilizing the exercise assembly 10.

As also represented in FIG. 1, the exercise and/or training assembly 10 includes a plurality of target structures, each of which is intended to receive repeated, forceful blows as the user performs the intended boxing, martial arts, etc. routine. More specifically and with primary reference to FIGS. 1 and 3, the exercise and/or training assembly 10 includes at least one but a possible plurality of rotating targets generally indicated as 16. As will be discussed in greater detail hereinafter, each of the one or more rotating targets 16 are rotationally connected to the support shaft 12 by a rotational fitting, generally indicated as 18, in FIGS. 3 and 5. With primary reference to FIG. 3, each of the one or more rotating targets 16 includes an elongated arm 24 including both a weighted construction generally indicated as 22 and a safety portion generally indicated as 28. The weighted portion 22 preferably comprises an elongated weighted, rigid material member 26, which may be in the form of a rigid material dowel.

As such, the member or dowel 26 extends substantially along at least a majority of the length of the arm 24 and intermediate opposite ends of the arm 24 or intermediate the rotational fitting 18 and the distal end 24' of the arm 24. While the length of the weighted member or dowel 26 may vary, one feature thereof includes the addition of a predetermined amount of weight to the arm 24 and/or rotating targets 16 which will facilitate its continuous rotation about the longitudinal axis of the shaft 12. More specifically and in at least one embodiment such a preferred weight of the arm 24 may be, but is not limited to, being in the range of between 13 and 14 ounces. This predetermined weight may vary depending on the overall structure of the rotating target 16. Further, the overall length of the arm 24 is preferably in the range of between 24 and 25 inches. As represented in FIG. 1 such an extended length of the rotating target 16 and corresponding arm 24 allows it to extend transversely outward from the shaft 12 a significantly greater distance than the other target structures. This extended length further provides a user of the exercise assembly 10 with a greater challenge due to the continuous rotation of the one or more rotating targets 16.

Each of the one or more rotating targets 16 also includes a safety portion 28 defining and extending along the length of the distal end, 24' inwardly towards the rotational fitting 18. The length and overall structure of the safety portion is such as to facilitate the receiving of any forceful blow delivered by the user. Accordingly, an outer end 26' of the weighted member or dowel 26 may be inwardly spaced from the safety portion 28 and the distal end 24' of the arm 24 a sufficient distance to assure that any blow delivered to the rotating target 16 will engage the safety portion 28. Further, the safety portion 28 is formed of a cushioning material such as, but not limited to, a resilient foam type of material which offers at least a predetermined minimal resistance to a blow or punch being thrown by a user. As such, there will be no chance of damage to the user's hand, arm, etc. by the delivery of such a blow to the safety portion 28.

Figure 3:
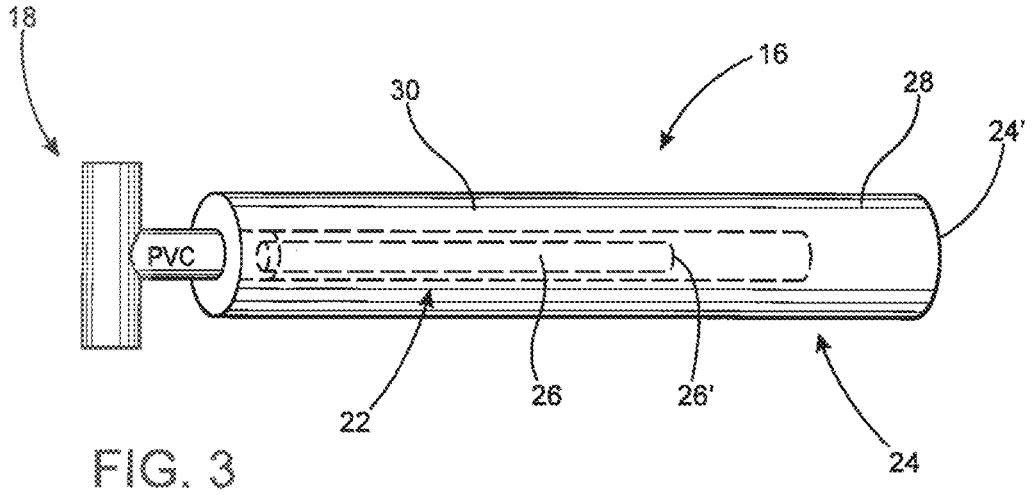
FIG. 3 is a perspective view in detail of a rotating target component of the embodiment of FIG. 1.

However, the at least minimal, non-damaging resistance provided by the safety portion 28 is sufficient to cause the rotation of the arm 24, about the shaft 12 in the manner intended, when the safety portion 28 and arm 24 are being struck. Additional features which enhance the safety of striking the arm 24 includes the provision of an outer sleeve 30 extending along the length of the arm 24, or at least a majority thereof, in overlying, covering relation to the weighted member or dowel 26. As is represented in FIG. 3 the safety portion 28 may in fact be an integrated part of the sleeve 30 since both the sleeve 30 and the safety portion 28 are formed of the aforementioned and described cushioning material such as a resilient foam material. However, it is emphasized that the safety portion 28 and the sleeve 30 may in fact be different structures, wherein the sleeve 30 overlies and covers the safety portion 28.

As also indicated, at least one preferred embodiment of the exercise assembly 10 includes the cooperative structuring of the arm 24 and the rotational fitting 18, such that the arm 24 continuously rotates about the shaft 12 at least 3 to 4 times when a typical blow or punch is delivered thereto by the user. Accordingly, and with primary reference to FIG. 5, the rotational fitting 18 comprises an elongated primary segment 32 having a hollow interior and an outwardly extending connecting segment 34. When disposed in its operative position, the primary portion 32 is disposed in concentrically surrounding relation to the shaft 12. As indicated the connecting segment 34 extends transversely outward therefrom in connected, supporting relation to a remainder of the arm 24 of the rotating target 16. Therefore, the rotational fitting 18 may include a substantially T-shape configuration.

Figure 3B:
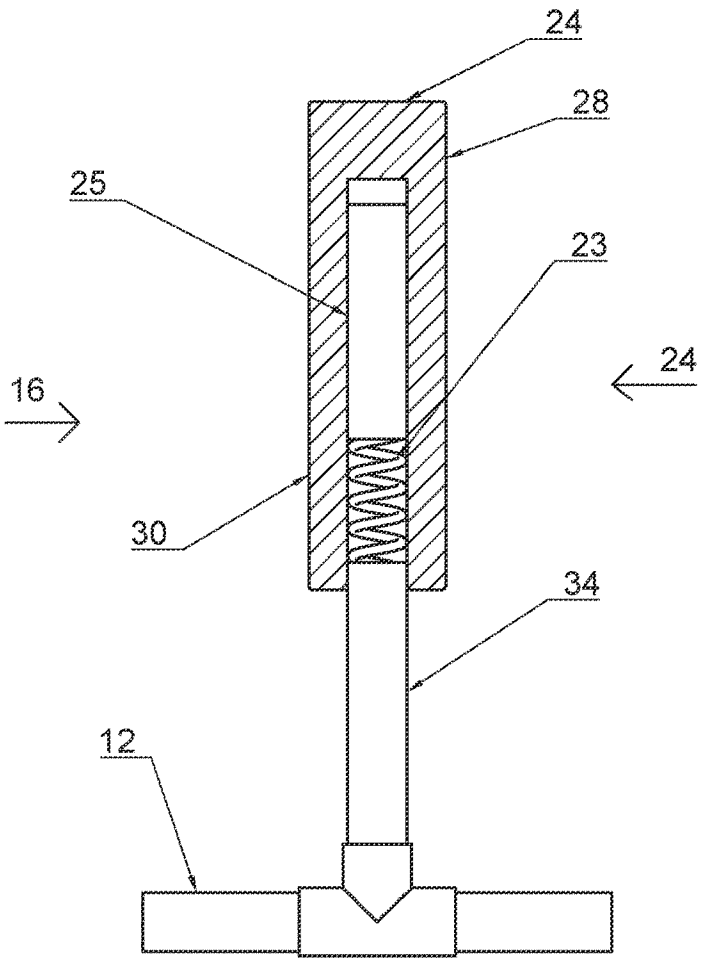
FIG. 3B is a perspective view in detail of another embodiment of the rotating target component of the embodiment of FIG. 1.
Figure 3A:
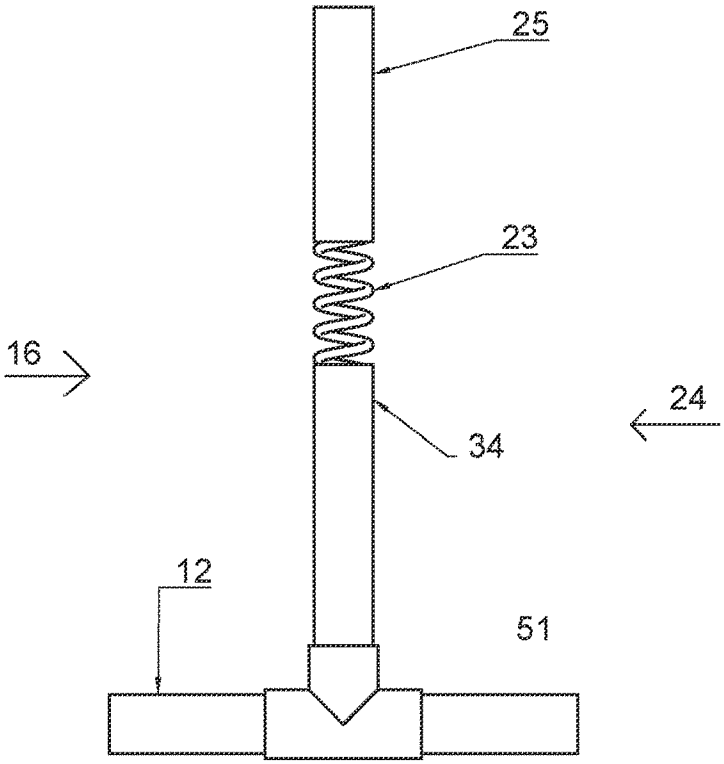
FIG. 3A is a perspective view in detail of a rotating target component of the embodiment of FIG. 3B.

In another embodiment, as illustrated in FIGS. 3A-3B, the elongated arm 24 may include an extension portion 25 and a biasing or spring portion 23 disposed in movably, resiliently interconnecting relation between the distal end 34' of the connecting segment 34 and a proximal end 25' of the extension portion 25. Further, as described above, the elongated arm 24 may include the safety portion generally indicated as 28.

The safety portion 28 may define and extend along the length of the distal end 24' of the arm 24, inwardly towards the rotational fitting 18. The length and overall structure of the safety portion 28 is such as to facilitate the receiving of any forceful blow delivered by the user. Accordingly, a distal end 25" of the extension portion 25 may be inwardly spaced from the safety portion 28 and the distal end 24' of the arm 24 a sufficient distance to assure that any blow delivered to the rotating target 16 will engage the safety portion 28.

The cooperative structuring of the biasing portion 23 and the connected extension portion 25 of the arm 24, may allow a user to deliver an uppercut type blow to the rotating target 16 when in the operative position 302. This may cause the biasing portion 23 to stretch or expand in an upward direction. This may cause the extension portion 25 and safety portion 28 of the arm 24 to at least partially pivot on an upwardly angular trajectory towards the shaft 12. Further, as described above, the elongated arm 24 may include the outer sleeve 30, extending along the length of the arm 24, or at least a majority thereof, in overlying, covering relation to the safety portion 28, extension portion 25, and the spring portion 23.

Figure 5:
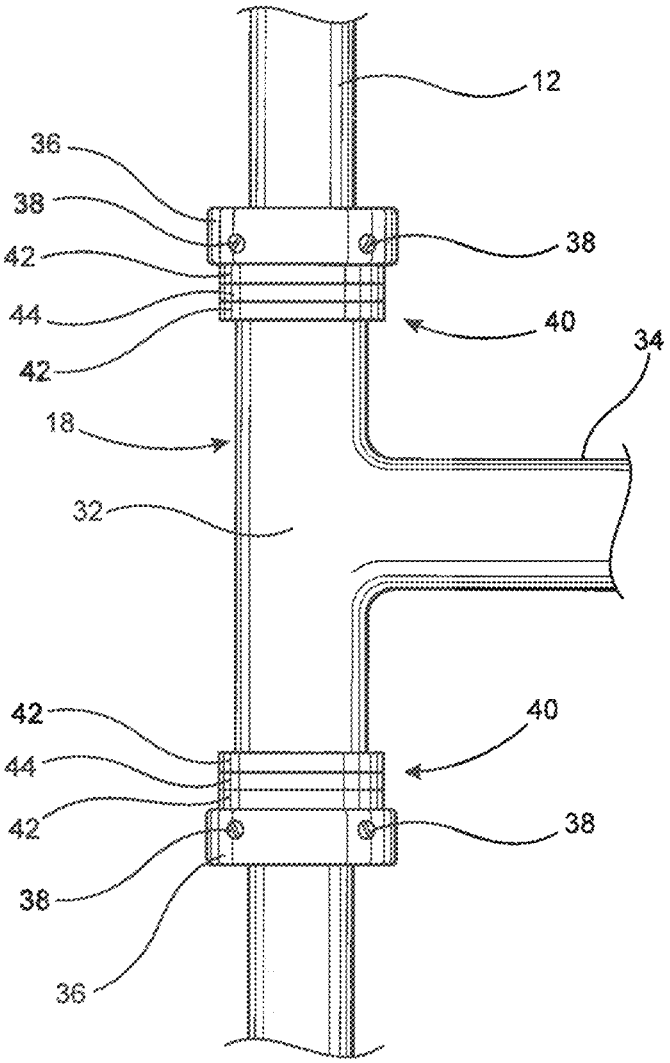
FIG. 5 is a detailed cutaway view of a rotational fitting used to secure and facilitate rotation of the rotating target of the embodiment of FIGS. 1 and 3 relative to the support shaft, in the manner represented in FIG. 1.

Further, the rotational fitting 18 is adjustably secured along the length of the shaft 12 using at least two, oppositely disposed locking collars 36 movably or adjustably connected to the shaft 12 by a plurality of set screws or like connectors 38. Associated with the rotational fitting 18 and operatively held in place by the locking collars 36 are two bearing assemblies generally indicated as 40. Each of the bearing assemblies 40 include two outwardly disposed washers 42 disposed in a sandwiching relation on opposite sides of a bearing structure 44, such as a thrust bearing or the like. As represented in FIG. 5 the locking collars 36 hold corresponding ones of the bearing assemblies 40 in an operative position relative to opposite open ends of the primary portion 32 of the rotational fitting 18. Therefore, rotation of the connecting segment 34 and the arm 24 of the rotating target 16 connected thereto is facilitated.

As emphasized above, one operative feature of the exercise and/or training assembly 10 is the challenge of the user to respond to the rotating target 16 and/or arm 24 as it continuously rotates a plurality of times about the length of the shaft 12. As further indicated this adds to the overall dexterity of the user and provides a more challenging workout.

Figure 25:
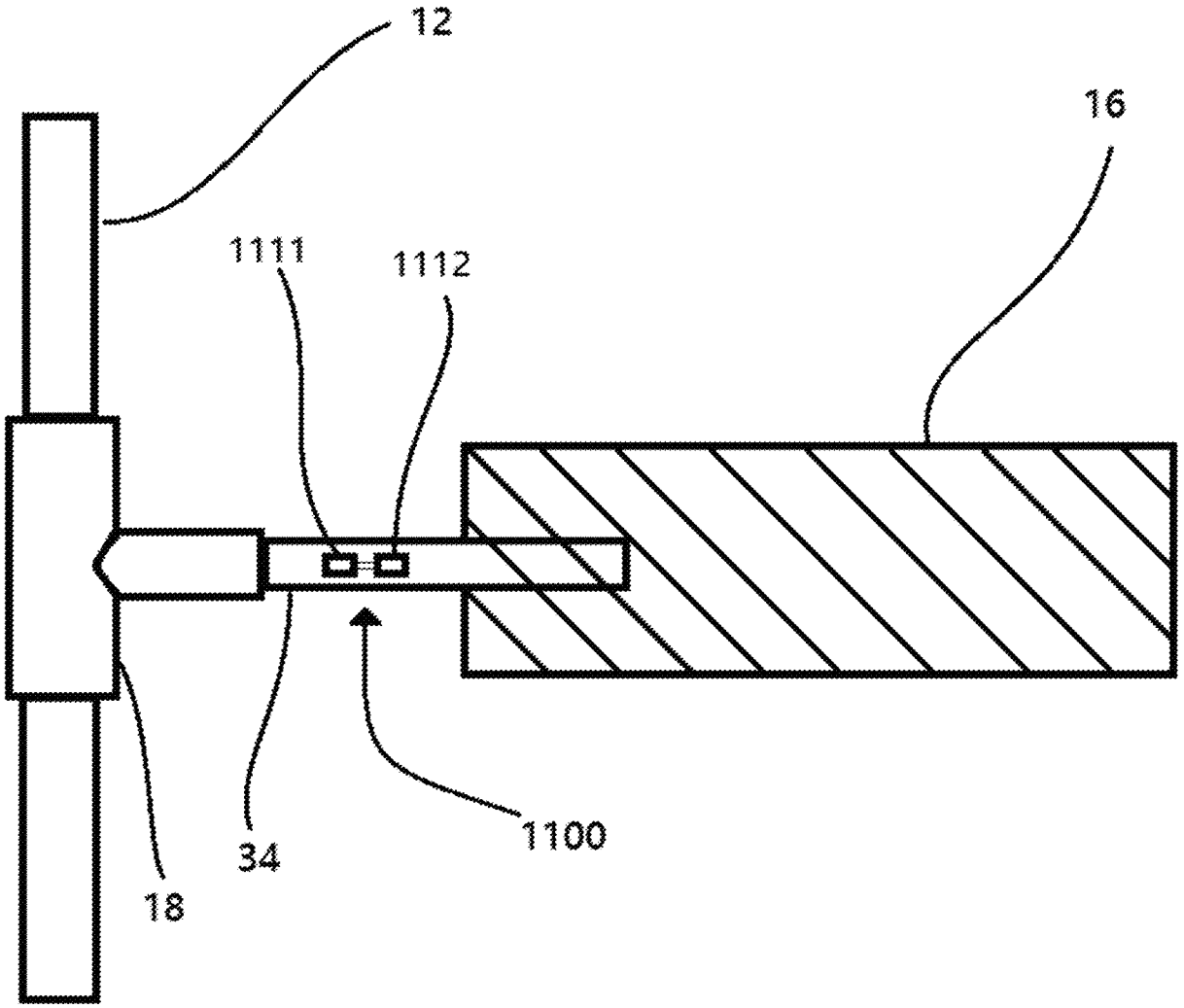
FIG. 25 is a side, partial cut away view of a preferred embodiment of an exercise assembly of the present invention.

With reference now to FIG. 25, another preferred embodiment of a portion of the exercise assembly 10 is shown. Once again, the shaft 12 is depicted with the rotational fitting 18 operatively connected thereto. Further, the outwardly extending connecting segment 34 is operatively engaged with the rotational fitting 18. Operatively connected to the connecting segment 34 is the rotating target 16. In this preferred embodiment, a scoring assembly 1100, is shown, comprising a microprocessor 1112 operatively connected to a sensor 1111 embedded within the connecting segment 34.

The sensor 1111 may be a force sensor, accelerometer, or other senor capable of detecting movement and/or forces inflicted upon it. The microprocessor 1112 may be capable of receiving inputs, measurements, or otherwise digitized information from the sensor 1111 by virtue of communication via electrical connection or wireless means so as to further process such inputs, measurements, or otherwise digitized information. The purpose of the scoring assembly 1100 is to be able to keep a score for a user. The score may also further be used to conduct competitions, games, workouts or signify quantifiable values associated with the exercise assembly.

In one preferred embodiment, the score may be a numerical value wherein a higher numerical value may represent a higher score. In this preferred embodiment, the score may be calculated through communication of the sensor 1111 and the microprocessor 1112. Upon a user striking the moving target 16, the sensor 1111 may detect a force or acceleration associated with the strike on the moving target 16. The sensor 1111 may then communicate with the microprocessor 1112 wherein the microprocessor 1112 may then process the communication and assign such a strike on the target 16 a score. As a user continues to strike the target 16, the scoring assembly 1100 may have the ability to process and keep a total score by virtue of the microprocessor 1112. As the moving target 16 may rotate about the shaft 12 by virtue of the rotational fitting 18, the moving target 16 may complete a full 360 degree rotation or more about the shaft 12 and "hit" the user. A user may be hit by the target 16 if the target 16 was rotating too fast for the user to react, or the user was positioned in the path of rotation of the target 16. If the user is hit by the target 16, a force or acceleration will nonetheless be imposed on the target 16 and subsequently the scoring assembly 1100. The sensor 1111 would then be able to register such a force or acceleration from the hit (to the user) and subsequently communicate this information to the microprocessor 1112. The microprocessor may then process the communication and assign the hit (to the user) a score. This hit score may be a negative score that would otherwise detract from the total score. In such an embodiment, each time the target 16 is struck by a user, the total score stored by the microprocessor 1112 goes up, and each time the target 16 hits the user, the total score stored by the microprocessor 1112 goes down.

FIG. 25 is just one depiction of the location of the scoring assembly 1100. The scoring assembly 1100 may comprise multiple sensors 1111 and multiple microprocessors 1112 located throughout a prospective exercise assembly 10 and its components. Further, each sensor 1111 may be distanced in relation to one or multiple microprocessors 1112 as the two may communicate via wireless means.

As the score may also further be used to conduct competitions, workouts, games or signify quantifiable values associated with the exercise assembly, the microprocessor 1112 may be pre-programmed or programmable to conduct competitions, workouts, games or signify quantifiable values associated with the exercise assembly 10. Further, the microprocessor 1112 may be able to connect to an output, such as, but not limited to a display, speaker or tactile device intended to signify results processed from the microprocessor 1112.

Figure 20:
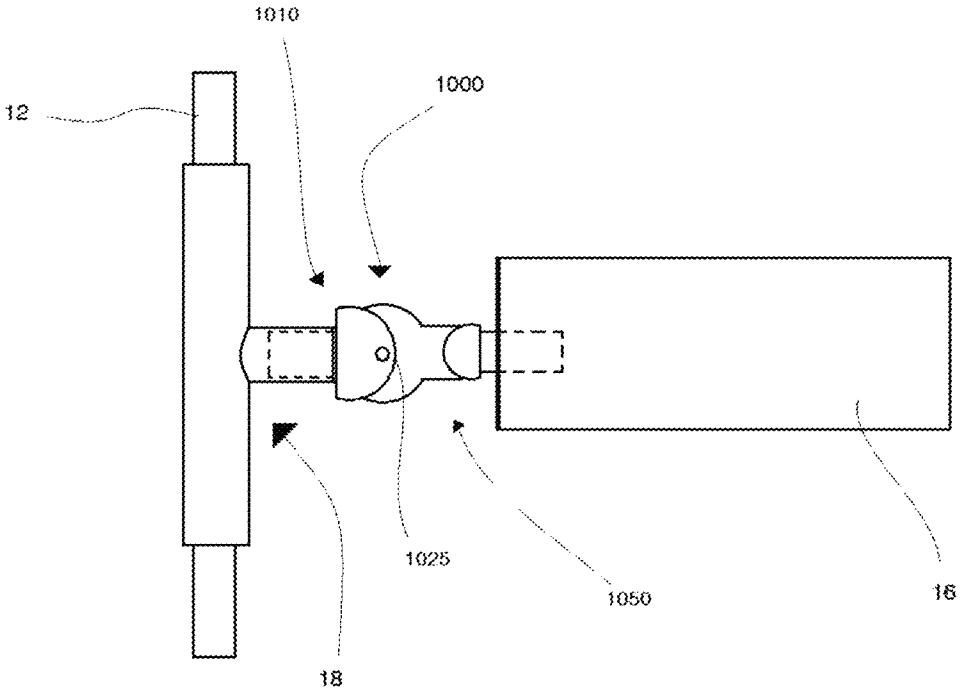
FIG. 20 is a side view of a preferred embodiment of an exercise assembly of the present invention in an operative orientation.
Figure 21:
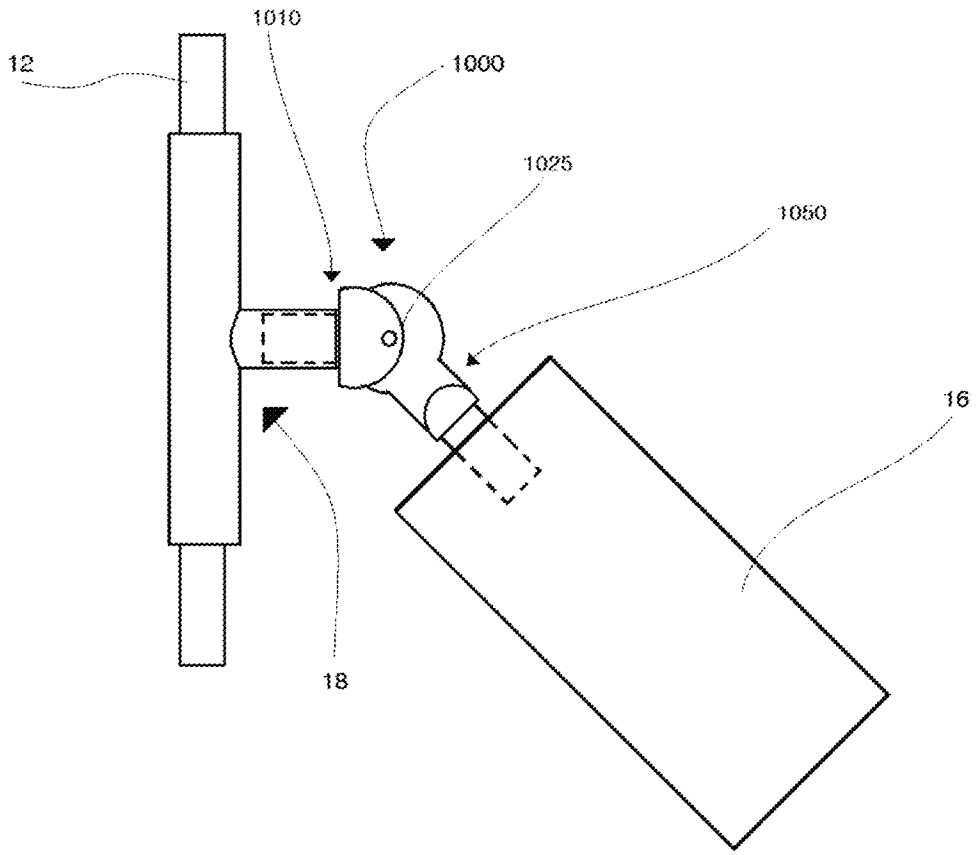
FIG. 21 is a side view of a preferred embodiment of an exercise assembly of the present invention in an inoperative orientation.
Figure 22:
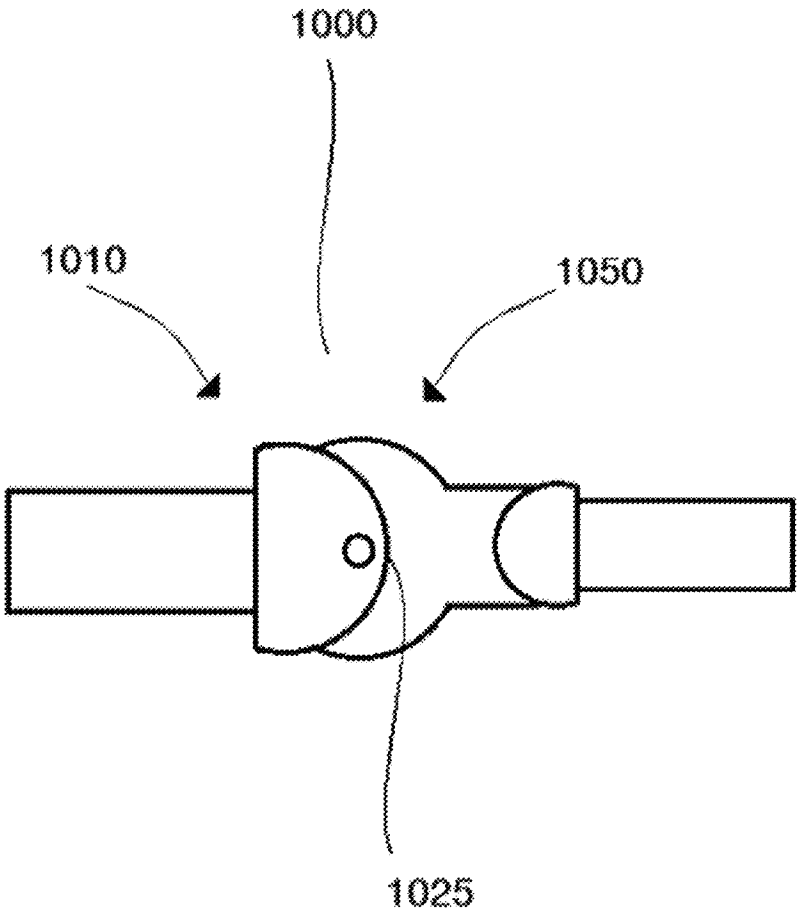
FIG. 22 is a side view of a component of the embodiment of FIG. 20.

In another embodiment, as illustrated in FIGS. 20-22, a breakaway mechanism as indicated by 1000 may connect to the rotational fitting 18, which may be connected to the shaft 12. As shown in the figures, the breakaway mechanism 1000 may also be subsequently connected to the target 16. Accordingly, the breakaway mechanism 1000 may connect to the rotational fitting 18 by means such as, but not limited to a weld, adhesive, thread system, ball bearing connection, or lock and pin. Such a connection at least facilitates the ability of the breakaway mechanism 1000 to rotate about the shaft 12 of the assembly, at least when the rotational fitting 18 is adjustably secured along the length of the shaft 12. Also, the breakaway mechanism 1000 may connect to any portion opposite the distal end 24' of the target 16 by means such as, but not limited to a weld, adhesive, thread system, ball bearing connection, or lock and pin.

In referencing FIGS. 20-22, the breakaway mechanism 1000 can comprise at least two distinct portions, a static interconnect 1010 and a target interconnect 1050. The static interconnect 1010 and target interconnect 1050 can be conjoined via a restricting assembly or connector 1025. The static interconnect 1010 may connect to the rotational fitting 18 and the target interconnect 1050 may connect to a portion of the target 16. Subsequently as show in FIGS. 20 and 21, the static interconnect 1010, has been operatively engaged with the rotational fitting 18, and the target interconnect 1050 has been operatively engaged with a portion of the target 16. The connector 1025 may then facilitate a moveable connection between the static interconnect 1010 and the target interconnect 1050 between an operative and inoperative orientation, wherein these orientations can also be used to describe the orientation of the breakaway mechanism 1000, target 16, rotational fitting 18, shaft 12, assembly 10 or any combination or singularity of conjoined elements described as a whole.

In FIG. 20, one operative orientation of the breakaway mechanism 1000, target 16, rotational fitting 18, shaft 12, assembly 10, or any combination or singularity of conjoined elements described, is shown wherein the connections between the rotational fitting 18, breakaway mechanism 1000 and target 16 are "aligned". The alignment may be defined as all connections forming a straight-line assembly of the component's connections, absent any substantial angle between the points of connections between each component. An operative orientation may also be defined as any alignment of the breakaway mechanism 1000 and the target 16 and/or all connections formed from the component's connections, wherein the target 16, when struck by an accurately directed force, will result in the breakaway mechanism 1000 and all orientations and connections formed from the component's connections, to remain angularly unchanged. A more definite teaching of accurately or misdirected forces will be explained herein.

In FIG. 21, one embodiment of an inoperative orientation of the breakaway mechanism 1000 is shown. This inoperative orientation of the breakaway mechanism 1000 is shown wherein the connections between the rotational fitting 18, breakaway mechanism 1000 and target 16 are "misaligned". This misalignment may be defined as at least one connection forming an angle in relation to connections of the components. An inoperative orientation may also be defined as any alignment of the breakaway mechanism 1000 and the target 16 and/or all connections formed from the component's connections, wherein the target 16, when struck by an inaccurately directed force, will result in the breakaway mechanism 1000 and at least one orientation and connection formed from the component's connections, to be altered angularly. A more definite teaching of accurately or misdirected forces will be explained herein.

In FIG. 21, the connector 1025 facilitated a moveable connection between the static interconnect 1010 and target interconnect 1050 from an operative to inoperative orientation. Indeed, the connector 1025 is at least in part able to facilitate a moveable connection between the static interconnect 1010 and the target interconnect 1050. In these embodiments, the connector 1025 acts as a hinge joint that is able to be placed in a state of extension, which may generally correspond to the operative orientation, to be manipulated to be placed in a state of flexion, which may generally correspond to the inoperative orientation. Subsequently, the status of flexion or extension defined by the connector 1025 may define an axis of rotation of the static interconnect 1010 and target interconnect 1050. This axis of rotation may be restricted to less than 360 degrees if when in rotation, any portion of the static interconnect 1010 and target interconnect 1050 come in contact with each other, thus materially impeding any further rotation. This moveable connection is intended to allow a rotational movement of the target interconnect 1050 in relation to the static interconnect 1010 which may remain in a static positioning.

When at least in an operative orientation, the breakaway mechanism 1000 is capable of rotating about the shaft 12 when the target 16, connected to the breakaway device 1000, receives an accurately directed force inflicted on the target 16 by a user. An accurately directed force can be defined as a force, blow, punch or otherwise impact directed upon the target 16 wherein the substantial direction of the impact is substantially perpendicular the shaft 12. An accurately directed force may also be defined as a force, wherein the direction of force applied is subsequently intended to cause a forced rotation of the target 16 about the shaft 12. When at least in the operative orientation, the breakaway mechanism 1000 is also capable of rotating about the shaft 12 and maintaining operative orientation upon the target 16 receiving an accurately directed force.

Further, when at least in an operative orientation, the breakaway mechanism 1000 is capable of rotating about the shaft 12 or not rotating about the shaft 12 and transitioning into an inoperative orientation upon the target 16 connected to the breakaway mechanism 1000 receiving an inaccurately directed force. An inaccurately directed force can be defined as a force, blow, punch or otherwise impact directed upon the target 16 wherein the substantial direction of the impact is not perpendicular the shaft 12. A misdirected force can also be defined as a force, inadvertently directed at an angle in relation to the shaft 12, which will subsequently be in a direction to not cause rotation of the target about the support shaft. Upon transitioning into an inoperative orientation, the breakaway mechanism 1000 and target 16 may continue rotating about the shaft 12 until frictional forces or other impeding forces prevent further rotation.

When at least in an inoperative orientation, the breakaway mechanism 1000 is capable of rotating about the shaft 12 upon the target 16 connected to the breakaway mechanism receiving a forceful blow by the user.

Figure 23:
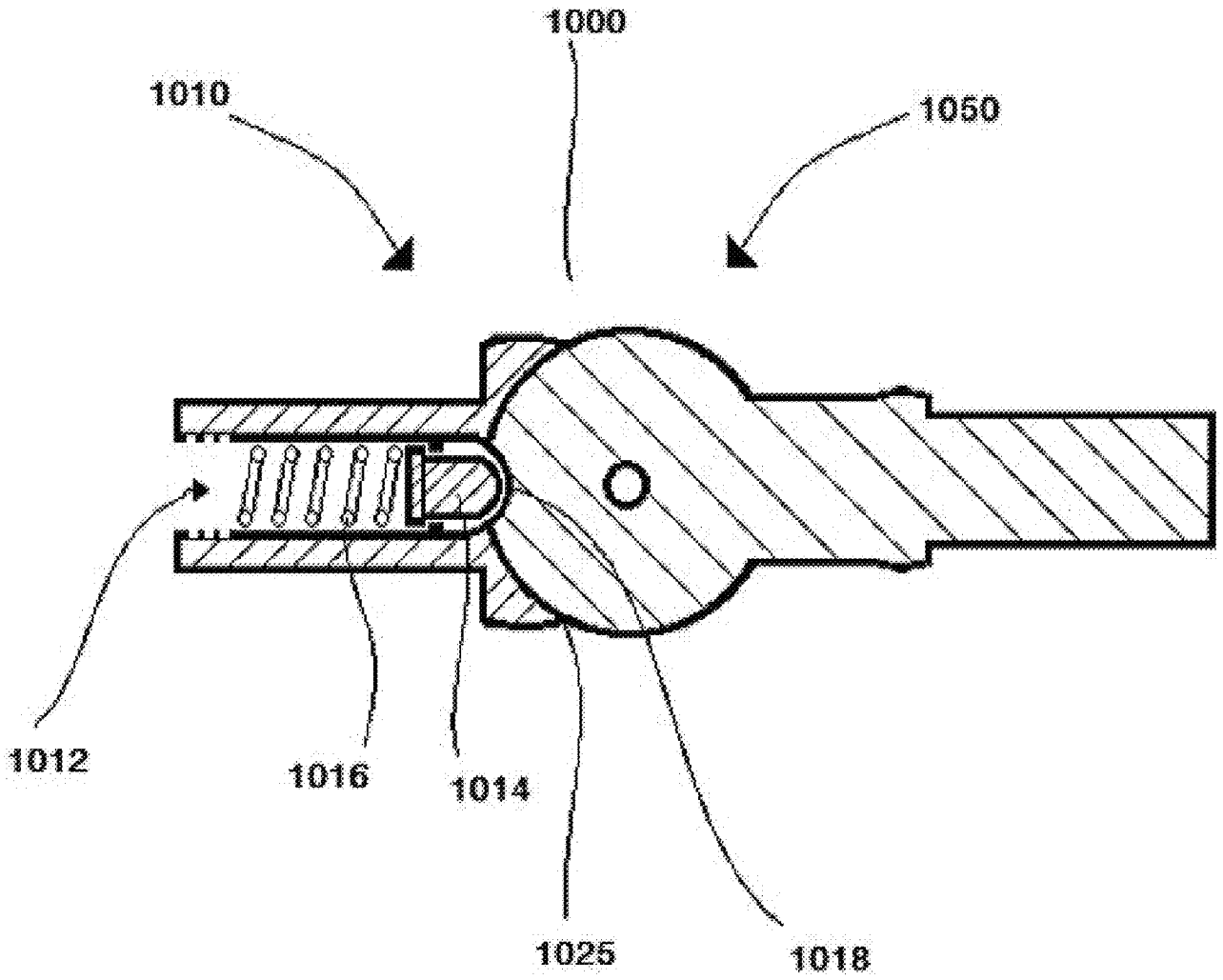
FIG. 23 is a side, partial cut away view of a component of the embodiment of FIG. 20 in an operative orientation.
Figure 24:
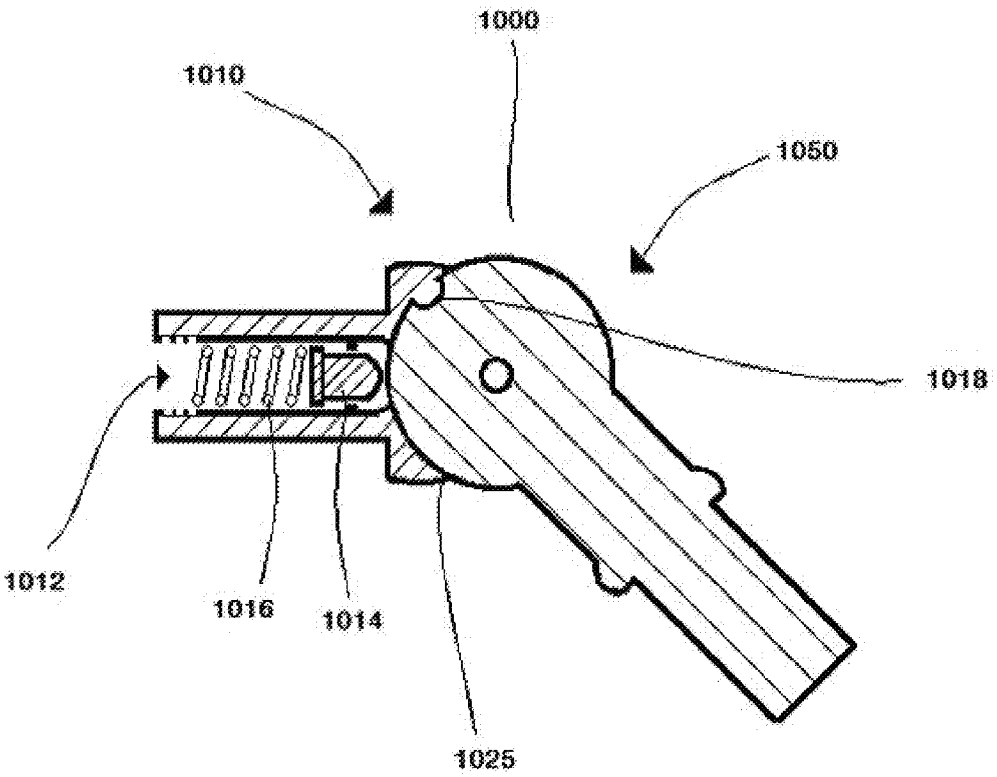
FIG. 24 is a side, partial cut away view of a component of the embodiment of FIG. 20 in an inoperative orientation.

With reference to FIGS. 23 and 24, either the breakaway mechanism 1000 or restricting assembly or connector 1025 may further comprise a retaining assembly 1012. The retaining assembly 1012 may be comprised of at least a retainer member 1014 and catch 1018. The retaining assembly 1012 can facilitate movement of the breakaway mechanism 1000 from an operative to inoperative orientation. The catch 1018 can be located within the target interconnect 1050 or connector 1025 and the retainer member 1014 can be located across the target interconnect 1050 or connector 1025 and static interconnect 1010, combined or in singularity.

When the breakaway assembly 1000 is at least in an operative orientation, the retainer member 1014 may inflict a force on the catch 1018, at least by means of contact with the catch 1018. Such a force may be produced by another portion of the retaining assembly 1012, that portion being an application mechanism 1016. The application mechanism 1016 is shown as a compressible spring in the figures, but may comprise any means such as, but not limited to, a spring, retainer, ball bearing etc. In at least one embodiment, the inflicting force described above is produced by the application mechanism 1016, directed onto the retainer member 1014 and translated on the catch 1018. Subsequently, as represented in FIG. 23, the retainer member 1014, is disposed in biased engagement with the catch 1018, through the provision of the application mechanism 1016 being in the form of a biasing structure or spring.

Also, when the breakaway assembly 1000 is at least in an operative orientation, and connected to the rotational fitting 18 and target 16, wherein the rotational fitting 18 is connected to the shaft 12, the inflicting force may be strong enough to ensure the point of contact between the retainer member 1014 and catch 1018 remains unchanged. This unchanged relationship may be facilitated through, the breakaway assembly 1000 remaining at rest, the breakaway assembly 1000 rotating about the shaft 12, and/or the breakaway assembly 1000, when starting at rest or while in rotation about the shaft 12, receiving an accurately directed force inflicted on the target 16 by a user.

This point of contact between the retainer member 1014 and catch 1018 remaining unchanged may be facilitated via a male and female engagement, frictional disposition, joint latch, or adhesive. This point of contact remaining unchanged may also be described as a retaining engagement and further defines the operative orientation.

Further, when the breakaway assembly 1000 is at least in an operative orientation, and connected to the rotational fitting 18 and target 16, wherein the rotational fitting 18 is connected to the shaft 12, the inflicting force may not be strong enough to ensure the point of contact between the retainer member 1014 and catch 1018 remains in contact. This loss of contact may be facilitated through, the breakaway assembly 1000 remaining at rest and receiving an inaccurately directed force inflicted on the target 16 by a user, and/or the breakaway assembly 1000 rotating about the shaft 12 and receiving an inaccurately directed force inflicted on the target 16 by a user.

Such an inaccurately directed force applied to the target 16 may disengage the point of contact between the retainer member 1014 and catch 1018. An inaccurately directed force may cause the retainer member 1014, and subsequently the application mechanism 1016 to receive a force overcoming the force of the retainer member 1014, and subsequently the application mechanism 1016 is inflicting on the catch 1018, thus facilitating a disengagement of the point of contact made with the catch 1018. This disengagement may be known as place the retaining member 1014 and catch 1018 in a non-retaining engagement. This non-retaining engagement also may dispose the target interconnect 1050 and static interconnect 1010 in a rotational state. This rotational state may be defined as the ability of the target interconnect 1050 to rotate about the static interconnect 1010. This non-retaining engagement and/or rotational state further defines the inoperative orientation.

This overcoming of force may then allow the connector 1025 to rotate the target interconnect 1050, and subsequently, the target 16 in relation to the static interconnect 1010 concurrent to a state of non-retaining engagement. This rotation may mitigate and/or translate the forces of an inaccurately directed force on the target 16 from that of a blow, punch or otherwise impact of a user into rotational energy. This rotational energy or otherwise mitigation of forces may reduce the stresses on the target 16 and any of its components. This rotation may also mitigate the forces of an inaccurately directed force on the target 16 from that of a blow, punch or otherwise impact of a user away from the rotational fitting 18 or shaft 12. It is important to note, at least one advantageous feature of the breakaway mechanism 1000, is to minimize the chance of damage to the rotational fitting 18, or other parts of the assembly 10, when a misdirected force is directed to the target 16 via such rotation. The state of allowing the connector 1025 to rotate the target interconnect 1050, and subsequently, the target 16 in relation to the static interconnect 1010, further defines the inoperative orientation. As such, in these embodiments, the connector 1025 acts as a releasable hinge joint that is able to be placed in a state of extension, to be manipulated to be placed in a state of flexion, at least when transitioning from a retaining engagement to a non-retaining engagement.

When at least in the operative orientation, breakaway mechanism 1000 or the assembly 10 will remain in the inoperative orientation until gravity, a user, or other directed force places the retainer member 1014 and catch 1018 back into a retaining engagement, thereby placing the breakaway mechanism 1000 or assembly 10 into the operative orientation.

Figure 4:
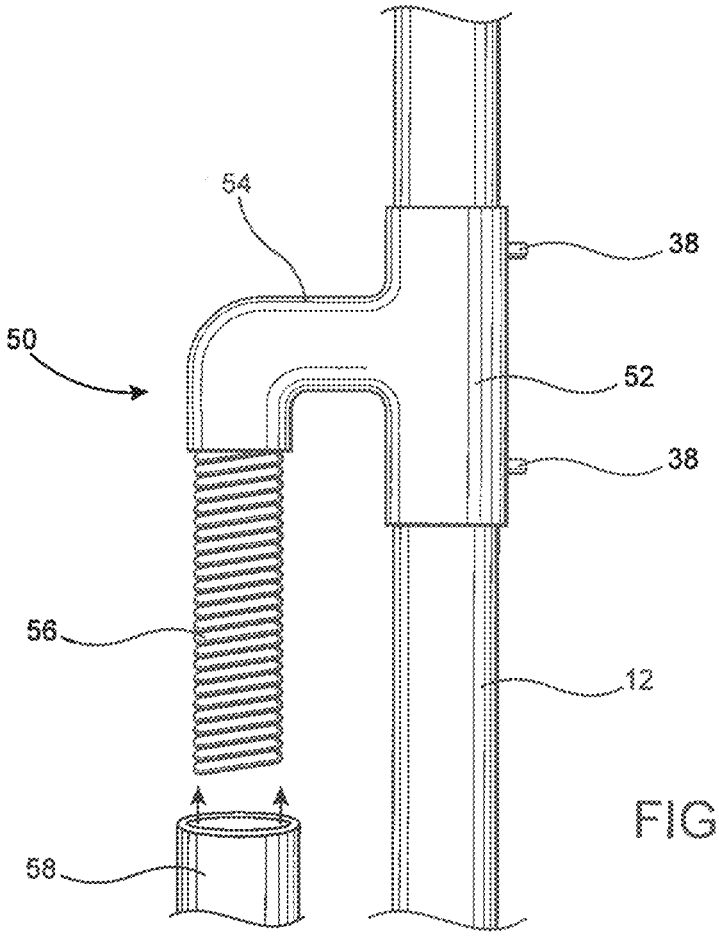
FIG. 4 is a detailed view in partial cutaway and exploded form disclosing structural details of the resistance assembly as represented in the embodiments of FIGS. 1 and 2.

Referring now to FIGS. 3 and 4, yet another operative feature of the rotating target 16 is its intended "restricted rotation" through a rotational path of less than 360° or less than a complete circular path about the longitudinal axis of the shaft 12. Accordingly, at least one preferred embodiment of the exercise and/or training assembly 10 further comprises a resistance assembly 50 which is adjustably but fixedly secured to the shaft 12 by a fitting 52, utilizing one or more sets screws 38. More specifically, the resistance assembly 50 is disposed in a predetermined location relative to the rotational path of a corresponding one of a possible plurality of arms 24 of one or more rotating targets 16. Therefore, the resistance assembly may be purposefully disposed in an "interruptive position" relative to the rotational path of the arm 24. As such, rotation of the arm will be restricted and/or prevented from accomplishing a complete 360° arc of rotation.

Further, the resistance assembly 50 includes a support segment 54 which may be considered a part of the fitting 52 adjustably connected to the shaft 12. Also, the resistance assembly 50 includes a biasing or spring structure 56 which is disposed to engage the arm 24 during its rotation. For purposes of safety, the biasing or spring structure 56 may be covered by a sleeve member 58, which may also be formed of a cushioning material of the type described above and from which the safety portion 28 and the sleeve 30 of the arm 24 is formed. In addition, the biasing structure 56 is disposed and calibrated or otherwise structured to stop rotation of the arm 24 and deliver or impose a directional, biasing force on the rotating arm 24. Such a biasing force will not only stop the rotation of the arm 24, but force it to rotate in an opposite direction, back towards the user. More specifically, the biasing structure 56 of the resistance assembly 50 will exert a biasing force on the rotating arm 24 in a direction which is substantially opposite to the initial direction of rotation of the arm 24 along its intended rotational path of travel. This will serve to reverse and redirect the rotation of the arm 24 back towards the user. In turn, the user can appropriately react by purposefully "ducking" the returning rotating arm 24 and or delivering an additional defensive blow thereto, dependent on the particular exercise or training activity which the user is practicing. It should be noted that a plurality of such resistance of assemblies 50 may be utilized with correspondingly disposed ones of a plurality of rotating target 16. It should also be noted that a plurality of resistance assemblies 50 may be utilized with correspondingly disposed ones of a plurality of rotating targets 16 wherein the plurality of rotating targets 16 are respectively connected to a breakaway mechanism 1000, as represented in FIGS. 21-24.

Figure 6:
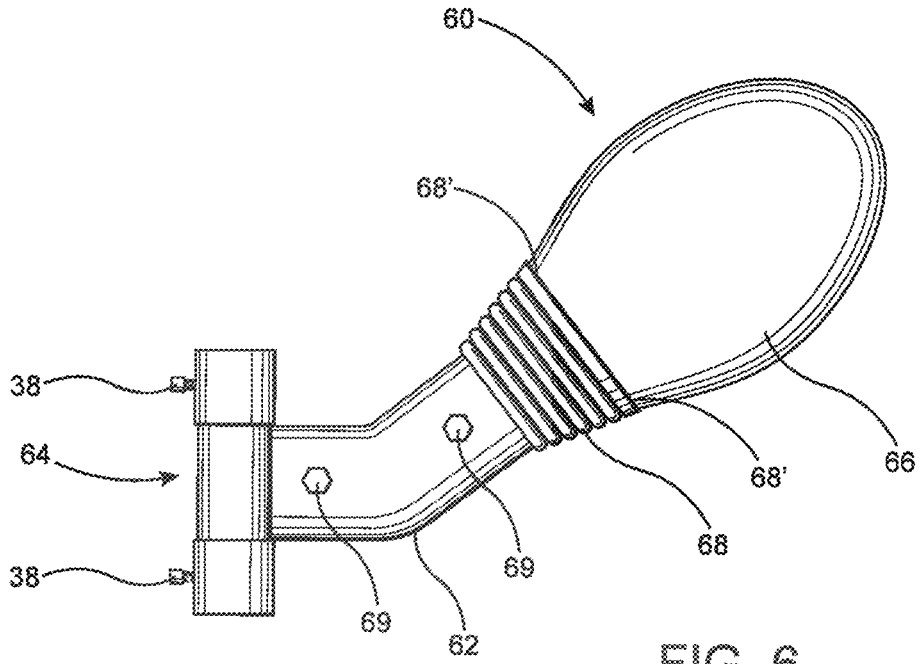
FIG. 6 is a side detail view of a head target also represented in an operative position in FIG. 1.
Figure 7:
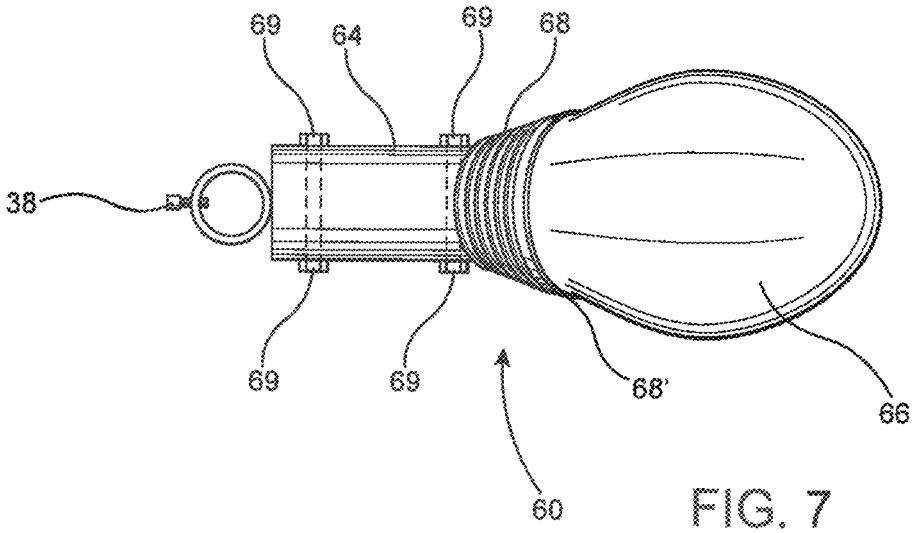
FIG. 7 is a top view of the embodiment of FIG. 6.

As represented in FIGS. 1, 6 and 7 the versatility of the exercise assembly of the present invention is further demonstrated by the provision of a head target 60. The head target 60 includes a support member which is preferably a rigid arm segment 62 adjustably secured along the length of the shaft 12 by fitting 64. The fitting 64 is intended to adjustably but fixedly dispose the head target 60 at a predetermined or preferred location along the length of the shaft 12 and at a preferred or appropriate height. The height and/or position of the head target 60 along the length of the shaft 12 may be dependent on the height or stature of the user or, as set forth above, the particular activity being practiced by the user is.

Accordingly, the head target 60 includes a target section 66 which defines a distal or outer end of the head target 60. The target section is structured to be struck or receive a blow from the user. In addition, a spring segment 68 is included as part of the head target 60 and is disposed in movably, resiliently interconnecting relation between the support arm segment 62 and the inner or proximal end of the target section 66. Further, the spring segment 68 may have a substantially conical configuration, which serves to enhance the support of the target section 66 and maintain it in a preferred orientation or position.

As such, the conically configured spring 68 extends divergently outward such that the larger and more open end thereof 68' is disposed in at least partially surrounding and/or gripping relation to the proximal end of the target section 66, as clearly represented in FIGS. 6 and 7. The specific dimension, configuration and overall structuring of the head structure 60 may vary and as such may require the use of one or more connectors 69 serving to securely but appropriately connect the target section 66 to the outer end of the support segment 62 in combination with the operative placement of the spring structure 68. Such structuring of the head target 60 also facilitates its use as a "speed bag" in a conventional manner in which such speed bags are used. In order to provide a more realistic appearance and disposition of the head target 60 and make it more "available" to receive repeated blows or punches from a user, it may be disposed at an acute angle relative to the length of the shaft 12 and be directed either upwardly or downwardly at such an acute angle.

As represented in FIG. 1, at least one preferred embodiment of the exercise assembly 10 also include one or more fixed targets 70 which may be similarly structured as the head target 60. More specifically, each of the one or more fixed targets 70 may include a support arm segment 62, a target portion or section 66 structured, to receive a blow from the user. Also, each of the one or more fixed targets 70 may be fixedly but adjustably secured to the shaft 12 by fitting 64. Further, in order to facilitate the target section 66 absorbing a plurality of blows or punches, a resilient, spring segment 68 may also serve to interconnect the target section 66 with the support segment 62, of the one or more fixed targets 70. Moreover, the spring element in both the head target 60 and one or more fixed targets 70 will be calibrated and/or otherwise structured to absorb the force of a blow exerted on the target section 66, but cause a return of the target section 66 to an original outwardly extending orientation as represented in the Figures. Also, as with the head target 60, the structural components of the each of the fixed targets 70, as set forth above, are such as to absorb a punch or blow from the user in a manner which does not cause a displacement and/or rotation of the fixed targets 70 about the shaft 12. Further, the one or more fixed targets 70 may be strategically or appropriately placed along the length of the support shaft 12 at any one of a plurality of outwardly extending directions, which facilitate the practice of any boxing, martial arts or like activities being performed by the user. As also represented in FIG. 1 each of the one or more fixed targets 70 may have an elongated substantially linear configuration rather than the acutely angled configuration of the head target 60.

Figure 8:
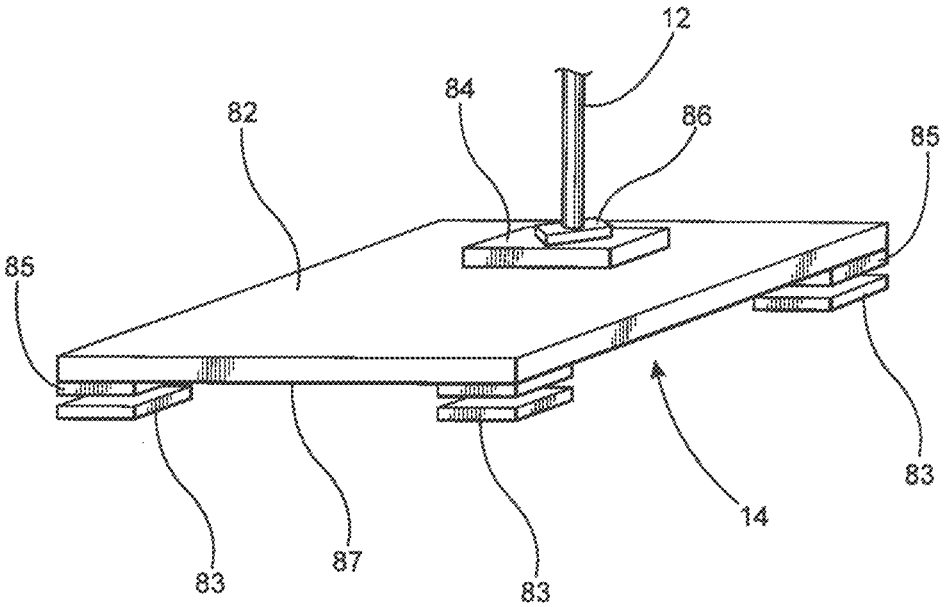
FIG. 8 is a perspective view in partial cutaway of one embodiment of a base in accord with the embodiment of FIG. 1.
Figure 9:
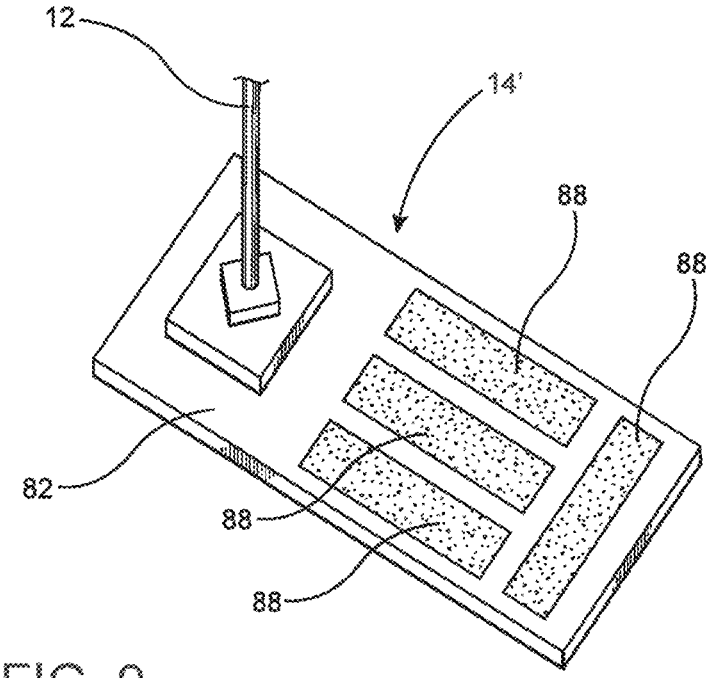
FIG. 9 is a perspective view in partial cutaway of yet another preferred embodiment of the base.

With primary reference to FIGS. 8 and 9, the aforementioned base 14 and 14' are provided to support the shaft 12 in an upright and/or other outwardly extending orientation relative thereto. In at least one preferred embodiment as represented in FIG. 8, the base 14 includes a substantially planar platform having an outer face or surface 82. The support shaft 12 is removably or fixedly connected to the base 14 and may include a plurality of supplementary supports in the form of plates, blocks, levels, etc. 84 and 86 disposed in engaging, supporting relation to the corresponding end of the shaft 12. More specifically, at least two supplementary supports or levels 84, 86 may be required in order to properly support the corresponding end of the shaft 12. Such support may be considered frequently necessary due to the plurality of target structures, as set forth above, receiving repeated blows or punches from a user. In another embodiment, the base 14, 14' and/or the supplementary levels 84, 86 may include a level with indicating bubbles so as to facilitate the proper orientation of the shaft 12 relative to a supporting surface.

As also represented in FIG. 8, the base 14 may be removably secured to a supporting surface such as a floor or the like. In doing so, a plurality of mounting members 83 may be fixedly or removably secured to the corresponding support surface and be disposed in an orientation so as to be removably connected to corresponding mounting structures 85 formed on the under face or under surface 87 of the base 80. Interconnection between the mounting members 83 and 85 may be accomplished by an appropriate adhesive material or other sufficiently strong connecting structures to maintain the stability of the base 14 while in use.

As represented in FIG. 9, yet another preferred embodiment of the base is represented as 14'. In this embodiment, the planar platform is sufficiently dimensioned and configured to have a user being supported on an outer face or surface 82 thereof. As such, the base 14' is structured to support the shaft in an outwardly and/or upright orientation concurrently to allowing the user to stand on the exposed or outer surface or face 82 of the base 14'. Such positioning of the user is further facilitated by the inclusion of a slip-resistant and/or traction enhancing structure 88 mounted on the outer exposed surface or face 82. Such a slip-resistant structure 88 may comprise a single segment or, as represented in FIG. 9A plurality of segments. In either structural variation, the slip-resistant structure 88 would be disposed so as to engage the moving feet of the user, while practicing the intended exercise and or training activity.

Figure 10:
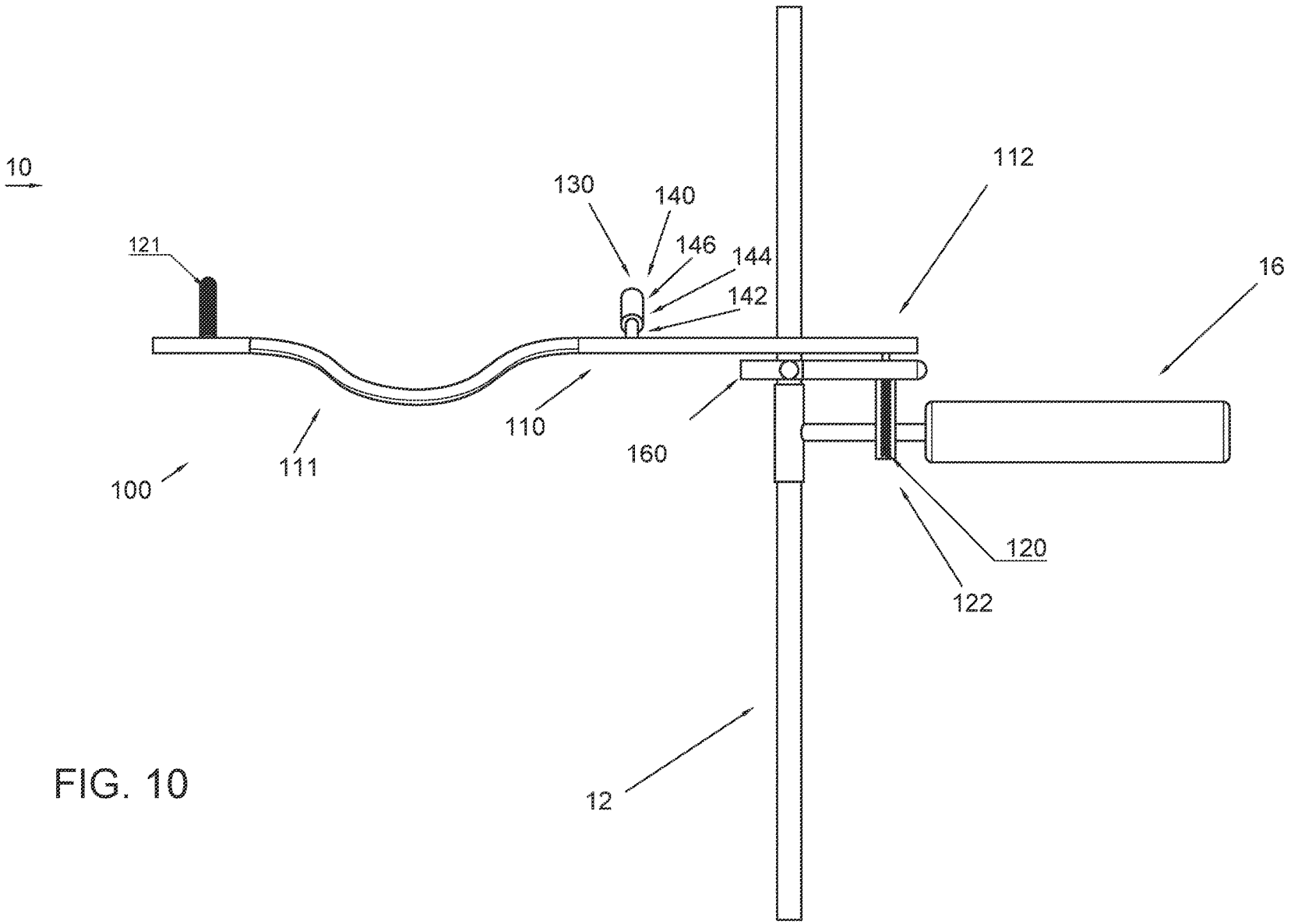
FIG. 10 is a perspective view of another preferred embodiment of an exercise assembly of the present invention.

However, yet another operative feature of the rotating target 16 is its intended "intermittent restricted rotation" through a rotational path of less than 360° or less than a complete circular path about the longitudinal axis of the shaft 12. As such, and as described in greater detail hereinafter, rotation of the arm will be intermittently or randomly restricted and prevented from accomplishing a complete 360° arc of rotation. Accordingly, and as represented in FIG. 10, another preferred embodiment of the training assembly 10 further comprises a solenoid-arm assembly generally indicated as 100. The solenoid-arm assembly 100 includes sufficient structural and operative versatility to facilitate its use while used in combination with the one or more rotating targets 16 as described above. The solenoid-arm assembly 100 may restrict the rotation of the rotating target 16 to a rotational path of less than 360° about the longitudinal axis of the shaft 12. More specifically, the solenoid-arm assembly 100 may be disposed in a predetermined location relative to the rotational path of the corresponding rotating target 16. Therefore, the solenoid-arm assembly 100 may be purposefully disposed in an interruptive position relative to the rotational path of the rotating target 16. As such, rotation of the rotating target 16 may be restricted and/or prevented from accomplishing a complete 360° arc of rotation about the shaft 12.

Additionally, the solenoid-arm assembly 100 includes a pivot arm 110 operatively positioned so as to pivot into and out of an interruptive position relative to the rotational path of the rotating target 16. As such, the pivot arm 110 includes a lower biasing structure 120 which defines a distal or outer end of the pivot arm 110. The lower biasing structure 120 is disposed to engage the rotating target 16 during its rotation, when in the active orientation 122, as explained in greater detail hereinafter. The lower biasing structure 120 is calibrated or otherwise structured to stop the rotation of the rotating target 16 and deliver or impose a directional biasing force on the rotating target 16. Such a biasing force will not only stop the rotation of the rotating target 16, but force it to rotate in an opposite direction, back towards the user. More specifically, the lower biasing structure 120 will exert a biasing force on the rotating target 16 in a direction which is substantially opposite to the initial direction of rotation of the rotating target 16 along its intended rotational path of travel. This will serve to reverse and redirect the rotation of the rotating target 16 back towards the user. In turn, the user can appropriately react by purposefully side-stepping the returning rotating target 16 and/or deliver an additional blow thereto, dependent on the particular exercise or training activity which the user is practicing. It should be noted that a plurality of such solenoid-arm assemblies 100 may be utilized with correspondingly disposed ones of a plurality of rotating targets 16. Further, the pivot arm 110 includes a top biasing structure 121 which defines a proximal or inner end of the pivot arm 110. The top biasing structure 121 is structured to expedite the positioning of the lower biasing structure 120 into the active orientation 122.

Additionally, as described above, the solenoid-arm assembly 100 will restrict the rotation of the rotating target 16 when the lower biasing structure 120 is in the active orientation 122. As such, the solenoid-arm assembly 100 includes an activation mechanism 130 structured to randomly position the lower biasing structure 120 between the active orientation 122 and an idol orientation 123. When the lower biasing structure 120 is in the active orientation 122 it is positioned into an interruptive position relative to the rotational path of the rotating target 16. More specifically, the transversely extending rotating target 16 will engage the lower biasing structure 120 during its rotation about the shaft 12. However, when the lower biasing structure 120 is in the idol orientation 123 it is positioned into a non-interruptive position relative to the rotational path of the rotating target 16.

Figure 10A:
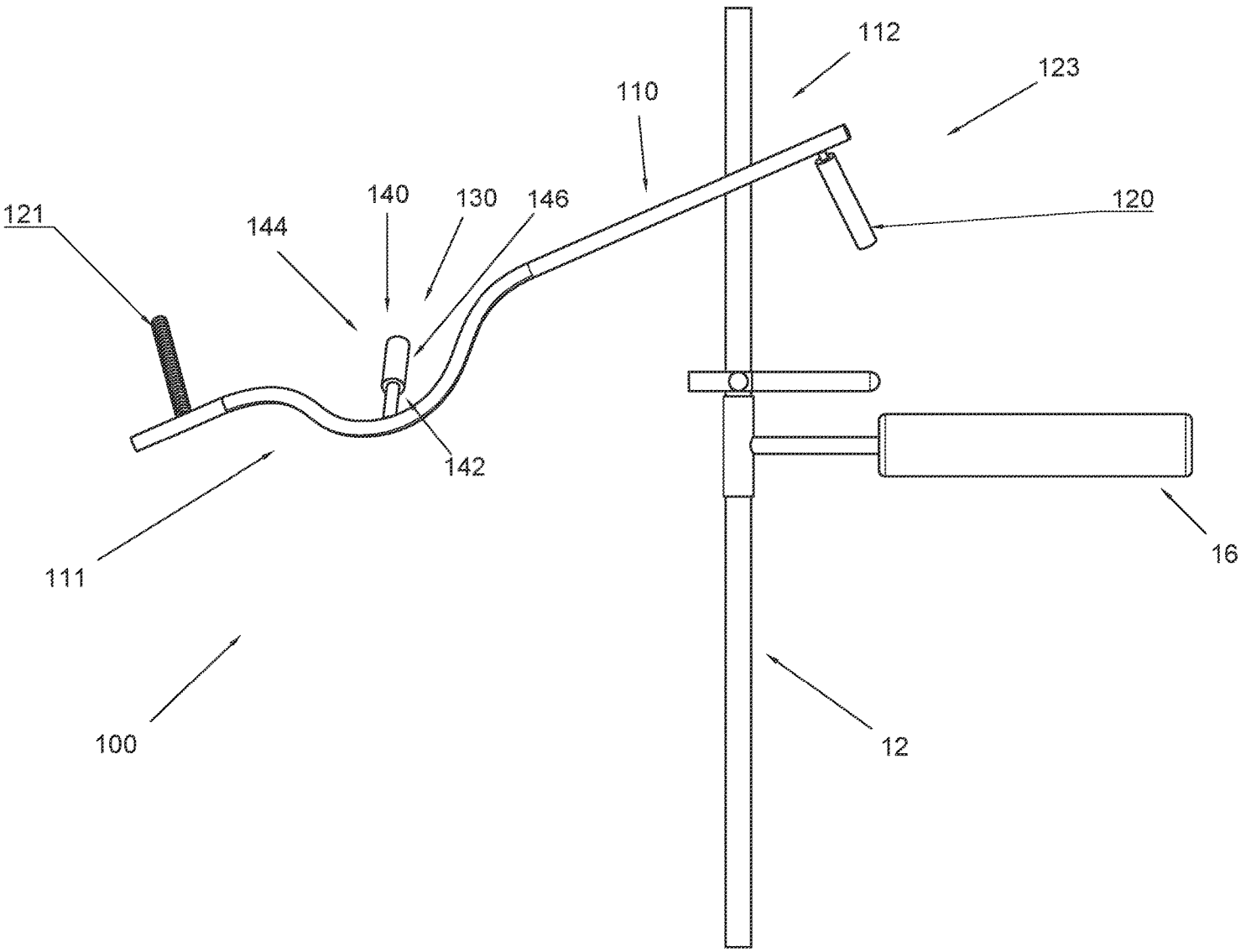
FIG. 10A is a perspective view of the embodiment of FIG. 10 in a different operative orientation.

Further, the activation mechanism 130 comprises a solenoid 140 mounted towards the proximal end of the pivot bar 110 and structured to position the lower biasing structure 120 between the active orientation 122 and the idol orientation 123. Further, with primary reference to FIG. 10A, the solenoid 140 includes a solenoid bar or plunger 142 structured to randomly engage the proximal end of the pivot bar 110. Additionally, the activation mechanism 130 further comprises a time switch mechanism 146 structured to intermittently or randomly electrically activate the solenoid 140. As such, when the solenoid 140 is electrically activated by the time switch mechanism 146, the solenoid bar 142 will release from the interior of the solenoid 140. This will serve to exert a biasing force on the proximal end of the pivot arm 110 in a direction opposite the lower biasing structure 120. More specifically, the exertion of the biasing force will force the proximal end of the pivot bar 110 in a downward direction, while concurrently forcing the distal end in an upward direction. This will serve to position the lower biasing structure 120 into the idol orientation 123 above the orbit of the corresponding rotating target 16. The random electrical activation of the solenoid 140 is indeterminate and may range from a split second to many seconds. As further indicated this intermittent interference with the rotation of the rotating target 16, reversing direction unpredictably, adds to the overall dexterity of the user and provides a more challenging workout.

Further, when the solenoid 140 is electrically activated again by the time switch mechanism 146, the lower biasing structure 120 will be positioned in the active orientation 122. More specifically, the pulsing of the solenoid 140 will retract the solenoid bar 142 into the interior of the solenoid 140. As such, this will return the pivot bar 110 to its original position. This will serve to position the lower biasing structure 120 into the active orientation 122 directly into the orbit of the rotating target 16. In addition, when the lower biasing structure 120 is disposed in the active orientation 122, the rotating target 16 will engage the lower biasing structure 120 and orient the rotating target 16 from the inoperative position 150 into the operative position 151. As such, when the rotating target 16 is disposed in the operative position 151 the user may again deliver a blow thereto, causing it to rotate about the shaft 12 returning it into the inoperative position 150 away from the user.

Figure 10B:
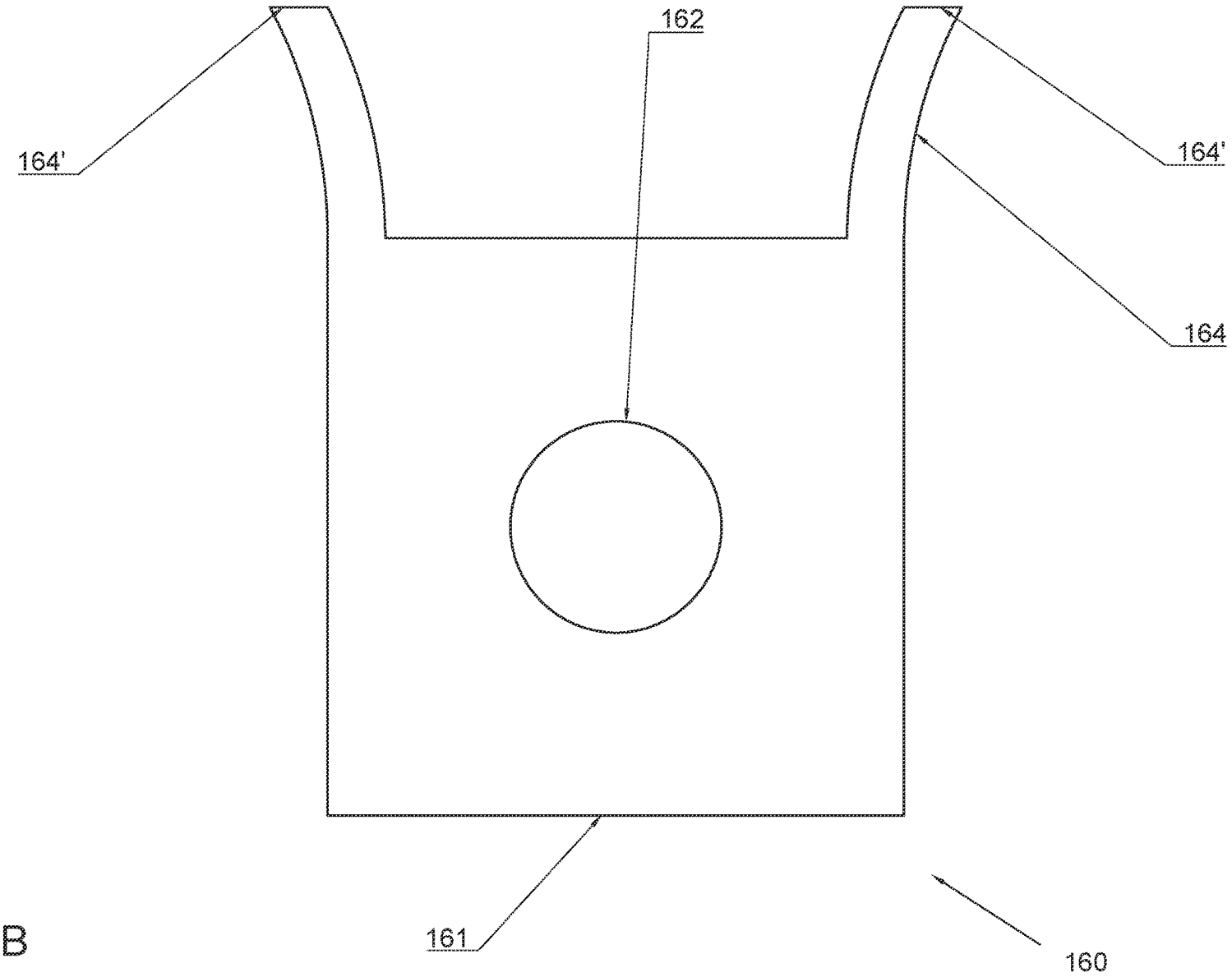
FIG. 10B is a Perspective, Detail View of a Component of the Embodiment of FIGS. 10 and 10A.

Further, with primary reference to FIG. 10B, the solenoid-arm assembly 100 includes a guide mechanism 160, which is adjustably but fixedly secured to the shaft 12. More specifically, the guide mechanism 160 includes a mounting block or like member 161, which may include an aperture 162 for the receipt and/or connection to the support shaft 12. In addition, the guide mechanism 160 includes at least two, spaced apart arm members 164 preferably including an opening or spacing at their outer or distal ends 164'. Accordingly, the guide mechanism 160 is structured to prevent the lower biasing structure 120 from moving in a direction beyond the active orientation 122. More specifically, when the lower biasing structure 120 is oriented into the active orientation 122, it will pass through and between the arm members 164 into the active orientation 122. The guide mechanism 160, including, but not limited to, the arms members 164 will engage the distal end of pivot arm 110 positioning it such that the pivot arm 110 extends transversely outward relative the shaft 12. As such, when the lower biasing structure 120 is in the active orientation 122, the rotating target 16 will engage the lower biasing structure 120 during its rotation. In turn, the lower biasing structure 120 will absorb the force of the rotating target 16 on contact and exert that driving force back onto the rotating target 16 in an opposite direction. This will cause a return of the rotating target 16 to the operative position 151. When the lower biasing structure 120 is forced back into the idol orientation 123, the lower biasing structure 120 will again pass back through and between the arms 164 and possibly through the open, spaced apart outer ends 164'.

Further, in at least one embodiment, a preferred length of the lower biasing structure 120 may be, but is not limited to, being 5 inches. As represented in FIG. 10 such a preferred length of the lower biasing structure 120 allows it to extend such a distance that the rotating target 16 will engage the lower biasing structure 120, but will not interfere with any other targets of the training assembly 10. As such, there will be no chance of damage to the pivot arm 110 or guide mechanism 160 by the delivery of such a blow from the rotating target 16.

Figure 11:
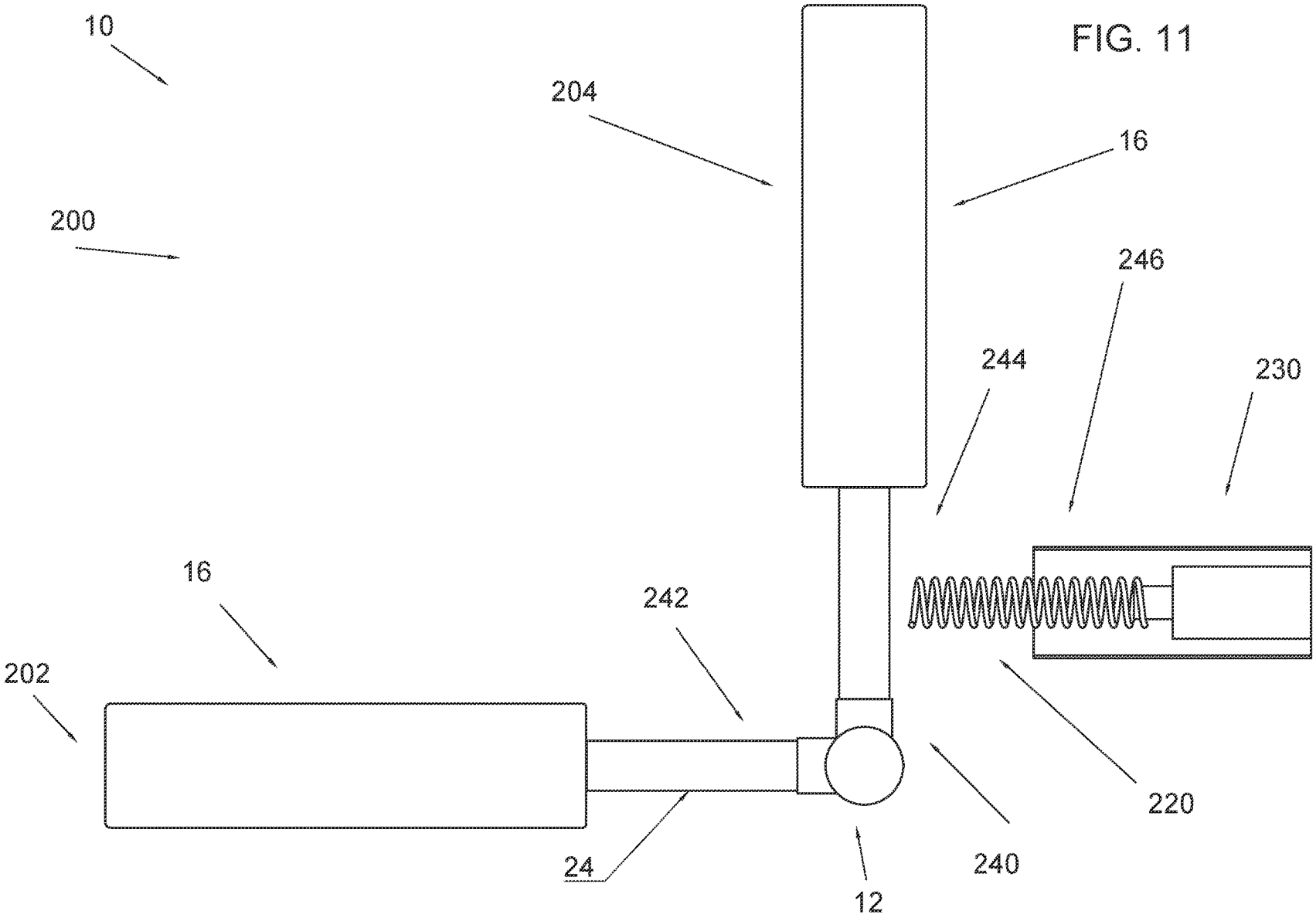
FIG. 11 is a top schematic view of another preferred embodiment of an exercise assembly of the present invention.

As represented in FIG. 11, another preferred embodiment of the training assembly 10 also includes a swing-arm assembly generally indicated as 200. The swing-arm assembly 200 includes sufficient structural and operative versatility to facilitate its use in combination with a target that can rotate around the support shaft 12 on contact from the user such as, but not limited to, the one or more rotating targets 16 as described above. Accordingly, for purposes of clarity and without limiting the scope of the present invention, the structural features of this invention will be described with reference to such a target being in the form of the one or more rotating targets 16 of the type represented in FIGS. 1, 2, 3, and 5. However, it is emphasized that the swing-arm assembly 200 of the present invention can be operable in combination with a variety of different types of targets that can rotate around the shaft 12 on contact from the user, in addition to and other than, the one or more rotating targets 16.

The swing-arm assembly 200 has an intended restricted rotation of the one or more rotating targets 16 through a rotational path of less than 360° or less than a complete circular path about the longitudinal axis of the shaft 12. More specifically, the swing-arm assembly 200 is disposed in a predetermined location relative to the rotational path of a corresponding one or more rotating targets 16. Additionally, the swing-arm assembly 200 includes an activating system 230 comprising an arm magnet 242 disposed on the arm 24 of the rotating target 16 and a corresponding assembly magnet 244 disposed on the activating system 230. In another preferred embodiment, the arm magnet 242 may also take the form of a latch, connection, or other mechanical means of attachment in replacement or addition of a magnetic element, but will be described as, arm magnet 242. Subsequently, the corresponding assembly magnet 244, may also take the form of a receiver, catch, connection or other mechanical means of attachment in replacement or addition of a magnetic element so as to connect to the mechanical means of attachment taking the form of the arm magnet 242. As described in greater detail hereinafter, the activating system 230 is structured to dispose the rotating target 16 between an operative position 202 and an inoperative position 204. In one preferred embodiment of the training assembly 10, such a magnetic and/or mechanical connection between the arm magnet 242 and the corresponding assembly magnet 244 may be, but is not limited to, an electromagnet and/or latch and catch.

Further, when the rotating target 16 is in the operative position 202 the user may deliver a blow thereto causing it to rotate on the shaft 12 in a direction away from the user, as indicated by direction arrow 241. During its rotation away from the user, the arm magnet 242 will magnetically and/or mechanically engage the assembly magnet 244 disposing the rotating target 16 in the inoperative position 204 for an indeterminate amount of time. The rotating target 16 will remain in the inoperative position 204 until the magnetic and/or mechanical connection between the arm magnet 242 and the assembly magnet 244 is activated. As such, the activating system 230 includes a time switch mechanism 246 structured to intermittently break the magnetic and/or mechanical connection between the arm magnet 242 and the assembly magnet 244. More specifically, when the arm magnet 242 is in a magnetic and/or mechanical engaging relation with the assembly magnet 244, the time switch mechanism 246 will randomly break the magnetic and/or mechanical connection. The random discharge cycle, and subsequent release of the rotating target 16, is indeterminate and may range from a split second to many seconds. As further indicated this adds to the overall dexterity of the user and provides a more challenging workout.

As such, the swing-arm assembly 200 is structured to interrupt the rotation of the rotating target 16, dispose it in the inoperative position 204, and as described in greater detail hereinafter, deliver a biasing force to the rotating target 16 when the magnetic and/or mechanical connection is activated. Such a force will force the rotating target 16 to rotate in an opposite direction towards the user, orienting the rotating target 16 back in the operative position 202 where the user may again deliver a blow or duck the returning rotating target 16.

Further, the swing-arm assembly 200 includes a biasing or spring structure 220 disposed to engage the arm 24 of the rotating target 16. The spring structure 220 is calibrated or otherwise structured to be constricted by the arm 24, when the arm magnet 242 is in a magnetic and/or mechanical engaging relation with the assembly magnet 244. More specifically, when the arm magnet 242 is in a magnetic and/or mechanical engaging relation with the assembly magnet 244, the arm 24 is held against the spring structure 220 maintaining it in a constricted state. However, when the magnetic and/or mechanical connection between the arm magnet 242 and the assembly magnet 244 is activated by the time switch mechanism 246, the spring structure 220 is released back to its original non-constricted form. This expansion of the spring structure 220 creates a force which is exerted against the arm 24 of the rotating target 16. As such, the spring structure 220 delivers a directional biasing force on the arm 24 that will force the rotating target 16 to rotate in an opposite direction. More specifically, the spring structure 220 will exert a biasing force on the arm 24 in a direction which is substantially opposite to the initial direction of rotation of the rotating target 16 along its intended rotational path of travel. This will serve to reverse and redirect the rotation of the rotating target 16 back towards the user into the operative position 202. In turn, the user can appropriately react by purposefully ducking the returning rotating target 16 and/or delivering an additional blow thereto, dependent on the particular exercise or training activity which the user is practicing.

Figure 12:
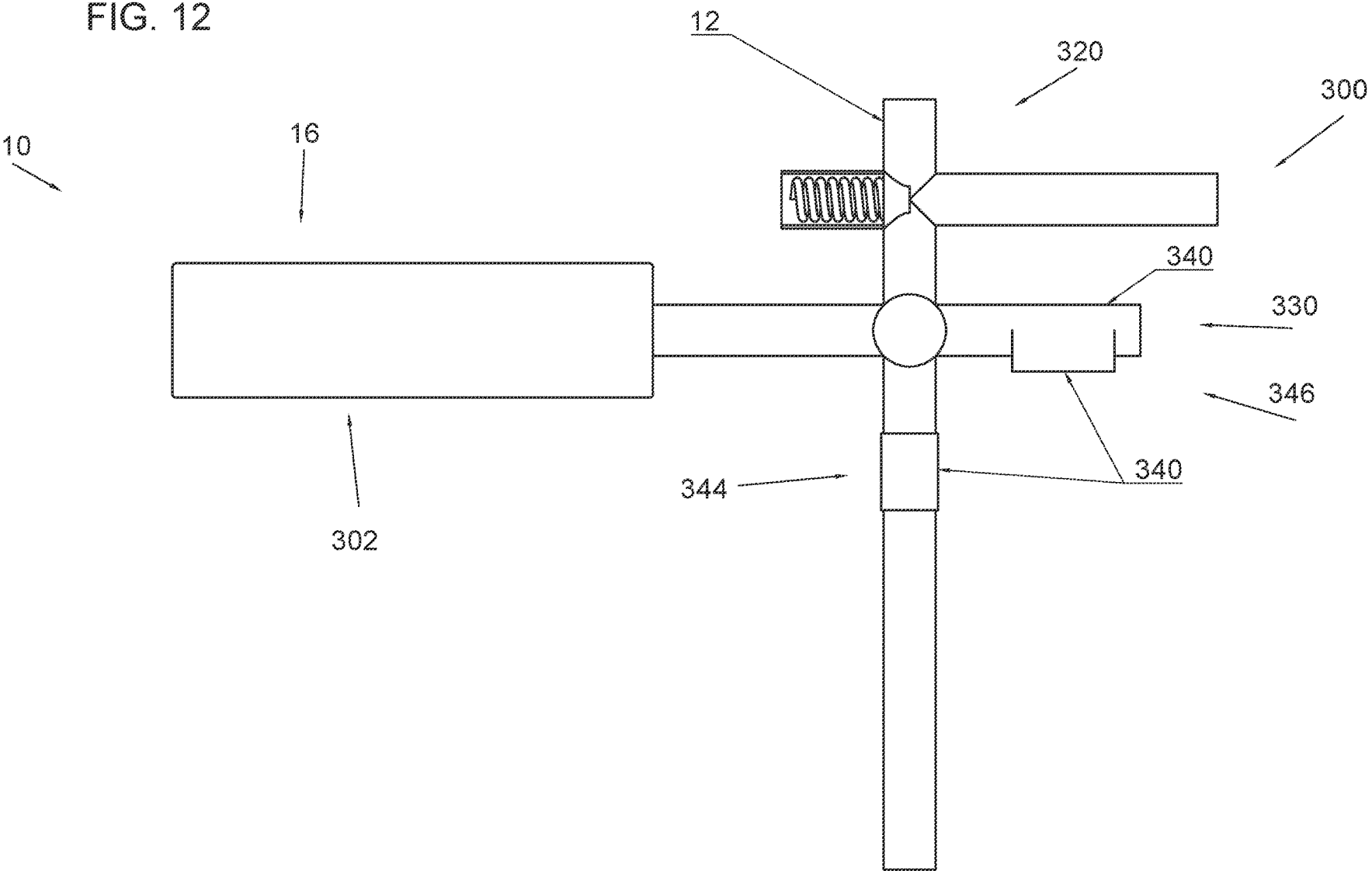
FIG. 12 is a schematic side view in partial cutaway of another preferred embodiment of an exercise assembly of the present invention.

As represented in FIG. 12, another preferred embodiment of the training assembly 10 includes a pivot swing-arm assembly generally indicated as 300. The pivot swing-arm assembly 300 includes sufficient structural and operative versatility to facilitate its use in combination with a target that can rotate around the support shaft 12 such as a rotating target 16, as described above. However, a rotating target with the additional capability to pivot between a transverse orientation relative the shaft 12 and an acute angular orientation or an aligned and/or substantially parallel relation relative to the shaft 12, as indicated by directional arrow 341. More specifically, and as described in greater detail hereinafter, after an uppercut type of blow or punch from the user, the rotating target 16 may pivot between an upward acute angular orientation or an aligned and/or substantially parallel orientation relative the shaft 12. Accordingly, for purposes of clarity and without limiting the scope of the present invention, the structural features of this embodiment will be described with reference to a pivot swing-arm assembly 300 which can be operable in combination with a variety of different types of targets that can rotate around the shaft 12 and pivot as described above.

The pivot swing-arm assembly 300 may have an intended restricted rotation of a rotating target through a rotational path of less than 360° or less than a complete circular path about the longitudinal axis of the shaft 12. More specifically, the pivot swing-arm assembly 300 is disposed in a predetermined location relative to the rotational path of a corresponding rotating target 16. Additionally, the pivot swing-arm assembly 300 includes an activating system 330 comprising an arm magnet 342 disposed on the arm 24 of the rotating target 16 and a corresponding assembly magnet 344 disposed on the activating system 330. Similar to the above, in another preferred embodiment, the arm magnet 342 may also take the form of a latch, connection, or other mechanical means of attachment in replacement or addition of a magnetic element. Subsequently, the corresponding assembly magnet 344, may also take the form of a receiver, catch, connection or other mechanical means of attachment in replacement or addition of a magnetic element so as to connect to the mechanical means of attachment taking the form of the arm magnet 342. As described in greater detail hereinafter, the activating system 330 is structured to dispose the rotating target 16 between an operative position 302 and an inoperative position 304. In one preferred embodiment of the training assembly 10 such a magnetic and/or mechanical connection between the arm magnet 342 and the corresponding assembly magnet 344 may be, but is not limited to, an electromagnet and/or latch and catch.

Further, when the rotating target 16 is in the operative position 302 the user may deliver an uppercut type blow to the rotating target 16 causing it to rotate and pivot on an upwardly angular trajectory towards the shaft 12. As such, during its upward trajectory, the arm magnet 342 will magnetically and/or mechanically engage the assembly magnet 344 disposing the rotating target 16 in the inoperative position 304, and holding it for an indeterminate amount of time.

The rotating target will remain in the inoperative position 304 until the magnetic and/or mechanical connection between the arm magnet 342 and the assembly magnet 344 is activated. As such, the activating system 330 includes a time switch mechanism 346 structured to intermittently break the magnetic and/or mechanical connection between the arm magnet 342 and the assembly magnet 344. More specifically, when the arm magnet 342 is in a magnetic and/or mechanical engaging relation with the assembly magnet 344, the time switch mechanism 346 will randomly break the magnetic and/or mechanical connection. As such, the rotating target 16 will pivot back to its original transverse orientation, and rotate back towards the user as described below. The random discharge cycle is indeterminate and may range from a split second to many seconds. As further indicated, this adds to the overall dexterity of the user and provides a more challenging workout.

The pivot swing-arm assembly 300 is structured to interrupt the rotation of the rotating target 16, dispose it in the inoperative position 304, and as described in greater detail hereinafter, deliver a biasing force thereto when the magnetic and/or mechanical connection is activated. Such a force will force the rotating target 16 to rotate in an opposite direction toward the user, orienting the rotating target 16 back into an operative position 302 where the user may again deliver a blow thereto.

As such, the pivot swing-arm assembly 300 includes a biasing or spring structure 320 disposed to engage the arm 24 of the rotating target 16. The spring structure 320 is calibrated or otherwise structured to be constricted by the arm 24 when the arm magnet 342 is in a magnetic and/or mechanical engaging relation with the assembly magnet 344. More specifically, when the arm magnet 342 is in a magnetic and/or mechanical engaging relation with the assembly magnet 344, the arm 24 of the rotating target 16 is held against the spring structure 320, maintaining it in a constricted state. However, when the magnetic and/or mechanical connection between the arm magnet 342 and the assembly magnet 344 is activated by the time switch mechanism 346, the spring structure 320 is released back to its original non-constricted form. This expansion of the spring structure 320 creates a force which is exerted back against the arm 24 of the rotating target 16. As such, the spring structure 320 delivers a directional biasing force on the arm 24 that will force the rotating target 16 to rotate in an opposite direction. More specifically, the spring structure 320 will exert a biasing force on the arm 24 in a direction which is substantially opposite to the initial direction of rotation of the rotating target 16 along its intended rotational path of travel. This will serve to reverse and redirect the rotation of the rotating target 16 back towards the user into the operative position 302. In turn, the user can appropriately react by purposefully ducking the returning rotating target and/or delivering an additional blow thereto, dependent on the particular exercise or training activity which the user is practicing.

Figure 13A:
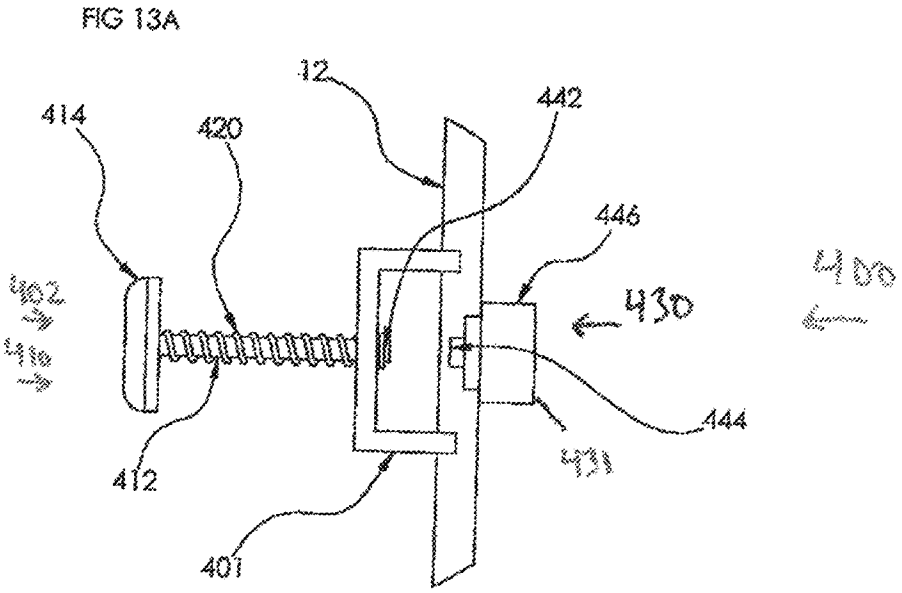
FIG. 13A is a perspective view of the embodiment of FIG. 13 in a different operative orientation.
Figure 13:
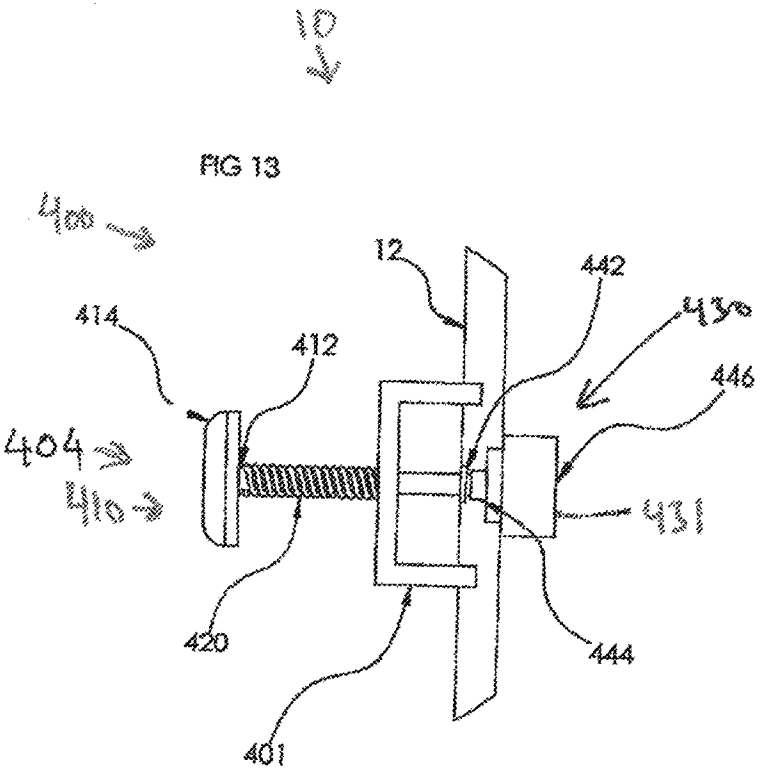
FIG. 13 is a perspective view of another preferred embodiment of an exercise assembly of the present invention in one operative orientation.

As represented in FIGS. 13 and 13A, another preferred embodiment of the training assembly 10 includes a spring-arm assembly generally indicated as 400. The spring-arm assembly 400 includes a bracket 401 adjustably mounted on the shaft 12, structured to support a retractable spring target 410. The spring target 410 includes a support arm section 412 and a target portion or section 414 structured to receive a blow from the user, when in an operative orientation 402.

The structural components of each of the spring targets 410, as set forth above, are such as to absorb a punch or blow from the user in a manner which does not cause a rotation of the spring target 410 relative to support shaft 12. As described in further detail hereinafter, the spring target 410 will be positioned between a retracted inoperative orientation 404 and the transversely or outwardly extended operative orientation 402, relative to support shaft 12. Further, one or more spring-arm assemblies 400 may be strategically or appropriately placed along the length of the shaft 12 at any one of a plurality of outwardly extending directions, which facilitate the practice of any boxing, martial arts or like activities being performed by the user.

Additionally, the spring-arm assembly 400 includes an activating system 430 comprising an arm magnet 442 disposed on the support arm segment 412 and a corresponding assembly magnet 444 disposed on the activating system 430. Similar to the above, in another preferred embodiment, the arm magnet 442 may also take the form of a latch, connection, or other mechanical means of attachment in replacement or addition of a magnetic element. Subsequently, the corresponding assembly magnet 444, may also take the form of a receiver, catch, connection or other mechanical means of attachment in replacement or addition of a magnetic element so as to connect to the mechanical means of attachment taking the form of the arm magnet 442. As described above, the activating system 430 is structured to position the spring target 410 between the operative position 402 and the inoperative position 404. In one preferred embodiment of the training assembly 10 such a magnetic and/or mechanical connection between the arm magnet 442 and the corresponding assembly magnet 444 may be, but is not limited to, an electromagnet and/or latch and catch. Further, when the spring target 410 is in the operative position 402 the user may deliver a blow thereto causing it to retract in an inward trajectory towards the shaft 12. Additionally, during its retraction the arm magnet 442 will magnetically and/or mechanically engage the assembly magnet 444, disposing the spring target 410 in the inoperative position 404 for an indeterminate amount of time.

The spring target 410 will remain in the inoperative position 404 until the magnetic and/or mechanical connection between the arm magnet 442 and the assembly magnet 444 is activated. As such, the activating system 430 includes a time switch mechanism 446 disposed within the housing 431 of the activating system 430 and structured to intermittently break the magnetic and/or mechanical connection between the arm magnet 442 and the assembly magnet 444. More specifically, when the arm magnet 442 is in a magnetic and/or mechanical engaging relation with the assembly magnet 444, the spring target 410 is in the inoperative position 404. When the time switch mechanism 446 randomly breaks the magnetic and/or mechanical connection, the spring target 410 will return to the operative position 402. The random discharge cycle is indeterminate and may range from a split second to many seconds. As further indicated this adds to the overall dexterity of the user and provides a more challenging workout.

Further, when the magnetic and/or mechanical connection is activated, the spring-arm assembly 400 is structured to deliver a directional force on the support arm segment 412 as described in greater detail hereinafter. Such a force will force the spring target 410 to extend in a transverse or outward direction back towards the user. As such, the spring-arm assembly 400 includes a biasing or spring structure 420 disposed about the support arm segment 412 between the target portion 414 and the bracket 401. Further, when the spring target 410 is disposed in the inoperative orientation 404, it is disposed in a retracted position relative to the support shaft 12. As such, the biasing structure 420 is calibrated or otherwise structured to be constricted between the target portion 414 of the spring target 410 and the bracket 401 as shown in FIG. 13.

However, when the magnetic and/or mechanical connection between the arm magnet 442 and the assembly magnet 444 is activated, the biasing structure 420 is released back to its non-constricted form. This expansion of the biasing structure 420 creates a force which is exerted against the target portion 414 of the spring target 410. Such a biasing force will force the spring target 410 to extend in a transverse or outwardly direction relative to the support shaft 12. More specifically, the biasing structure 420 will exert a biasing force on the spring target 410 in an outward direction away from the shaft 12. This will serve to redirect the spring target 410 back towards the user. In turn, the user can appropriately react by purposefully delivering an additional blow to the returning spring target 410, dependent on the particular exercise or training activity which the user is practicing.

Figure 14:
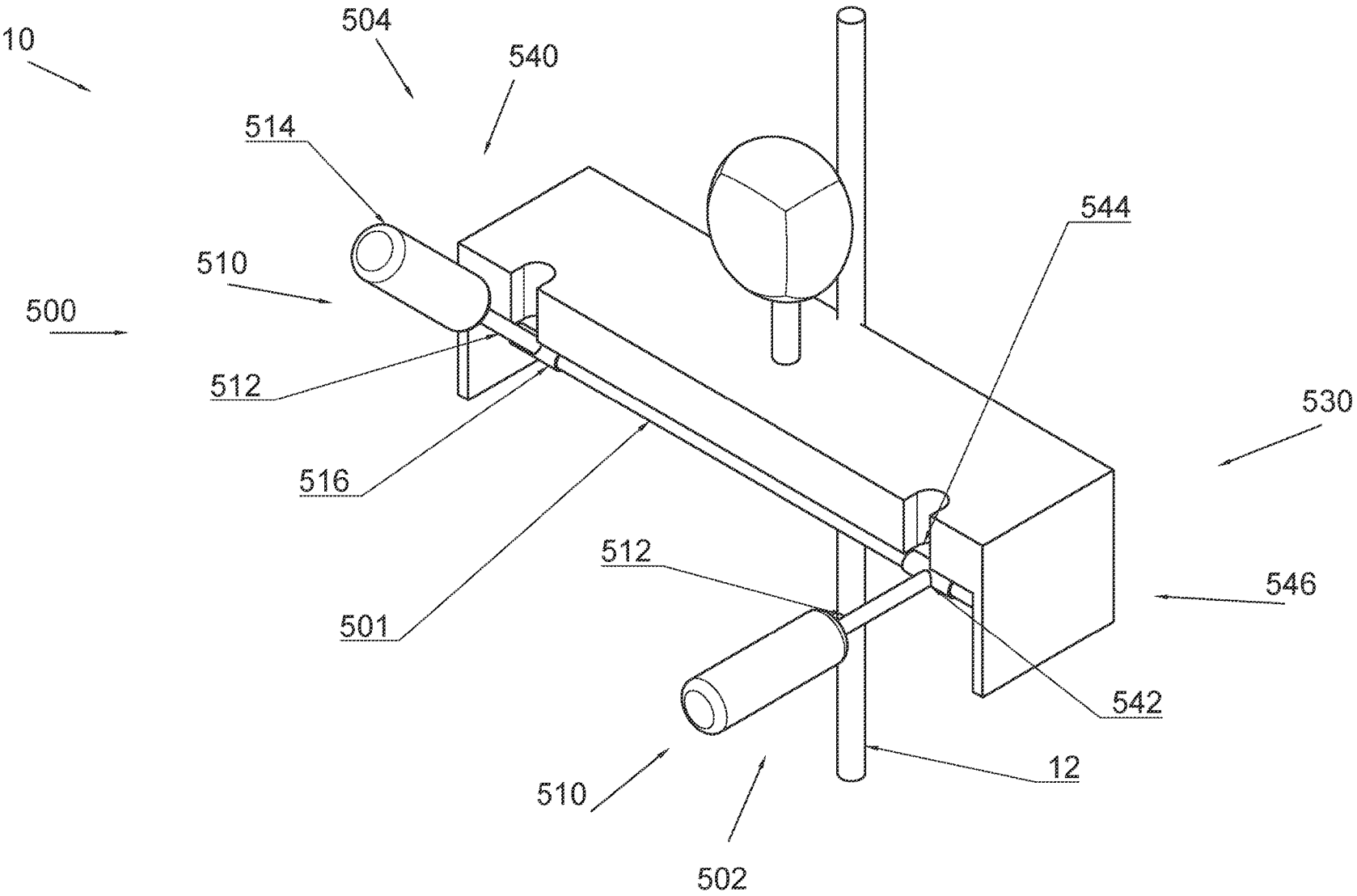
FIG. 14 is a perspective view of another preferred embodiment of an exercise assembly of the present invention.

As represented in FIG. 14, another preferred embodiment of the training assembly 10 includes a housing assembly 500 adjustably secured and transversely oriented to the vertically upright operative orientation of the shaft 12. The housing assembly 500 is adjustably but fixedly secured to the shaft 12 at a preferred location along the length thereof just above or below the head of the user. The height and/or position of the housing assembly 500 along the length of the shaft 12 may be dependent on the height or stature of the user or the particular activity being practiced by the user. The aforementioned housing assembly 500 is structured to support one or more drop targets 510. Each of the one or more drop targets 510 includes a support arm section 512 and a target section 514 structured to receive a blow from the user, when in an operative orientation 502. As discussed in detail hereinafter, each drop target 510 is operatively positioned between an outwardly extending orientation relative the shaft 12 and an aligned and/or substantially parallel orientation relative the shaft 12.

The housing assembly 500 includes a housing support bar 501 disposed in engaging, supporting relation to the corresponding end of each of the one or more drop targets 510. Such support may be considered necessary due to the plurality of drop targets 510 receiving repeated blows or punches from the user. As will be discussed in greater detail below, the housing support member 501 is structured to position and support each of the one or more drop targets 510 in an outwardly transverse orientation relative the shaft 12, when each of the one or more drop targets 510 is in an operative position 502. Such a housing support member 501 may be in the form of a pivot bar or the like.

The support arm section 512 extends substantially along the length of the drop target 510 and intermediate opposite ends of the drop target 510, or intermediate the attachment section 516 and the target section 514 located at the distal end of the drop target 510. As will be discussed in greater detail below, while the length of the support section 512 may vary, one feature thereof includes the addition of a magnetic and/or mechanical connection 540 which will position each of the one or more drop targets 510 between an inoperative position 504 and an operative position 502.

Each of the one or more drop targets 510 also includes a target section 514 defining and extending along the length of the distal end of the drop target 510, inwardly towards the attachment section 516, which connects the drop target 510 to the housing support member 501. The length and overall structure of the target section 514 is such as to facilitate the receiving of any forceful blow delivered by the user. Accordingly, the support arm section 512 may be inwardly spaced from the target section 514 a sufficient distance to assure that any blow delivered to any of the drop targets 510 will engage the target section 514. Further, since the entire drop target 510 is formed of a light weighted material, such as but not limited to plastic, there will be no chance of damage to the user's hand, arm, etc. by the delivery of such a blow to the drop target 510.

The housing assembly 500 further includes an activating system 530 comprising a magnetic and/or mechanical connection 540 between the support arm section 512 of the drop target 510 and the activating system 530. The activating system 530 is structured to position each of the drop targets 510 between an operative position 502 and an inoperative position 504. In one preferred embodiment of the training assembly 10 such a magnetic and/or mechanical connection 540 may be, but is not limited to, an electromagnet and/or latch and catch. Further, the magnetic and/or mechanical connection 540 includes an arm magnet 542 disposed on the support arm section 512 of the drop target 510 and an assembly magnet 544 disposed on the activating system 530. Similar to the above, in another preferred embodiment, the arm magnet 542 may also take the form of a latch, connection, or other mechanical means of attachment in replacement or addition of a magnetic element. Subsequently, the corresponding assembly magnet 544, may also take the form of a receiver, catch, connection or other mechanical means of attachment in replacement or addition of a magnetic element so as to connect to the mechanical means of attachment taking the form of the arm magnet 542 In one preferred embodiment of the training assembly 10 the assembly magnet 544 may be connected to the housing assembly 500 in a floating position, however in another embodiment it may be fixedly connected thereto.

As such, when the drop target 510 is in the operative position 502 the user may deliver an uppercut type blow to the drop target 510 causing it to pivot in an upward direction towards the shaft 12, away from the user. Further, during the upward pivot the arm magnet 542 will engage the assembly magnet 544 positioning the drop target 510 in the inoperative position 504 for an indeterminate amount of time. When the drop target 510 is in the inoperative position 504 it is disposed in an aligned and/or substantially parallel orientation relative the shaft 12. Additionally, the inoperative position 504 is maintained until the magnetic and/or mechanical connection 540 is discharged, allowing the drop target 510 to gravitationally return to an outwardly transverse operative position 502. As such, each of the one or more activating systems 530 includes a time switch mechanism 546, structured to randomly discharge the magnetic and/or mechanical connection 540 as discussed above. One intended operation of the one or many drop targets 510 is to facilitate a random release of the one or many drop targets 510 from an inoperative position 504 to an operative position 502 when the magnetic and/or mechanical connection 540 is discharged. This will further facilitate the performance by a user of a relatively quick or rapid response movement when practicing either a boxing or martial arts technique, since the user will have to respond to the continuously released drop targets 510.

When disposed in the operative position 502, the drop target 510 is disposed in an outward extending relation to the shaft 12. As indicated above, the attachment section 516 of the drop target 510 extends horizontally outward therefrom in connected, supporting relation to the housing support member 501 of the housing assembly 500. Therefore, when the drop target 510 is in the operative position 502, it may include a substantially L-shape configuration relative the shaft 12.

As emphasized above, one operative feature of the exercise and/or training assembly 10 is the challenge to respond to the plurality of drop targets 510 as they each randomly release from an acute angular orientation to a transverse orientation relative the shaft 12. A striking uppercut type of blow by the user will force the drop target 510 to pivot in an upward direction, back towards the housing assembly 500. This will serve to return the drop target 510 back into the inoperative position 504. When the time switch mechanism 546 discharges the magnetic and/or mechanical connection 540 the user can appropriately react to the returning drop target 510. As indicated, this adds to the overall dexterity of the user and provides a more challenging workout.

Figure 15:
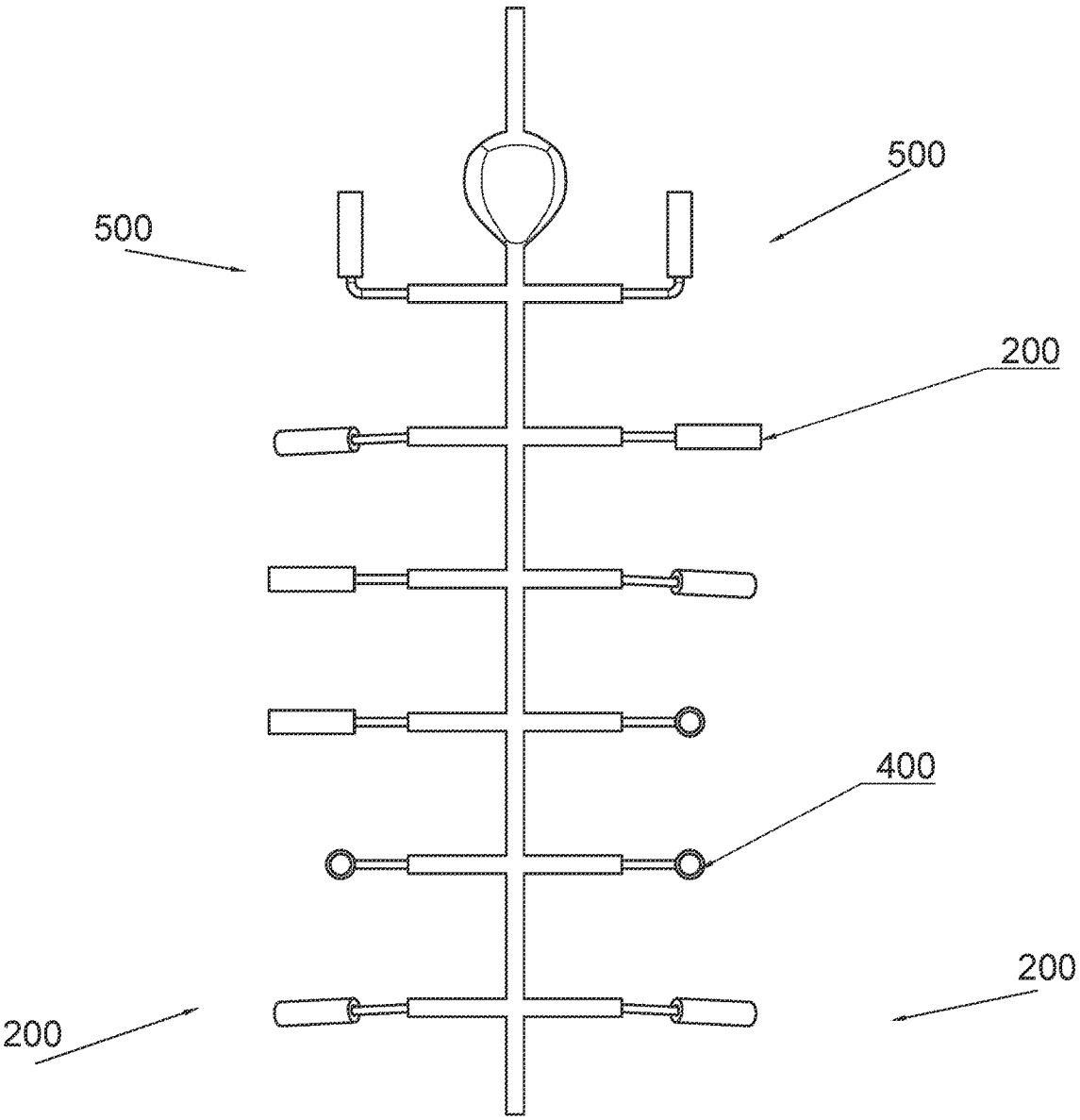
FIG. 15 is a perspective view of another preferred embodiment of an exercise assembly of the present invention.

The exercise and/or training assembly 10 may incorporate a plurality of different target structures and assemblies as described above, each of which intended to receive repeated forceful blows as the user performs the intended boxing, martial arts, etc. routine. More specifically and with primary reference to FIG. 15, by way of example, the exercise and/or training assembly 10 may include a plurality of swing-arm assemblies 200, spring-target assemblies 400, and/or housing assemblies 500 adjustably connected to the shaft 12.

Figure 16:
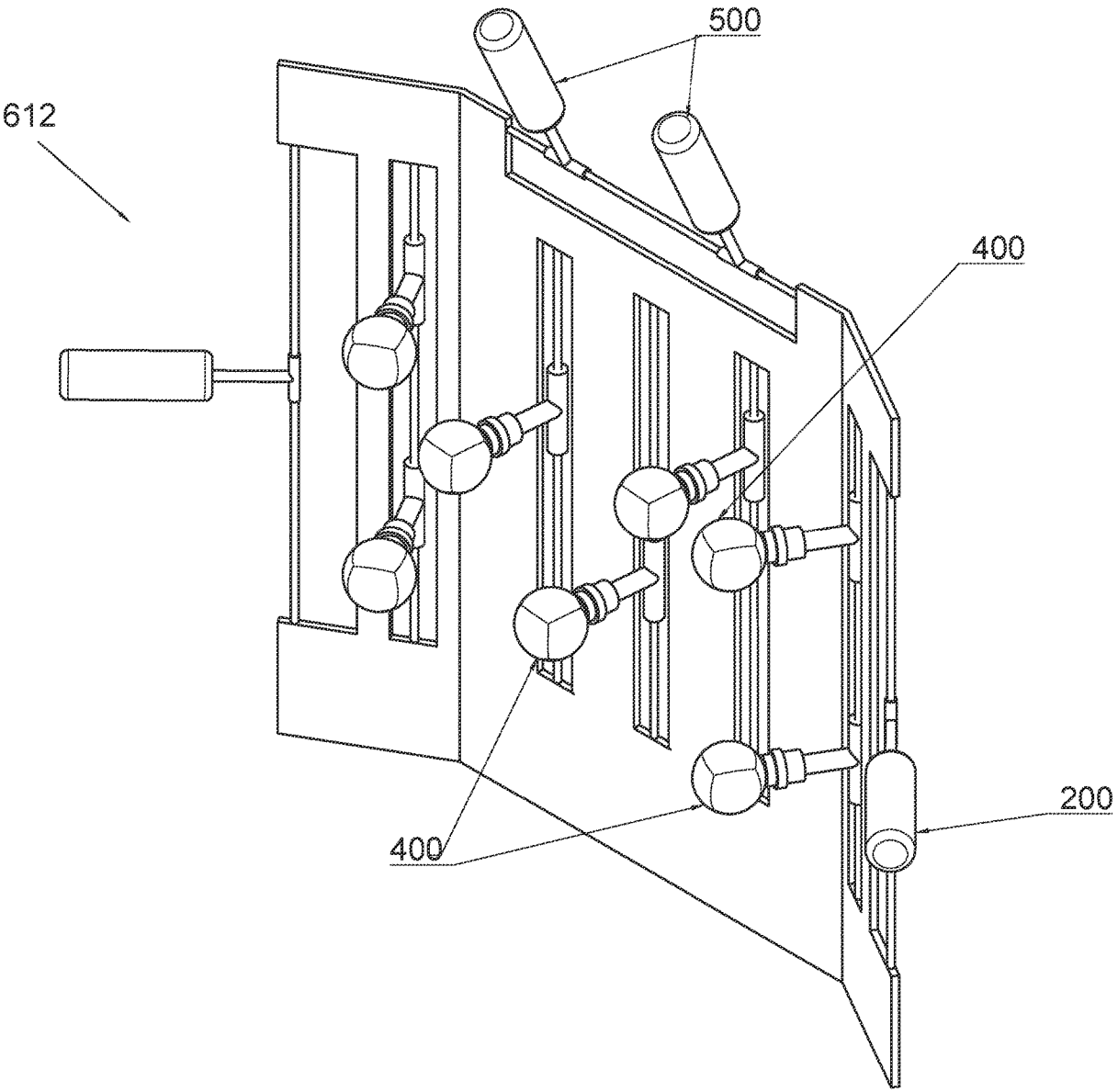
FIG. 16 is a perspective view of another preferred embodiment of an exercise assembly of the present invention.

However, in at least one embodiment, the training assembly 10 may include a plurality of the different target structures and assemblies as described above, mounted on a support 12 such as a vertically upright panel support structure 612. More specifically, the training assembly 10 includes an elongated panel support structure, generally indicated as 612. Further, with primary reference to FIG. 16, by way of example, the exercise and/or training assembly 10 may include a plurality of swing-arm assemblies 200, spring-target assemblies 400, and/or housing assemblies 500 adjustably connected to a 3-panel support structure 612.

Figure 17A:
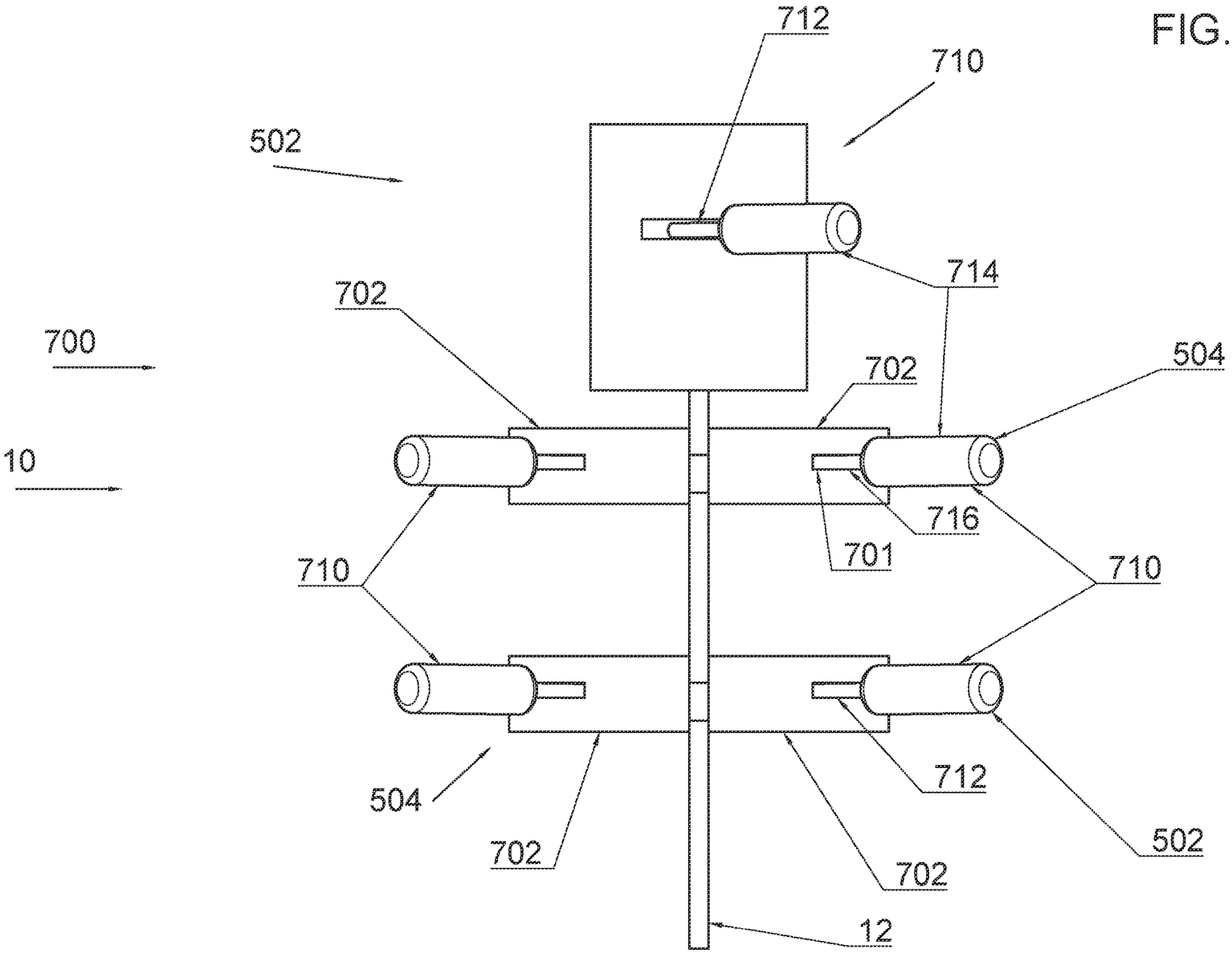
FIG. 17A is a perspective view of another preferred embodiment of an exercise assembly of the present invention.
Figure 17B:
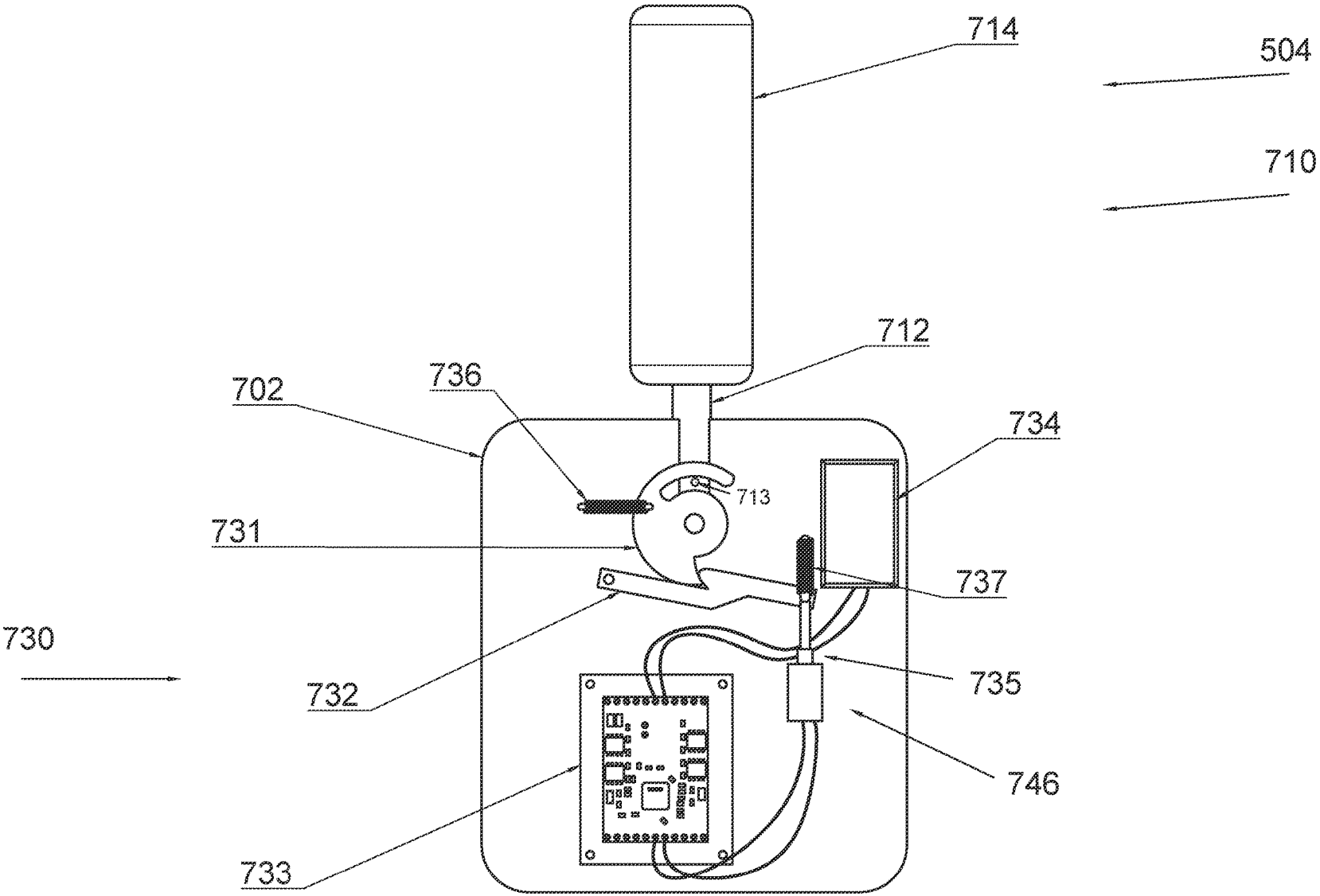
FIG. 17B is a detail view of a component of the embodiment of FIG. 17A.

As represented in FIGS. 17A and 17B, another preferred embodiment of the training assembly 10 may include a panel assembly illustrated at 700. The panel assembly 700 may include a base or support panel 702 adjustably secured to the shaft 12 at a user preferred location along the length thereof. The position of the support panel 702 along the length of the shaft 12 may be dependent on the height or stature of the user or the particular activity being practiced by the user. The support panel 702 may be structured to support at least one panel target 710. Each panel target 710 may comprise a support arm section 712 and a target section 714 structured to receive a blow from the user when in the operative orientation 502. As discussed in detail hereinafter, the panel target 710 may be operatively positioned between the operative position 502 and the inoperative position 504.

The support panel 702 may include a support member 701 disposed in supporting, connecting relation between the support panel 702 and the proximal end of the panel target 710. Such support may be considered necessary due to the panel target 710 receiving repeated blows or punches from the user. Further, the support member 701 may be structured to position and support the panel target 710 in an outwardly transverse orientation relative the shaft 12 when in the operative position 502, at such an angle that the user may deliver a blow or strike thereto.

The support arm section 712 may extend substantially along the length of the proximal end of the panel target 710, intermediate an attachment section 716 and the target section 714. The attachment section 716 may connect the panel target 710 to the support member 701. As will be discussed in greater detail below, while the length of the support arm section 712 may vary, one feature thereof may include the addition of a support pin 713 structured and disposed to engage an activating system 730, when the panel target 710 is positioned in the inoperative position 504.

As discussed above, the panel target 710 may include a target section 714 defining and extending along the length of a distal end of the panel target 710. The length and overall structure of the target section 714 may be such as to facilitate the receiving of repeated forceful blows delivered by the user. Accordingly, the support arm section 712 may be inwardly spaced from the target section 714 a sufficient distance to assure that any blow delivered to the panel target 710 will engage the target section 714 only. The panel target 710 may be formed of a light-weight material to reduce the chance of damage to the user's hand, arm, etc. by the delivery of such a blow to the panel target 710.

As illustrated in detain in FIG. 17B, the support panel 702 may also be structured to support an activating system 730, structured and disposed to position the panel target 710 between the operative position 502 and the inoperative position 504. The activating system 730 may comprise a catch 731 structured and disposed to engage the support pin 713 of the panel target 710, holding the panel target 710 in the inoperative position 504. This may happen via a blow from the user against the panel target 710 when in the operative position 502, such that the force of the blow may cause the panel target 710 to pivot in a direction away from the user and towards the support panel 702. On contact with the catch 731, the support pin 713 may engage and connect with the catch 731, positioning the panel target 710 in the inoperative position 504 for an indeterminate amount of time until released by the activating system 730.

Accordingly, the activating system 730 may include a switch mechanism 746, such as but not limited to a pull solenoid, structured to randomly activate and release the connected panel target 710 back into the operative position 502. The random activation of the switch mechanism 746 may be indeterminate or may be at least partially "pre-programed" so as to correspond "time wise" to the routine being performed by the user, and may range from a split second to many seconds. In one embodiment, this at least partial random activation may be caused by a programmable circuit board 733 and battery 734 connected to the switch mechanism 746 via electrical wires. More specifically, and as discussed in detail hereinafter, the switch mechanism 746 may include a plunger 738 structured to retract upon activation from the programmable circuit board 733 and to release upon deactivation.

As illustrated in detail in FIG. 17B, the activating system 730 may also include a sear 732 disposed in interconnecting relation between the catch 731 and the switch mechanism 746. The sear 732 may serve to hold or position the catch 731 in connecting relation to the support pin 713 of the panel target 710, when the catch 731 is engaged with the support pin 713. The switch mechanism 746 may be connected to the sear 732 via a connecting link 735, such that when the switch mechanism 746 is activated, it may exert a pulling force on the sear 732, causing the sear 732 to pivot while concurrently causing the connected catch 731 to move or rotate. Additionally, the catch 731 may include a catch biasing structure 736 structured to exert a biasing force upon the catch 731, causing additional movement or rotation of the catch 731. This combined movement or rotation of the catch may serve to release the support pin 713 from the catch 731, positioning the connected panel target 710 back into the operative position 502. Further, the sear 732 may include a sear biasing structure 737 structured to exert a biasing force upon the sear 732, on deactivation of the switch mechanism 746, causing the sear 732 and concurrently the catch 731, to pivot or rotate back into its original positions.

More specifically, the sear 732 may be disposed in interconnecting relation between the plunger 738 of the switch mechanism 746 and the sear biasing structure 737. Upon activation of the switch mechanism 746 by the programmable circuit board 733, the plunger 738 may retract, exerting a pulling force upon the sear 732 and sear biasing structure 737 via the connecting link 735. Such a pulling force may cause the sear biasing structure 737 to expand and the sear 732 to pivot while concurrently causing the catch 731 to rotate, releasing the support pin 713 and positioning the panel target 714 into the operative position 502. Upon deactivation of the switch mechanism 746, the plunger 738 may release, removing the pulling force applied to the sear 732 and sear biasing structure 737. This will cause the sear biasing structure 737 to exert a biasing force upon the sear 732, causing the sear 732 to pivot back into its original position, and concurrently causing the connected catch 731 to rotate back into its original position.

This will further facilitate the performance by a user of a relatively quick or rapid response movement when practicing either a boxing or martial arts technique, since the user will have to respond to the randomly released panel target 710.

Figure 18:
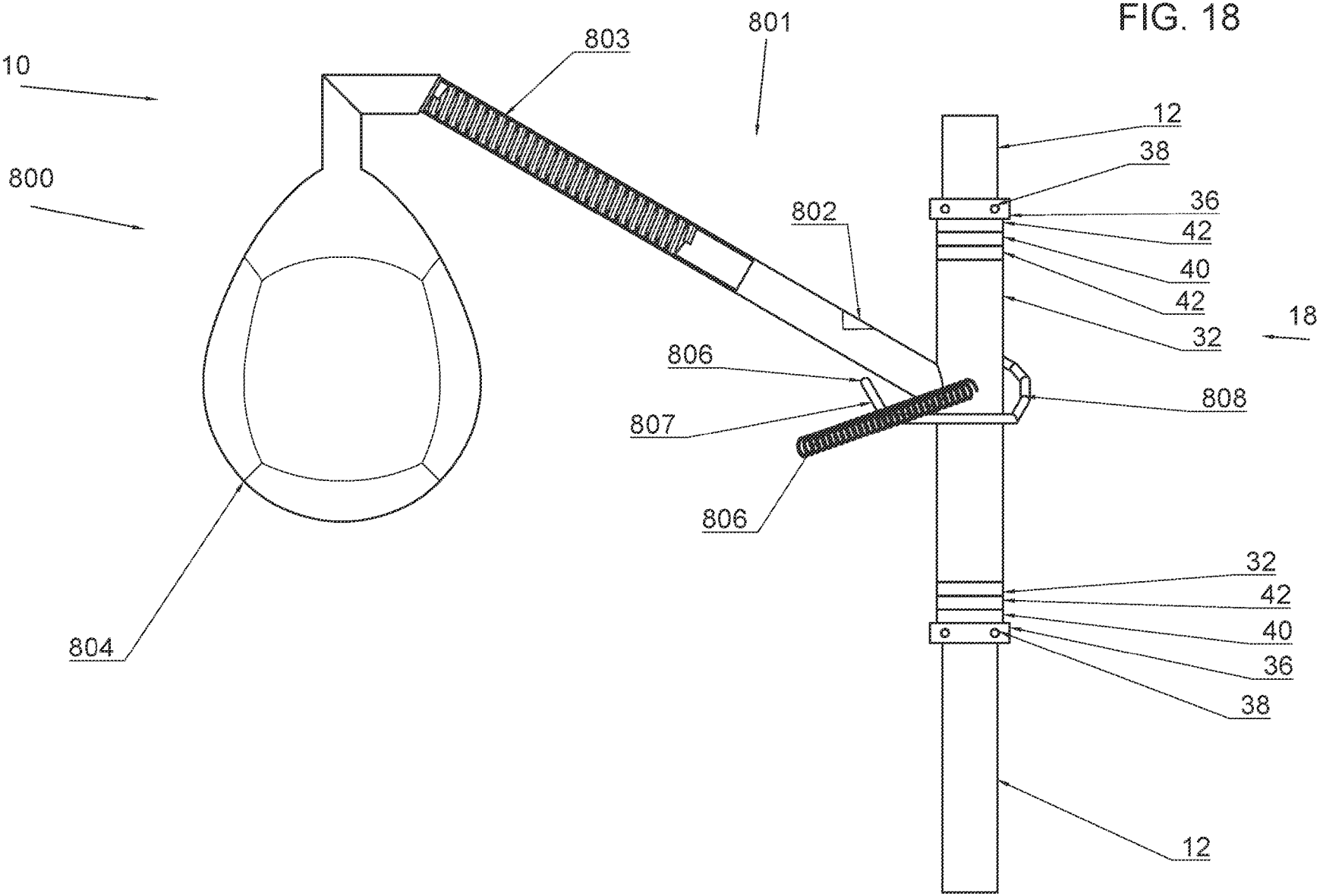
FIG. 18 is a perspective view of another preferred embodiment of an exercise assembly of the present invention.

As represented in FIG. 18, another embodiment of the exercise assembly 10 may include a head assembly generally indicated as 800. The head assembly 800 may include a target section 804 structured to be struck or receive a blow from the user. Such structuring of the target section 804 may also facilitate its use as a "speed bag" in a conventional manner in which such speed bags are used.

Further, the head assembly 800 may include an elongated arm 801 which may be rotationally or semi-rotationally connected to the support shaft 12 by a rotational fitting, generally indicated as 18. The elongated arm 801 may extend substantially outward from the shaft 12 in connected, supporting relation to the target section 804. The elongated arm 801 may comprise both a rigid portion 802 and a biasing or spring portion generally indicated as 803. The rigid portion 802 may extend along the length of a proximal end of the elongated arm 801 and intermediate opposite ends of the elongated arm 801 or intermediate the rotational fitting 18 and a distal end of the elongated arm 801. In order to provide a more optimal disposition of the target section 804 to receive repeated blows or punches from a user, the elongated arm 801 may be disposed at an acute angle relative to the length of the shaft 12. In at least one embodiment, a preferred angle of the elongated arm 801 may be, but is not limited to, being in the range of between 20° and 25°, relative the upright shaft 12. This predetermined angle may vary depending on the exercise practiced by the user.

The biasing portion 803 may define and extend along the length of the distal end of the elongated arm 801, disposed in interconnecting relation between the target section 804 and the rigid portion 802 of the elongated arm 801. Further, the biasing portion 803 may be calibrated and/or otherwise structured to absorb a portion of the force of a blow exerted on the target section 804, causing the biasing portion 803 and the target section 804 to move in an unpredictable manner. More specifically, after a blow is delivered to the target section 804, the spring element of the biasing portion 803 may expand and retract, creating additional "bobbing"

movements to the target section 804. Also, the structural components of the rotational fitting 18, as set forth above, may be such as to cause a partial displacement or rotation of the elongated arm 801 about the shaft 12, after a blow from the user upon the target section 804. More specifically, the cooperative structuring of the elongated arm 801 and the rotational fitting 18 may be such that the elongated arm 801 at least partially rotates about the shaft 12 after a blow or punch is delivered to the target section 804 by the user.

Accordingly, as in FIG. 5, the rotational fitting 18 comprises an elongated primary segment 32 having a hollow interior and an outwardly extending connecting segment 34. The primary portion 32 may be disposed in concentrically surrounding relation to the shaft 12. The connecting segment 34 may extend transversely outward therefrom in connected, supporting relation to a remainder of the elongated arm 801. Further, the rotational fitting 18 may be adjustably secured along the length of the shaft 12 using at least two, oppositely disposed locking collars 36 movably or adjustably connected to the shaft 12 by a plurality of set screws or like connectors 38.

Associated with the rotational fitting 18, and operatively held in place by the locking collars 36, are two bearing assemblies generally indicated as 40. Each of the bearing assemblies 40 include two outwardly disposed washers 42 disposed in a sandwiching relation on opposite sides of a bearing structure 44, such as a thrust bearing or the like. The locking collars 36 may hold corresponding ones of the bearing assemblies 40 in an operative position relative to opposite open ends of the primary portion 32 of the rotational fitting 18. Therefore, at least a partial rotation of the connecting segment 34 and the elongated arm 801 connected thereto is facilitated.

However, in order to incorporate additional "unpredictable" movement of the target section 804, the present invention features the intended restricted rotation of the elongated arm 801 through a rotational path of less than 360° or less than a complete circular path about the longitudinal axis of the shaft 12. As such, the head assembly 800 may include a restriction biasing structure 806, which may be considered a part of the rotational fitting 18 rotationally connected to the shaft 12, structured and disposed to restrict the rotation of the elongated arm 801. However, as represented in FIG. 18, the restriction biasing structure 806 extends transversely outward from the shaft 12 at such a disposition that it will not engage the elongated arm 801, but will rotate therewith.

To effectuate the rotation restriction of the elongated arm 801, the restriction biasing structure 806 may work in combination with a restriction guide 807, which may be fixedly but adjustably secured to the shaft 12. The restriction guide 807 may include two, spaced-apart restriction arms 808, structured to engage and restrict the rotation of the restriction biasing structure 806 to the space between the two restriction arms 808. More specifically, the restriction biasing structure 806 may be disposed between the two restriction arms 808 and structured to engage one of the restriction arms 808 during its rotation about the shaft 12. As such, the restriction guide 807 and the two restriction arms 808 may collectively define a substantially V-shape, as represented in FIGS. 18A-18B, configuration about the restriction biasing structure 806.

Accordingly, the force exerted by a blow or punch delivered to the target section 804 by a user may cause at least a partial rotation of the elongated arm 801. Due to the fact that the elongated arm 801 and the restriction biasing structure 806 are both connected to the rotational fitting 18, a blow exerted on the target section 804 will result in a concurrent rotation of the restriction biasing structure 806. When so rotated, the restriction biasing structure 806 will engage one of two the restriction arms 808, depending on the direction of rotation of the restriction biasing structure 806. Upon such engagement, the rotation of both the restriction biasing structure 806 and the elongated arm 801 will be halted. As such, the elongated arm 801 may only rotate about the shaft 12 a distance equal to the space between the two restriction arms 808.

In addition, after engagement with one of the two restriction arms 808, the restriction biasing structure 806 may be disposed and calibrated or otherwise structured to deliver or impose a directional, biasing force thereon. Such a biasing force may cause the restriction biasing structure 806 and the elongated arm 801 to rotate in an opposite direction, back towards the user. More specifically, the restriction biasing structure 806 may exert a biasing force in a direction which is substantially opposite to the initial direction of the elongated arm 801 along its intended path of travel. This will serve to reverse and redirect the rotation of the elongated arm 801 back towards the user. In turn, the user can appropriately react by purposefully delivering an additional blow to the connected target section 804.

Figure 18A:
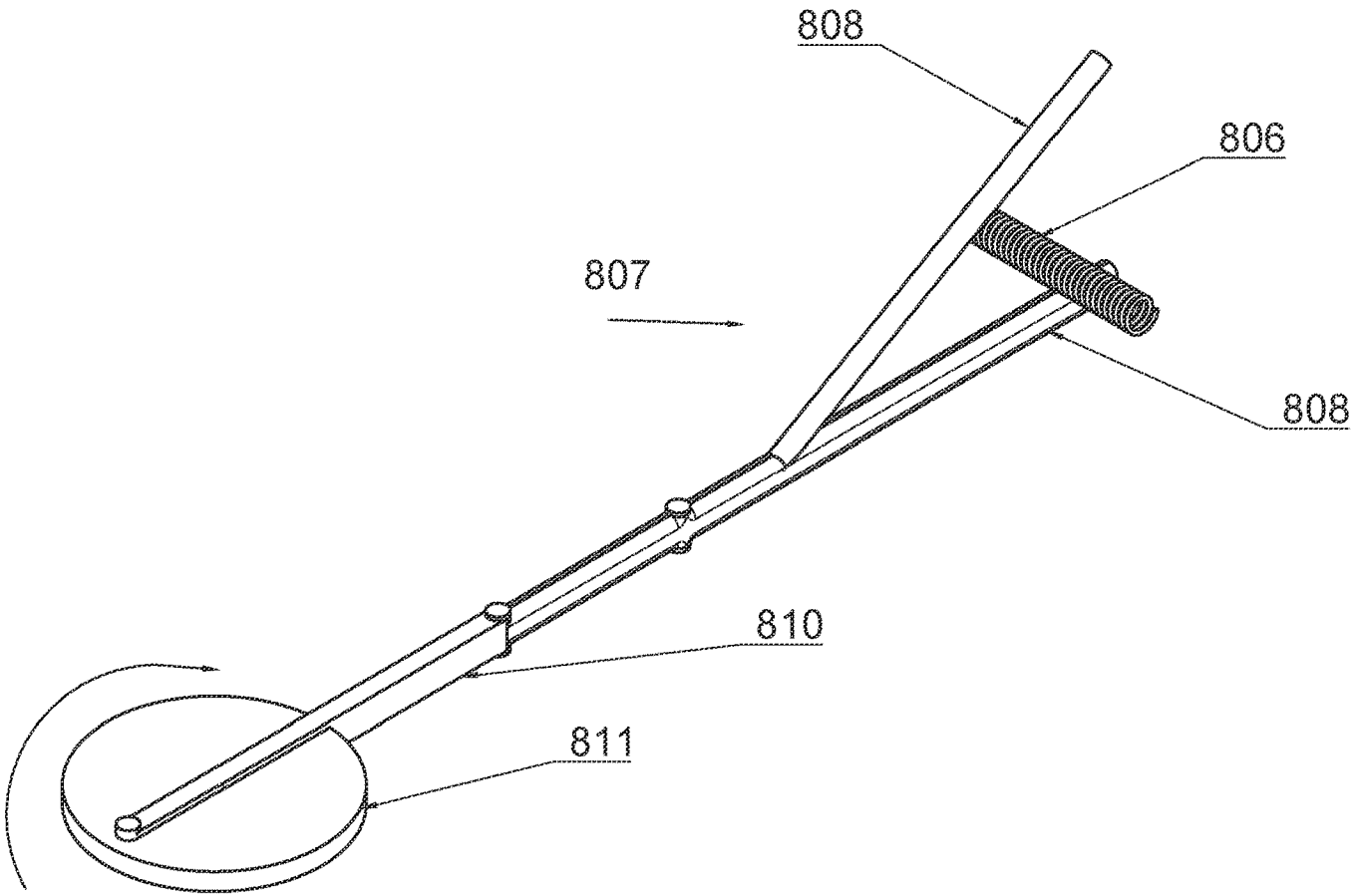
FIG. 18A is a detail view of a component of the embodiment of FIG. 18.
Figure 18B:
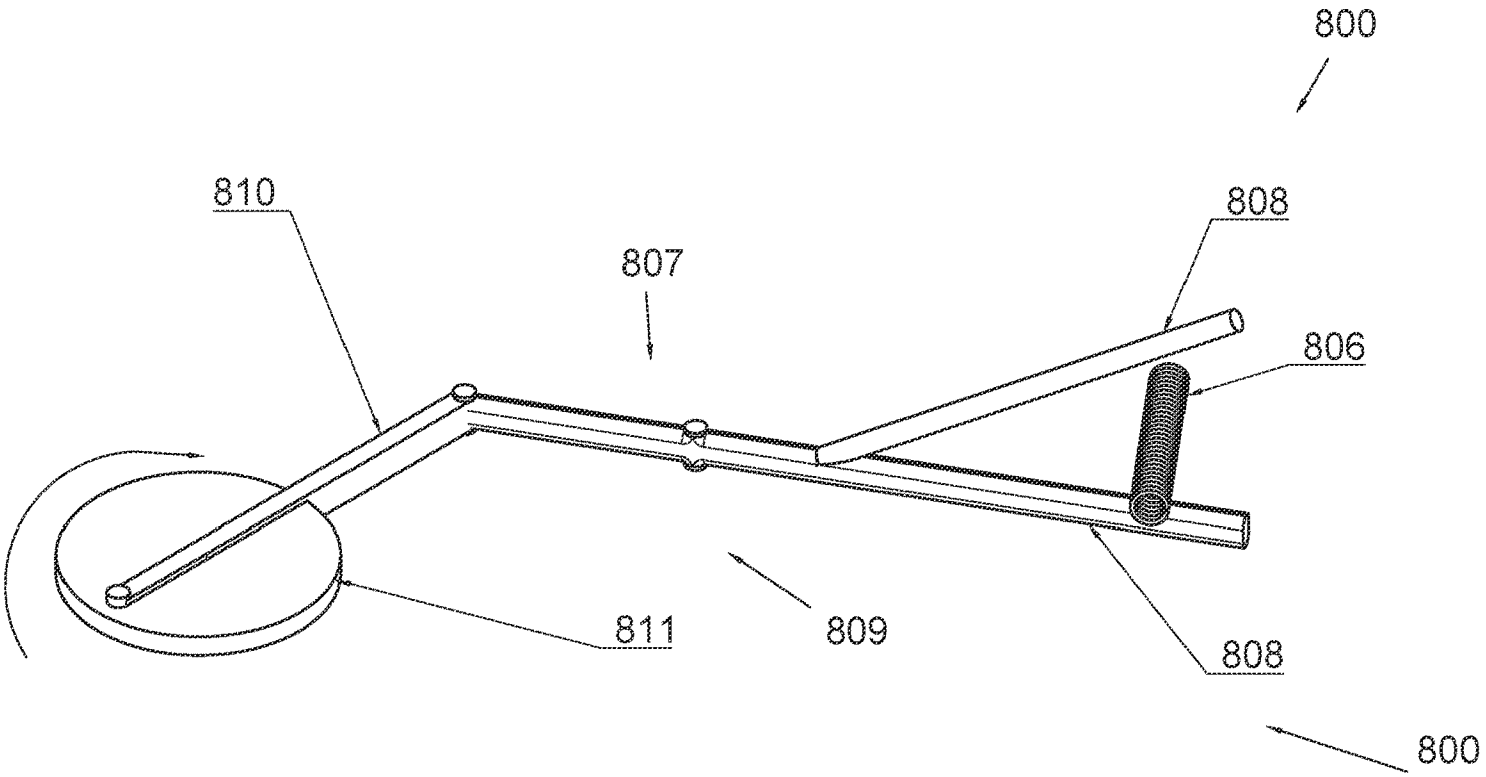
FIG. 18B is a detail view of a component of the embodiment of FIG. 18.
Figure 18C:
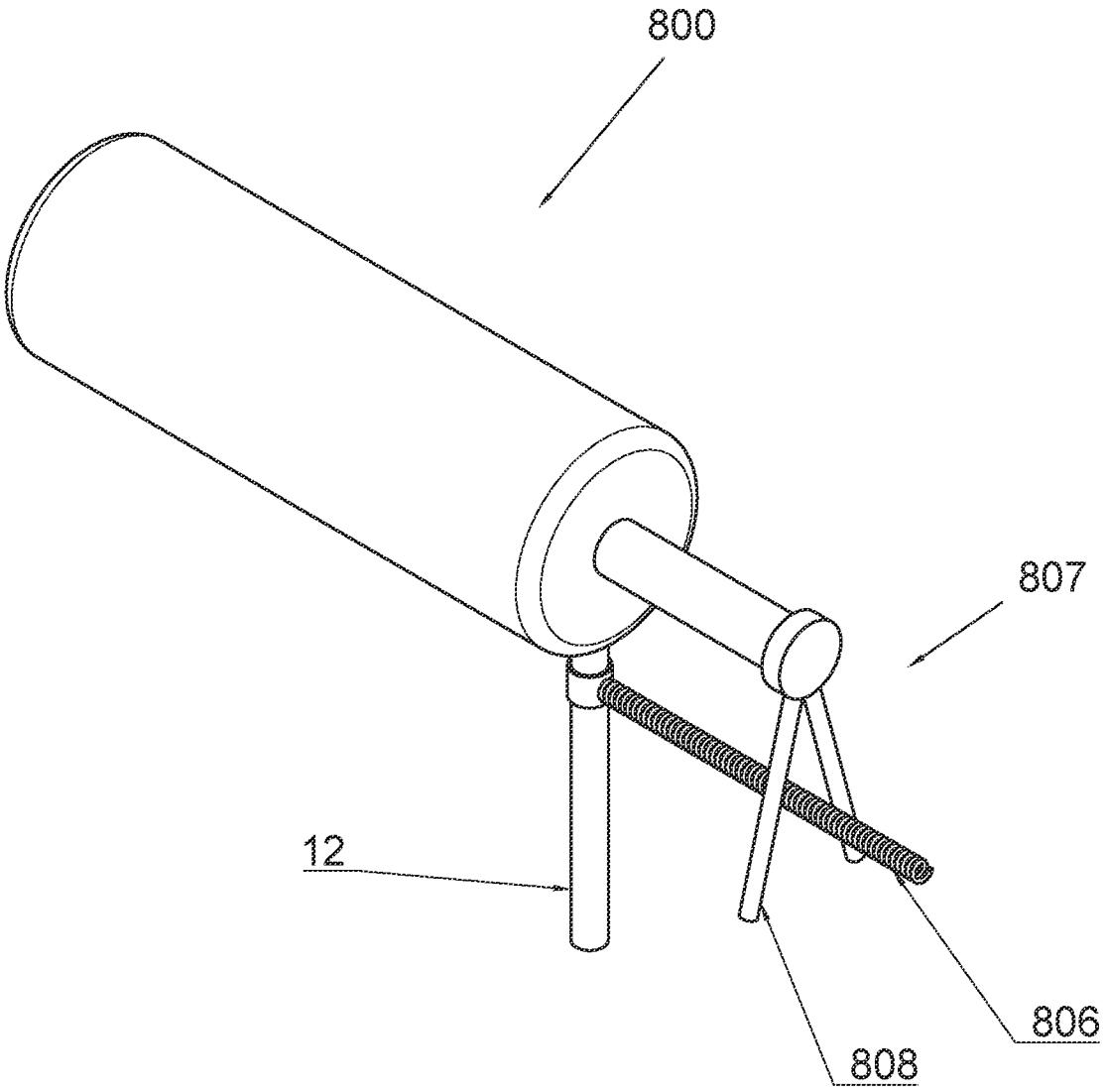
FIG. 18C is a detail view of a component of the embodiment of FIG. 18.
Figure 18D:
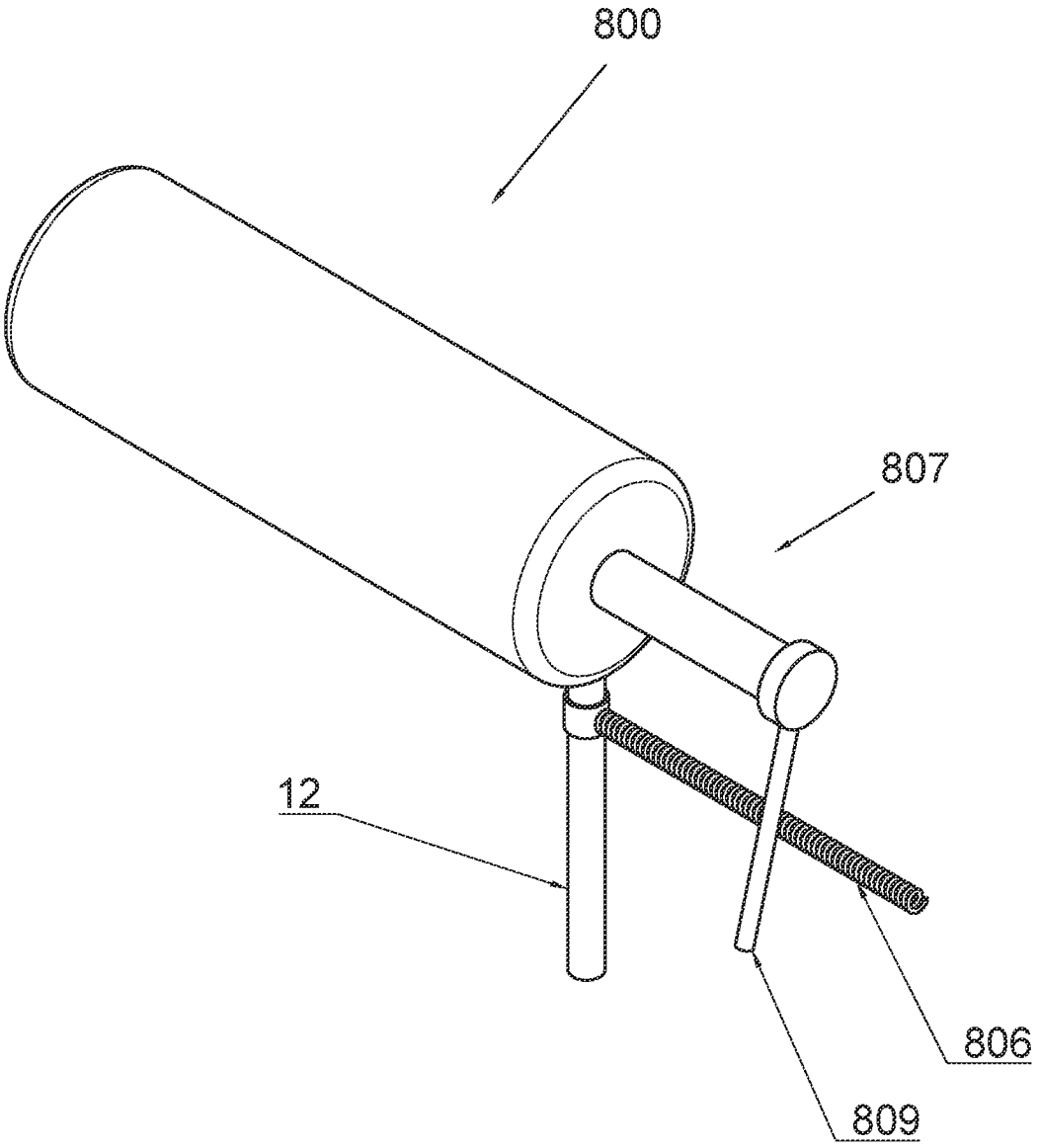
FIG. 18D is a detail view of a component of the embodiment of FIG. 18.

As illustrated in FIG. 18C, in one embodiment, the restriction guide 807, may be mounted on the shaft 12 in a substantially reversed orientation from that represented in FIGS. 18A-18B, above the restriction biasing structure 806. As such, the restriction guide 807 and the two restriction arms 808 may collectively define a substantially A-shape configuration about the restriction biasing structure 806. Further, the restriction guide 807 may be connected to a motor structured to cause the restriction arms 808 to move in a "side to side" motion, engaging the restriction biasing structure 806. This will serve to cause frequent contact between the restriction arms 808 and the restriction biasing structure 806 disposed there between, which may add to the unpredictable movement of the target section 804 as described above. As illustrated in FIG. 18D, in another embodiment, the inverted restriction guide 807 may only include one restriction arm 808' structured and disposed to rotate around and engage with the restriction biasing structure 806.

In one embodiment, as illustrated in FIGS. 18A-18B, to provide additional "unpredictable" movement to the target section 804, the restriction guide 807 may be pivotally secured to the shaft 12. More specifically, at least one of the two restriction arms 808 may independently move or pivot such that the rotating restriction biasing structure 806 may engage one of the two restriction arms 808 at different locations and/or angles depending on the movement or pivot thereof. This may serve to alter the initial rotational distance of the restriction biasing structure 806 as it travels away from the user and/or alter the speed of the returning restriction biasing structure 806 back towards the user after engagement with one of the restriction arms 808.

To effectuate the movement or pivot of at least one of the restriction arms 808, the restriction guide 807 may include a pivot mechanism 809, such as but not limited to a slider crank mechanism, structured to move or pivot the restriction guide 807. The pivot mechanism 809 may include a connecting rod 810, pivotally connected between the restriction guide 807 and a pivot wheel 811. Accordingly, when the restriction biasing structure 806 engages the restriction guide 807, the energy created by the linear rotation of the restriction biasing structure 806 may be transferred to the pivot mechanism 809 as mechanical rotational energy. More specifically, the linear rotation of the restriction biasing structure 806 may be transformed into a rotary motion at the pivot wheel 811 via the connecting rod 810. As such, the pivot wheel 811 may rotate. The rotary motion of the pivot wheel 811 may then be transformed into a linear motion at the restriction guide 807 via the connecting rod 810, causing at least one of the restriction arms 808 to move or pivot. In one embodiment, the rotary motion of the pivot wheel 810 may be perpetuated via a motor.

Figure 19:
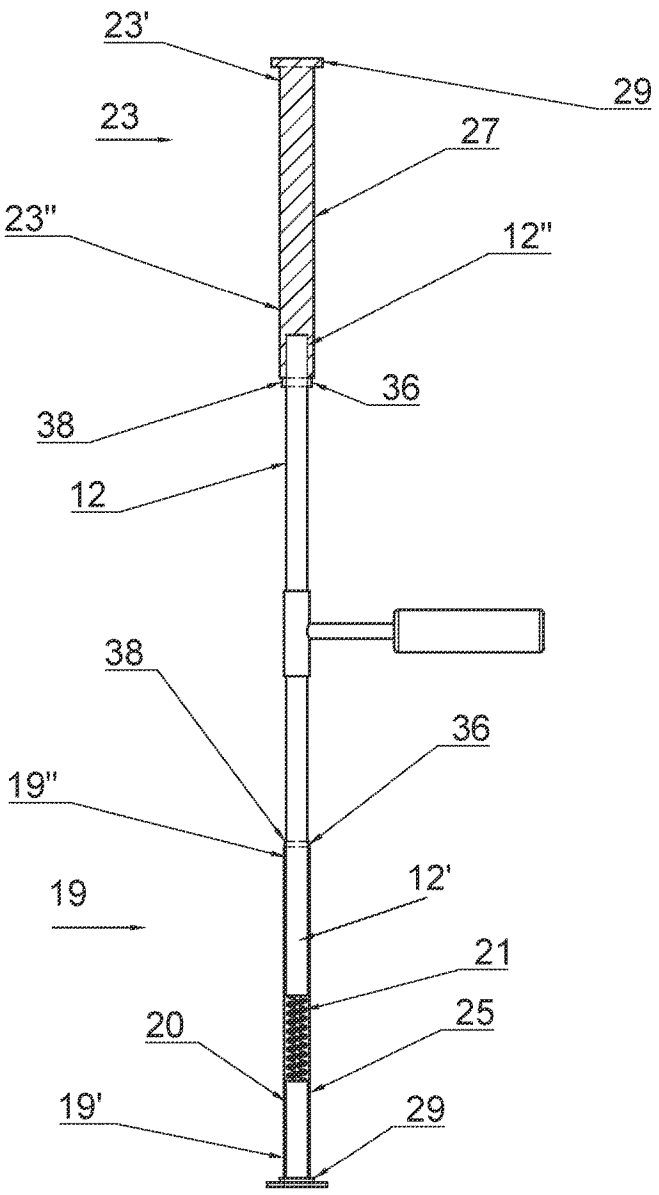
FIG. 19 is a perspective view of another preferred embodiment of an exercise assembly of the present invention.

As illustrated in FIG. 19, in another preferred embodiment, the training assembly 10 may include additional structural and operative versatility to facilitate the support and mounting of the support shaft 12. More specifically, the elongated support shaft 12 may be vertically mounted on a floor or other supporting surface and on a ceiling or other supporting structure located a sufficient distance above the floor supporting structure. This will serve to anchor the shaft 12 at both ends adding additional support thereto. Such reliable mounting of the support shaft 12 from the "floor to the ceiling", as well as a plurality of target structures mounted thereon, is important due to the fact that the training assembly 10 is intended to be repeatedly struck by the user. The overall length of the shaft 12 may be preferably in the range of between 8 and 10 feet. Such a length allows the training assembly 10 to vertically mount to most "floor to ceiling" structures. This preferred length further provides a user of the exercise assembly 10 with a greater amount of areas to train or exercise.

In cooperation with the shaft 12, a bottom and top sleeve structure 19, 23, may be removably mounted on each end thereof while concurrently engaging the floor and ceiling structures respectively. More specifically, the bottom sleeve structure 19 may be removably connected to a floor structure and a lower portion 12' of the shaft 12, and the top sleeve structure 23 may be removably connected to a ceiling structure and an upper portion 12" of the shaft 12. Such reliable mounting of the support shaft 12 is important due to the fact that the support assembly 10 is intended to be repeatedly "struck" as a user performs various boxing, martial arts and/or like activities, while utilizing the exercise assembly 10. Such support of the training assembly 10 against floor and ceiling structures may be further facilitated by the inclusion of slip-resistant and/or traction enhancing structures 29 mounted on proximal ends 19', 23', of the bottom and top sleeve structures 19, 23. The slip-resistant structures 29 may be disposed so as to anchor the training assembly 10 to the floor and ceiling structures, such that the user may practice the intended exercise and or training activity.

The top sleeve structure 23 may comprise a top exterior segment 27 having a hollow interior. When disposed in its operative position, the top exterior segment 27 may be disposed in concentrically surrounding relation to the upper portion 12" of the shaft 12. The bottom sleeve structure 19 may comprise a bottom exterior segment 25 having a hollow interior. When disposed in its operative position, the bottom exterior segment 25 may be disposed in concentrically surrounding relation to the lower portion 12' of the shaft 12. Further, the bottom sleeve structure 19 may include an interior restriction segment 20 and an interior biasing member 21 removably mounted or connected inside of the bottom exterior segment 25. More specifically, the interior restriction segment 20 may be removably inserted in, and extend substantially along, the interior length of the proximal end 19' of the bottom sleeve structure 19. The interior biasing member 21 may be disposed in movably, resiliently interconnecting relation between the interior restriction segment 20 and the lower end 12' of the shaft 12.

Further, when the interior biasing member 21 is in interconnecting relation with the shaft 12, it may be disposed in a retracted, compressed position due to the force and/or weight of the shaft 12. As such, the interior biasing member 21 is calibrated or otherwise structured to be constricted between the shaft 12 and the interior restriction segment 20. Further, the top and bottom sleeve structures 19, 23, may be adjustably secured along the length of the shaft 12 via locking collars 36 movably or adjustably connected to the shaft 12 by a plurality of set screws or like connectors 38. More specifically, the bottom locking collar 36 may hold the shaft 12 against the interior biasing member 21 while in the retracted, compressed position when interconnected between the shaft 12 and the interior restriction segment 20. This will serve to allow the user to mount the top sleeve structure 23 against the ceiling and lock the upper end 12" of the shaft 12 therein via the top locking collar 36.

Figure 26A:
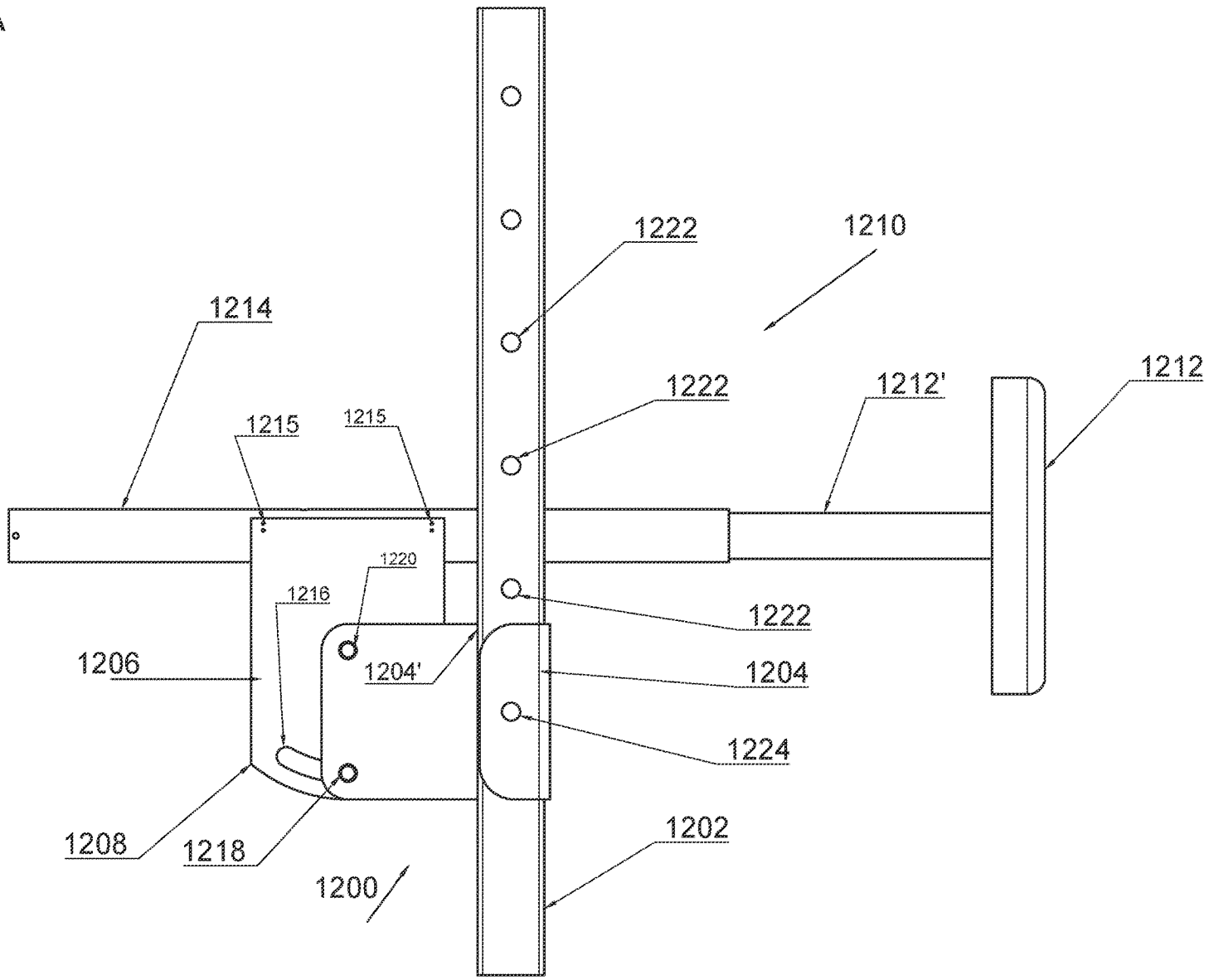
FIGS. 26A, 26B and 26C are front views in partial cutaway of another embodiment of the present invention directed to an adjustable mounting assembly.
Figure 26B:
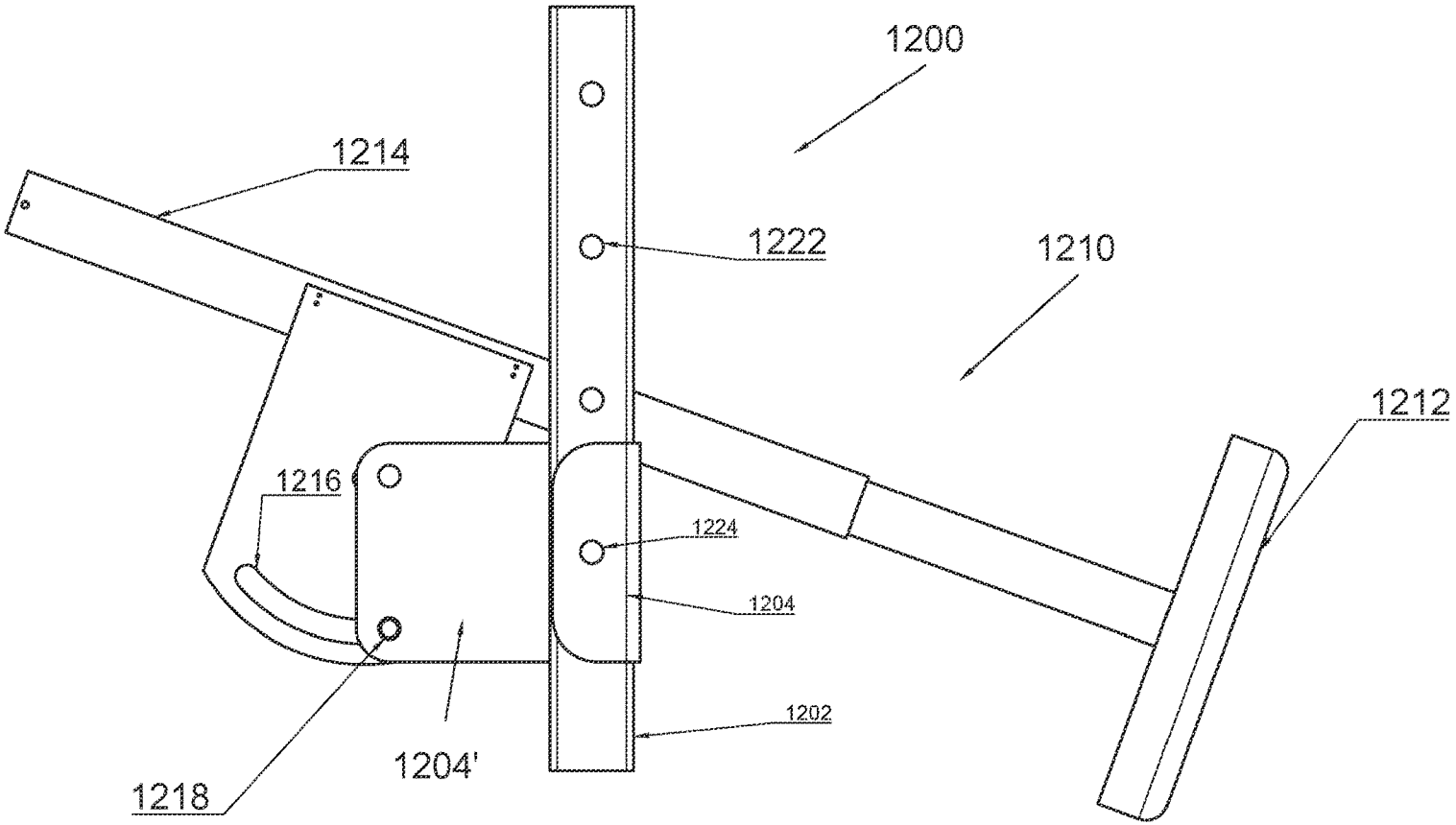
Figure 26C:
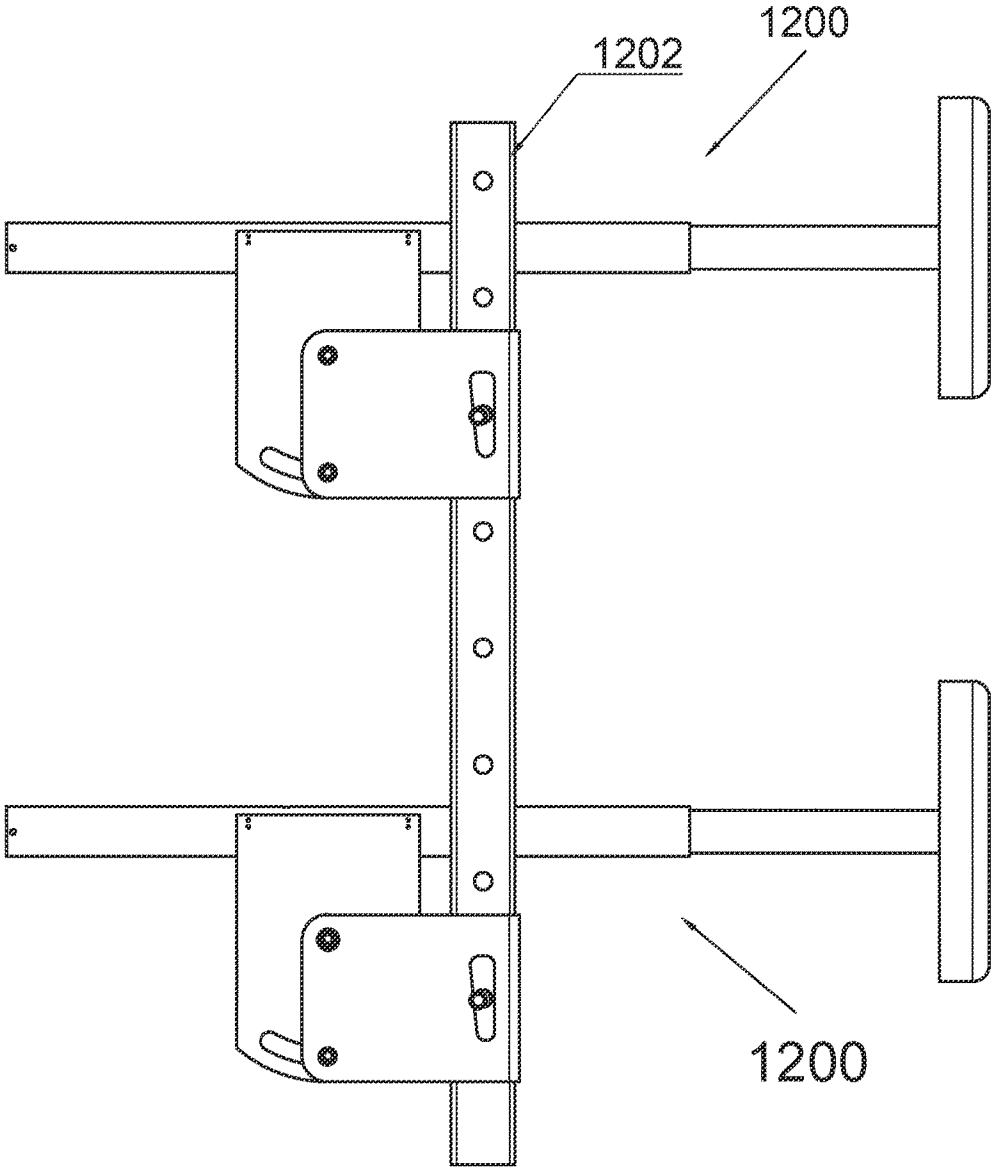

With primary reference to FIGS. 26A-26C, yet another embodiment of the exercise assembly of the present invention comprises an adjustable mounting assembly generally indicated is 1200 adjustably and removably connected in supported relation on a support shaft 1202. The support shaft 1202 has an elongated configuration and is operatively disposed in a substantially vertical orientation, as represented. The adjustable mounting assembly 1200 includes a bracket 1204 and a target mount 1206 movably connected to one another, wherein the target mount 1206 is movably connected to and at least partially supported by the bracket 1204. Such movable interconnection of the target mount 1206 to the bracket 1204 is at least partially accomplished by an attachment assembly generally indicated as 1208.

As also represented, the target mount 1206 is designed to be connected to and support thereon an exercise target generally indicated as 1210. In the embodiments represented in FIGS. 26 A-26C, the exercise target 1210 is connected in fixed or removable supported relation on the exercise mount 1206 by one or more connectors 1215 and as such is movable there with between at least a first operative orientation and a second operative orientation. For purposes of clarity, the first and second operative orientations may be defined as, but not limited to, the different operative orientations represented in FIGS. 26A and 26B, relative to the support shaft 1202. As also represented, the exercise target 1210 is of the type structured to receive a "jab" type of punch or strike. Therefore, the exposed or strike area 1212 is connected to a rod or like structure 1212' which in turn is telescopically and movably disposed within the interior of a tube or like conduit 1214. Accordingly, upon a jab type force being delivered to the strike area or segment 1212, the supporting rod 1212' will be driven into the interior of the supporting tube or conduit 2014 and thereafter be forced outwardly therefrom into the position represented in the Figures. Such outward, return travel or movement will be caused, at least in part, by a spring or like biasing structure being disposed on the interior of the tube or conduit 1214. It is noted that other type exercise targets may be operatively connected to or mounted on the mounting assembly 1200, and the "jab" type of exercise target is representative only.

The aforementioned attachment assembly 1208 is collectively mounted and/or formed on the bracket 1204 and the exercise mount 1206 and comprises a pivotal connection including an elongated, preferably curved slot 1216 and a stop member 1218. As also represented the stop member 1218 is fixedly connected to the bracket extension 1204' and is of a sufficient elongated dimension to pass through the elongated, preferably curved slot 1216. Further, the attachment assembly 1208, at least partially defined by the aforementioned pivotal connection, includes a pivot pin or member 1220 serving to pivotally interconnect the bracket 1204 and/or extension plate 1204' and the target mount 1206. The target mount 1206 is pivotally adjustable relative to the bracket 1204 and bracket plate extension 1204' about the pivot pin 1220 as the stop member 1218 is disposable or movable along at least a majority of the length of the elongated curved slot 1216, concurrent to the exercise target 1210 moving between and into the aforementioned first and second operative orientations.

Therefore, as represented in the FIGS. 26A-26B the first and second operative orientations of the exercise target 1210 as well as the target mount 1206 may be collectively defined by different angular positions or orientations thereof relative to the support shaft 1202. In more specific terms, a first operative orientation of the exercise target 1210 may be, but is not limited to, a substantially perpendicular orientation to the longitudinal axis of the support shaft 1202. In contrast, the second operative orientation is represented in FIG. 26B and may be defined by a different angular position or orientation (greater or less than perpendicular) of the target 1210 and target mount 1206 relative to the length or longitudinal axis of the support shaft 1202. Movement of the exercise target 1210 and target mount 1206 relative to the bracket 1204 and support shaft 1202 may be limited by the stop member 1218 engaging the opposite, terminal ends of the elongated slot 1216.

As described, the pivotal connection of the attachment assembly 1208 comprises the elongated, preferably curved slot 1216 and a stop member 1218 extending therethrough. Relative movement therebetween facilitates the pivotal interconnection between the extension plate 1204' of the bracket 1204 and the exercise mount 1206 about the interconnecting pivot pin 1220. However, it should be apparent that while the elongated slot 1216 is formed on the exercise mount 1206 and the stop member 1218 is formed on or connected to the extension 1204' of the bracket 1204, the reverse disposition could be possible and still facilitate selective, intended and preferred relative movement between the bracket extension 1204' in the exercise mount 1206. Therefore, the pivotal connection of the attachment assembly 1208 could also be defined by the elongated slot 1216 and the stop member 1218 being disposed on different ones of the bracket 1204 and the target mount 1206.

Yet additional structural features of the embodiment of FIGS. 26A-26C includes the adjustable mounting assembly 1200 being supported on the support shaft 1202 which has a multisided, preferably square, transfers cross-sectional configuration. As such, each of the exterior surfaces of the support shaft 1202 includes a substantially flat or planar configuration. Also, the support shaft 1202 includes a plurality of connecting apertures 1222 disposed in spaced relation to one another as they collectively extend along the length of at least the majority of the support shaft 1202. Further, each of the connecting structures 1222 extend completely through the support shaft 1202 and are dimensioned and configured to receive a locking member or pin 1224 therethrough.

It is also to be noted that in at least one embodiment, the bracket 1204 has an at least partially U-shaped configuration so as to wrap around and at least partially enclose multiple sides of the support shaft 1202. When so positioned and when oppositely disposed apertures 1224' formed in the bracket 1204 are aligned with the connecting apertures 1222, an elongated connecting pin 1224 extends collectively through oppositely disposed apertures 1224' which are aligned with at least one of the connecting apertures 1222. It is of further note that the substantially or at least partially U-shaped configuration of the bracket 1204, in combination with the square or multisided cross-sectional configuration of the support shaft 1202, facilitates stability of the adjustable mounting assembly 1200 on the support shaft 1202.

As represented in FIG. 26C more than one of the adjustable mounting assemblies 1200 may be concurrently connected to the support shaft 1202, both in and accessible relation to a user, thereby adding versatility to this embodiment of the exercise assembly of the present invention.

Figure 27:
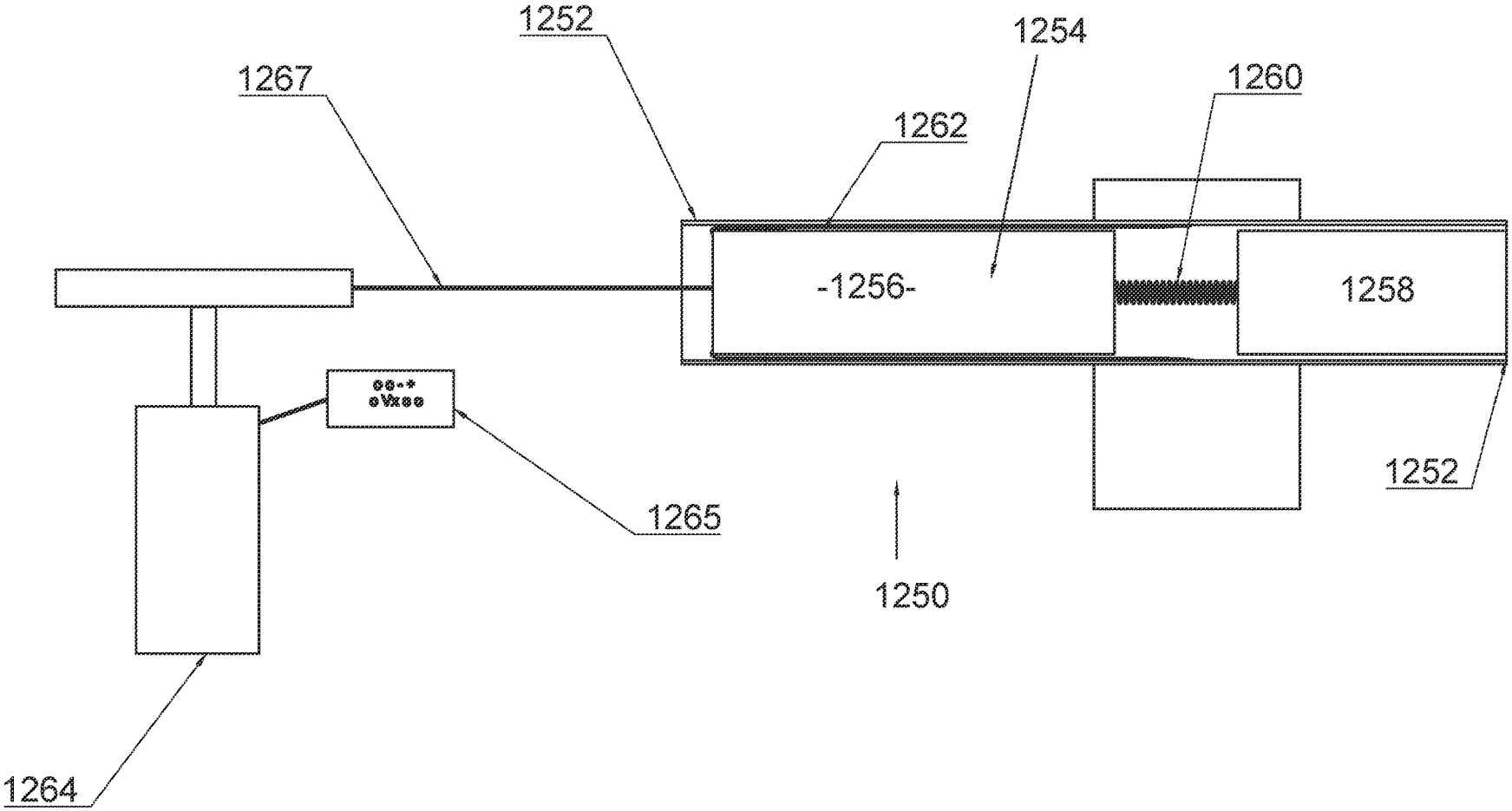
FIG. 27 is a schematic representation of another embodiment of the present invention directed to yet another exercise target.

Yet another embodiment of the present invention is represented in FIG. 27 and comprises an exercise target, generally indicated is 1250. The exercise target 1250 is structurally and operatively intended to provide challenges to a user of the exercise assembly by periodically extending outwardly into potentially engaging relation with a portion of the user's body somewhat like, but not limited to a "jab-like" blow being delivered to the user. In more specific terms, the target assembly 1250 includes a housing 1252 preferably having an at least partially elongated configuration and an open or hollow interior in which the force delivering structure generally indicated is 1254 may be disposed when in a "stored" position, as represented in the indicated Figure. The force delivering structure 1254 includes a base portion 1256 and an engaging portion 1258 connected to one another by a spring or like force absorbing member 1260. In its retracted or stored position, a first spring or biasing member 1262 is disposed within the housing 1252 in a compressed orientation. A control assembly generally in the indicated as 1264 serves to regulate and/or determine, possibly on a pre-programmed and/or random basis, when the force delivering structure 1254 is released so as to forcibly extend outwardly from an open and 1252' of the housing 1252.

Further, the control assembly 1264 may include printed circuitry 1265, a clutch motor 1266 and a connecting/release segment 1267. In operation, the force delivering structure 1254 may be released from the interior of the housing 1252 so as to be forced outwardly in potentially engaging relation to a user. Such release may be periodic, to the extent of being preprogrammed or controlled by the printed circuitry 1265, which in turn serves regulate control of the clutch motor 1266 and releases the connecting segment 1267. Upon such release the spring or biasing member 1262 will exert an outwardly directed force on the force delivering member 1254 causing at least the engaging portion 1258 to pass through the open 1252' into potential engagement with a user of the exercise assembly. In order to prevent any significant damage to the user, the engaging portion 1258 may be formed of a soft foam or like pliable material. In addition, the force absorbing member 1260 is disposed and interconnecting relation between the base portion 1256 and the engaging portion 1258 thereby further absorbing any potential damaging force which may be exerted on the engaging portion 1258 if in fact contact is made with the user.

Figure 28A:
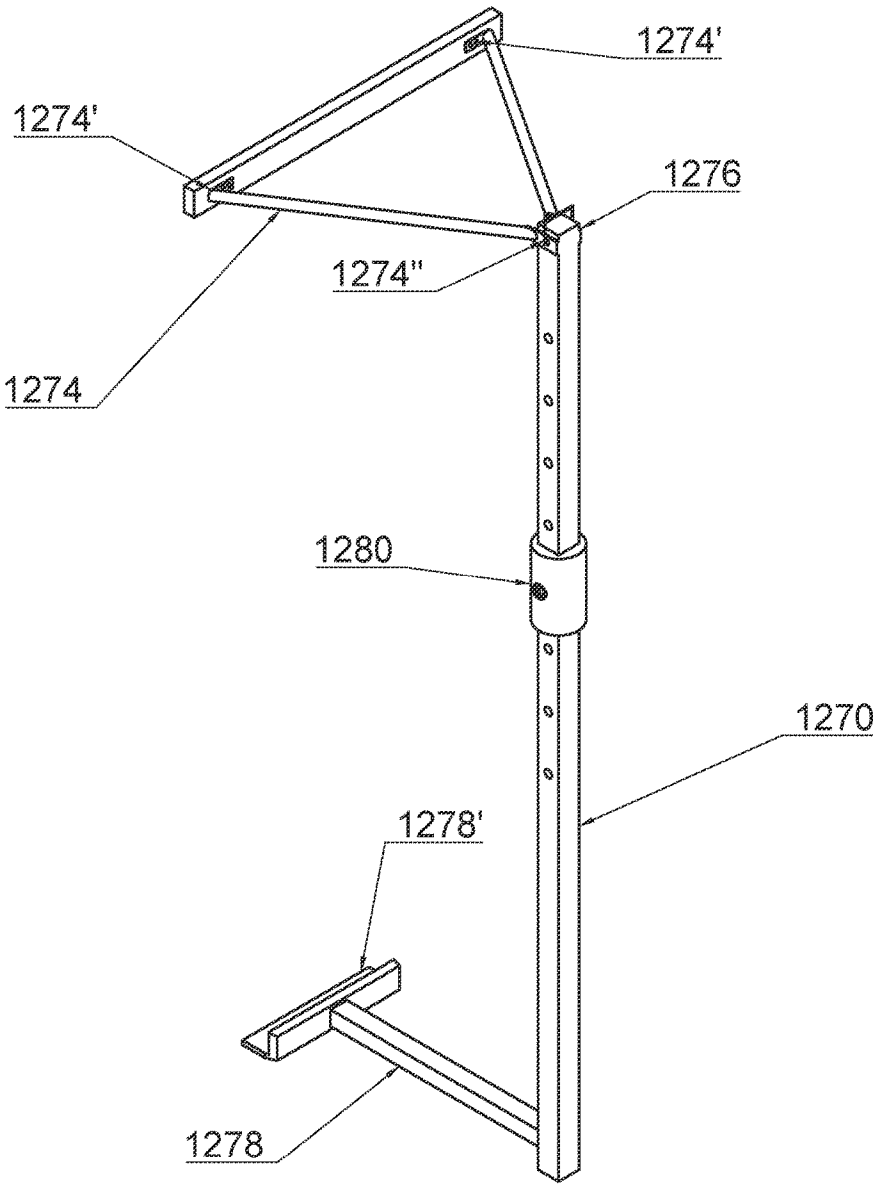
FIG. 28A is a front perspective view of yet another embodiment of the present invention directed to a support shaft connected to a door and/or doorframe structure.
Figure 28B:
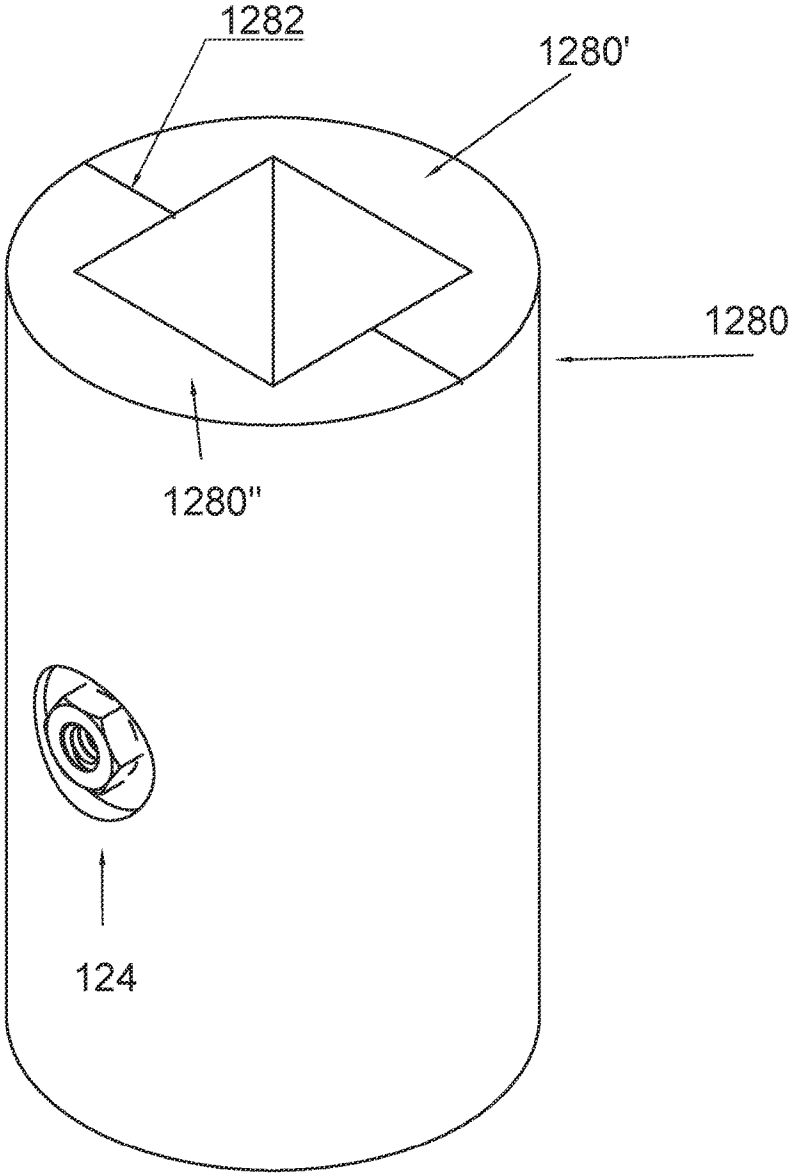
FIG. 28B is a perspective view of a target mount in assembled form, structured to be removably connected to the support shaft of the embodiment of FIG. 28A.
Figure 28C:
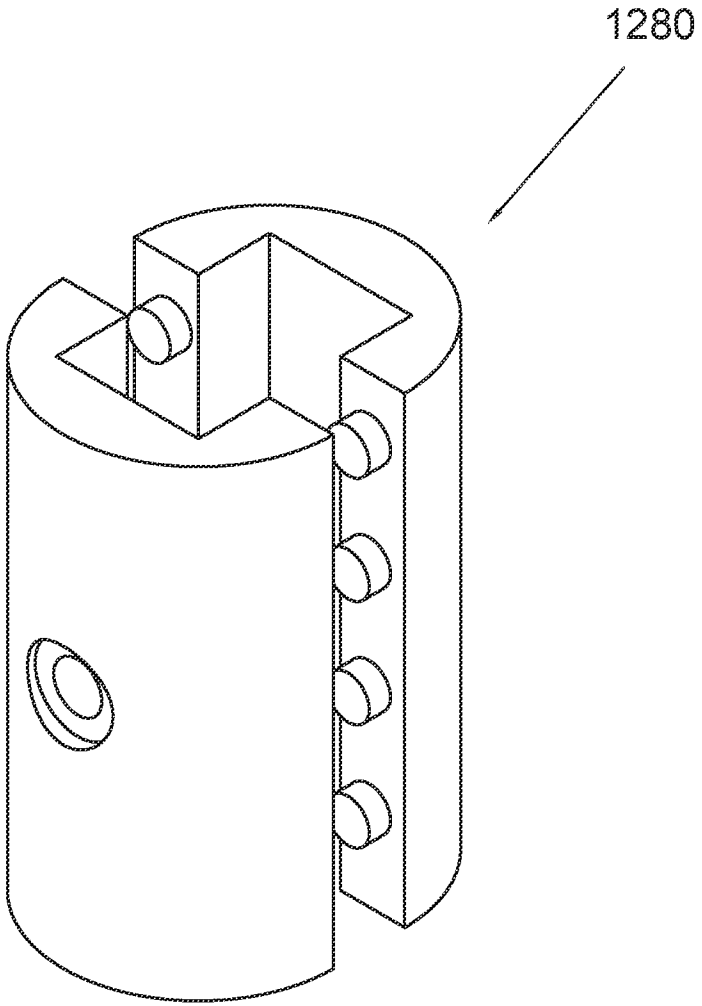
FIG. 28C is a perspective view of the embodiment of FIG. 28 B in unassembled form.

Yet another preferred embodiment of the exercise assembly of the present invention is represented in FIGS. 28A-28C. This embodiment adds structural and operative versatility to the exercise assembly due to the fact that the support shaft 1270 may be mounted on and movable with a door or like movable structure 1272 capable of being moved relative to a wall, floor, ceiling, etc. The enhanced versatility of this embodiment thereby eliminates the need to securely mount the support shaft 1272 to a ceiling and or floor portion and further allows the selected positioning of the support shaft 1270 by the opening, closing and or further disposition of the door 1272 between open and closed positions.

More specifically, the represented embodiment includes at least one but preferably a plurality of brackets 1274 having their inner or proximal ends 1274' connected to the exposed surface of the door 1272 and their outer or distal ends 1274" connected directly to an upper or other appropriate portion of the support shaft 1270, as at 1276. As represented, the outer or distal ends 1274" are connected to the sports shaft 1270 in an aligned, adjacent or contiguous location to another, thereby adding further stability. In cooperation therewith, a lower mounting or support bracket 1278 is connected to a lower portion of the door 1272, as at 1278', wherein the opposite end thereof is connected to a lower end of the support shaft 1270 as at 1279.

Yet additional features of the embodiment of FIGS. 28A-28C includes aim target mounting structure 1280 preferably including at least two separable segments 1280' in 1280" removably interconnected along a segment line 1282, as represented in FIG. 28C. The target mounting structure 1280 may include one or more attachment structures generally indicated as 1284 structured to facilitate removable connection of any one of the plurality of different exercise targets thereto.

Figure 29A:
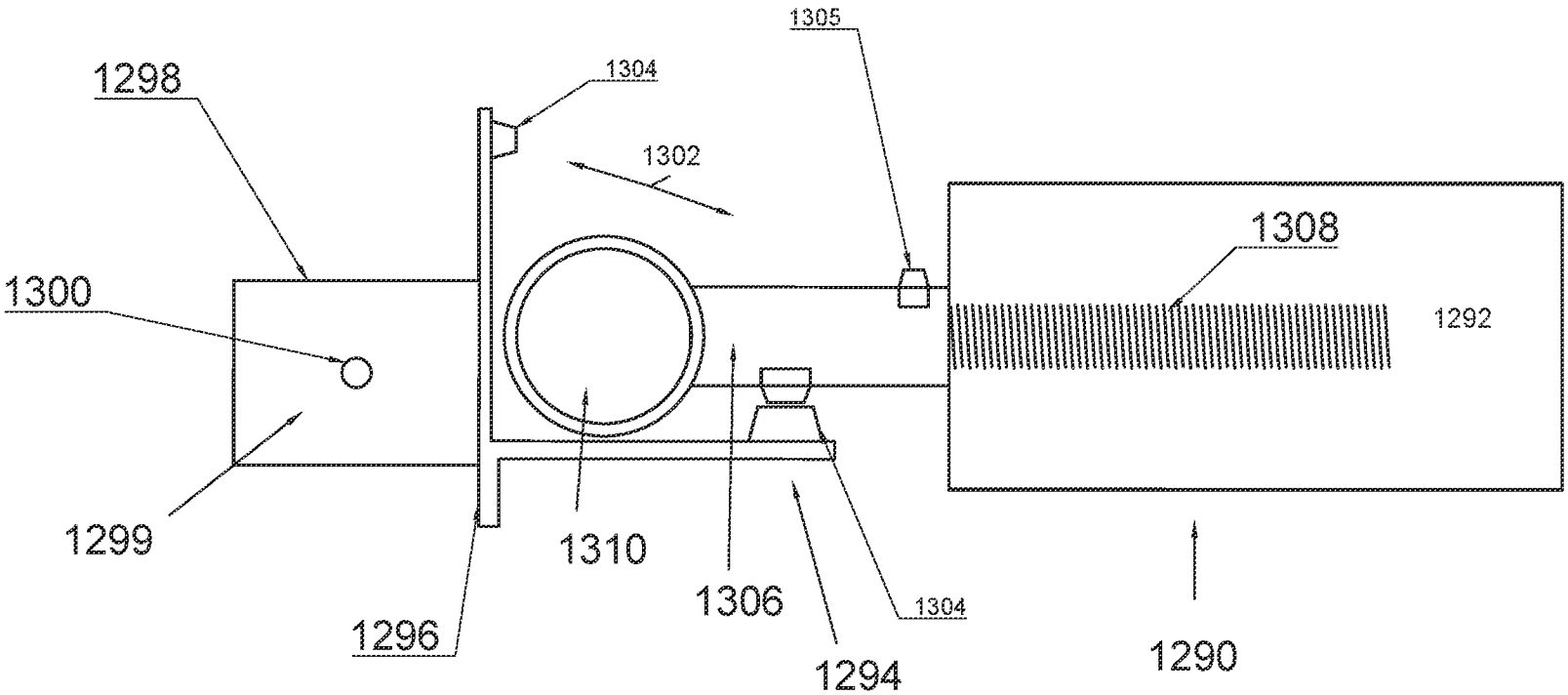
FIG. 29A is a schematic representation of yet another embodiment of the present invention directed to an exercise target operative to facilitate the use of an "uppercut" type blow.
Figure 29B:
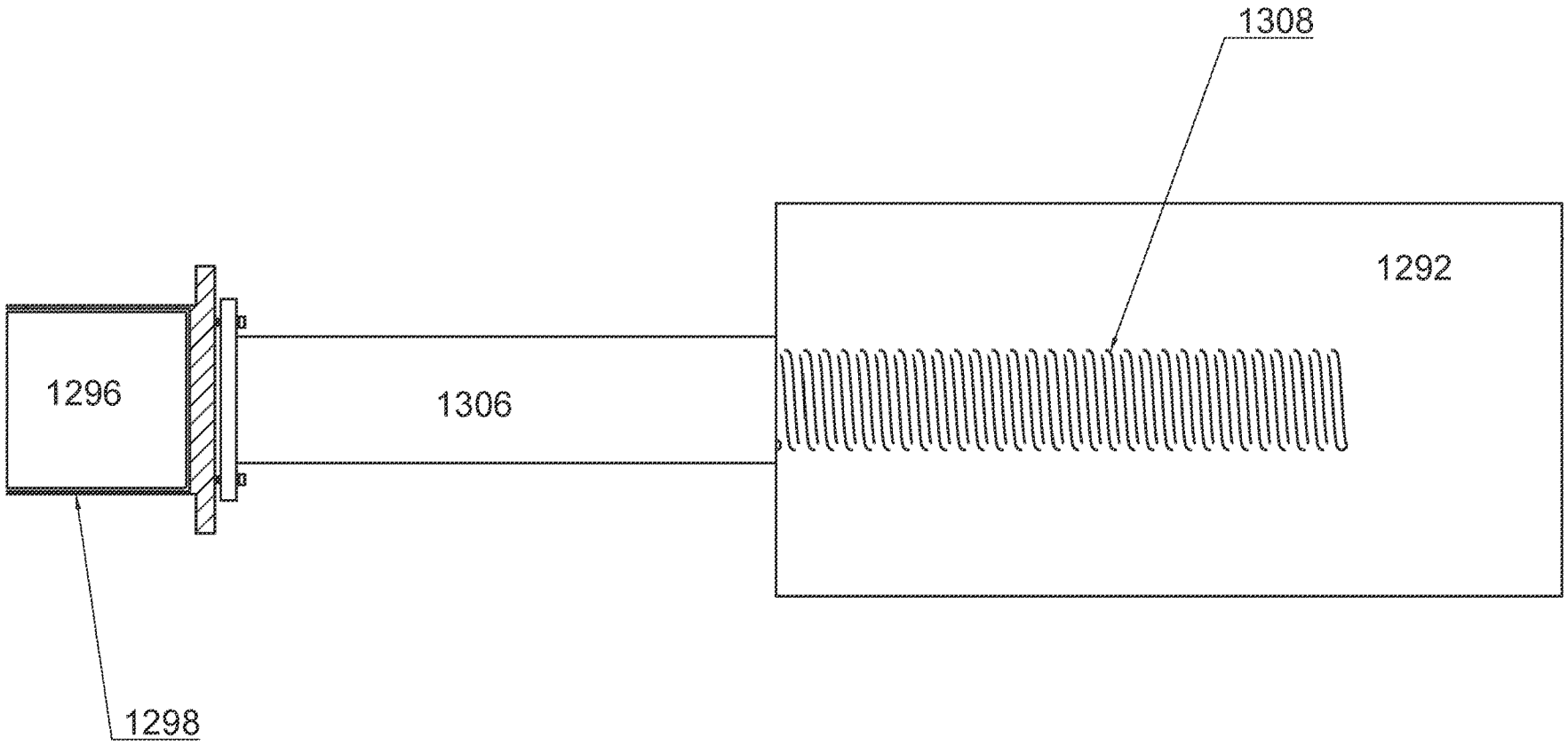
FIG. 29B is a sectional view in partial cutaway of the embodiment of FIG. 29A.

Yet another embodiment of the exercise assembly of the present invention is represented in FIG. 29 in the form of a exercise target 1290 structurally and operationally designed to receive an "uppercut" type of blow from a user of the exercise assembly. As such, the uppercut exercise target 1290 includes a striking base 1292 which may be formed from a foam or other comparatively soft material so as to not damage a user's hand when struck with an uppercut type blow. A base 1292 is interconnected by an attachment assembly generally indicated as 1294 to a support shaft 1296, wherein the support shaft 1296 may have the square or multi-sited cross-sectional configuration. The attachment assembly 1294 includes a bracket 1298 having a U-shaped or other appropriate configuration so as to concurrently engage multiple exterior surfaces of the shaft 1296 as represented in FIG. 29B. Therefore, the bracket 1298 and the remainder of the attachment assembly 1294 as well as the striking base 1292 may be adjusted relative to the support shaft 1296 while being connected thereto. Such adjustment features include an elongated channel or slot 1299 formed in the bracket 1298 in aligned relation with a connecting aperture 1300 formed in the support shaft 1296. A connecting pin, bolt or other appropriate connecting member may concurrently extend through the connecting aperture 1300 and elongated slot 1299 in fixed but removable engagement therewith.

The attachment assembly 1294 is operative to initially but removably maintain the striking base 1292 in an outwardly extended substantially transverse relation to the support shaft 1296 so as to be readily accessible to receive an uppercut type blow by a user. When such a blow was struck, the force will cause the base 1292 to rotate upwardly as indicated by directional arrow 1302 into a substantially inoperative orientation such as, but not limited to, parallel or somewhat linearly aligned relation to the length of the support shaft 1296. Further, the attachment assembly 1294 includes magnets 1304 and 1304' disposed in aligned relation with the metal buttons or tabs 1305 and 1305 respectively. Therefore, when in the initial, operative or accessible position, as represented in FIG. 29A a corresponding magnet 1304 will engage and be magnetically attracted to the correspondingly metal or other appropriate material tab 1305. Upon delivery of the uppercut blow, the support segment 1308 will rotate relative to a fixed shaft 1310 resulting in the magnet 1304' removably retaining, due to magnetic attraction, the button 1305'. This will in turn maintain the connecting shaft 1306 in the inoperable, substantially non-accessible orientation or position, as well as the base 1292 attached thereto. For purposes of reducing potential damage to a user when an uppercut blow is delivered to the striking base 1292, a spring or like flexible member 1308 serves to at least partially interconnected base 3092 to the connecting segment 1306.

Figure 30:
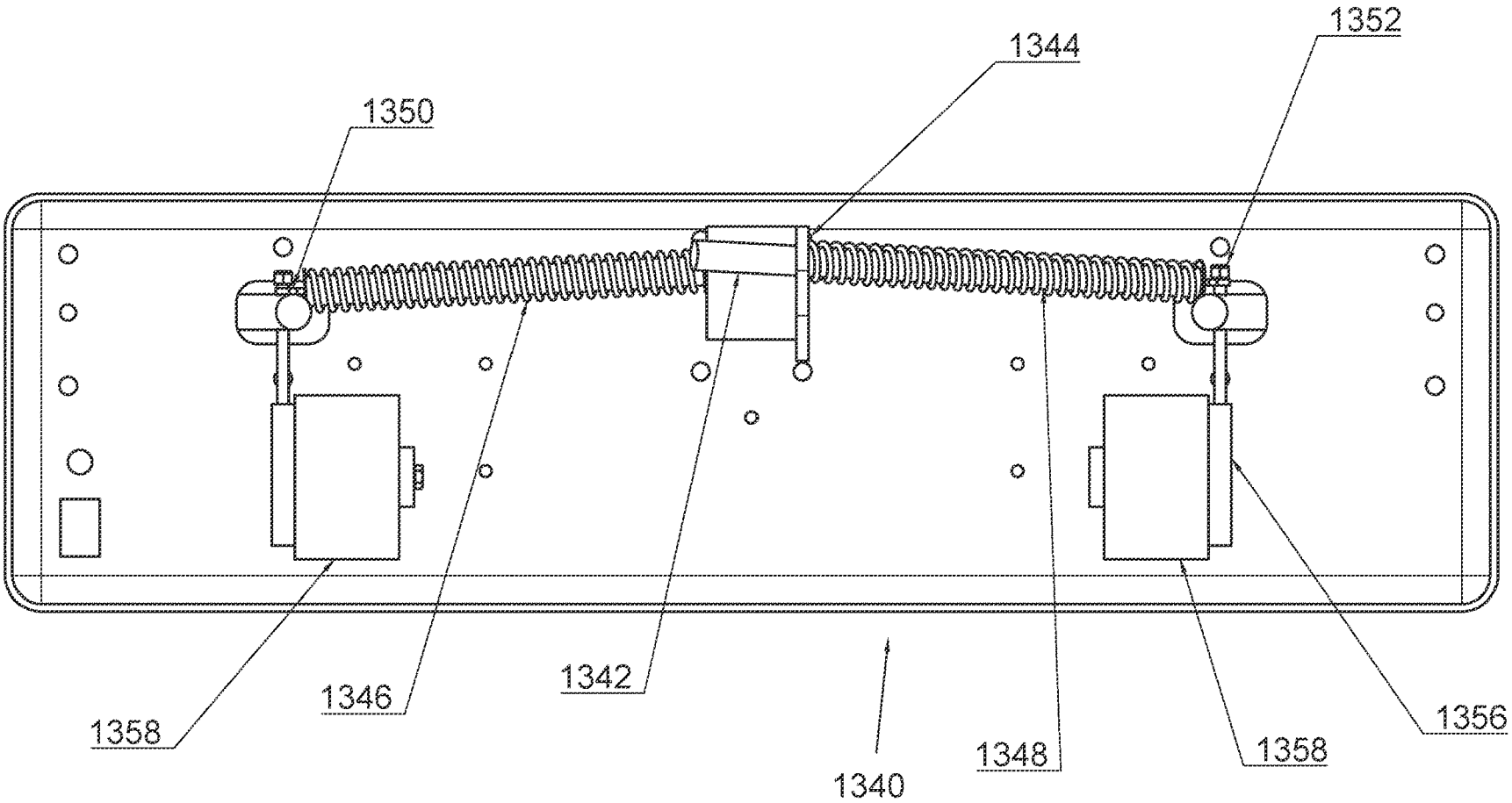
FIG. 30 is a perspective view in partially assembled form of an activating assembly operative to position different exercise targets such as, but not limited to, of the type represented in at least FIG. 14.

Yet another preferred embodiment of the exercise assembly of the present invention is represented in FIG. 30 and is directed to an activating assembly generally indicated at 1340. The activating assembly 1340 includes at least one but preferably two activating arms 1342 and 1344, which may be operative collectively and concurrently or independently. Each arm 1342 and 1344 is operatively associated with a different spring 1346 and 1348. The outer or distal end of each of the arms 1342 and 1344 is connected in driving/positioning relation to an activating segment 1350 and 1352 respectively. Further, each activating segment 1350 and 1352 may be connected to a magnetic or other magnetically attractive material member 1356. In turn the magnetic material blocks or members 1356 are each disposed in aligned relation with a correspondingly disposed electromagnets, as at 1358.

In operation, and as represented in FIG. 30 the Springs 1346 and 1348 are in a compression mode such as when the magnetic material blocks 1356 are attracted to corresponding ones of the electromagnets 1358. However, upon a proper and intended control of electric current to the electromagnets 1358, the blocks 1356 will be released from their engagement with the electromagnets and allow the compressed Springs 1346 and 1348 to exert an outwardly and/or rotationally directed force onto the activating segments 1350 and 1352. This in turn will result in a linear, pivotal, rotational or other movement of independent, different exercise targets (not shown for purposes of clarity) to which the activating segments 1350 and 1352 are attached in driving, positioning relation thereto. Further, subsequent retaining, magnetic engagement between the blocks 1356 and corresponding ones of the electromagnets 1358 will result in the corresponding springs 1346 and 1348 being again disposed in their compressed orientation in order to again activate, move, reposition, etc. the exercise targets to which the activating segments 1350 and 1352 are attached. It is a further note that electromagnets 1358 may be periodically, selectively or randomly activated and deactivated such that the user of the exercise assembly associated will not be aware of when the targets connected to the activating segments 1350 and 1352 are moved, repositioned, rotated, pivoted, etc.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An exercise assembly operative to be struck by a user, said exercise assembly comprising:

a support shaft having an elongated configuration, a mounting assembly including a bracket and a target mount cooperatively structured to adjustably dispose an exercise target on said support shaft, said bracket connected in supported relation on said support shaft and said target mount movably connected in supported relation to said bracket, said exercise target secured to said mounting member and movable there with relative to said support shaft, an attachment assembly collectively disposed on said bracket and said target mount;

said attachment assembly structured to adjustably dispose said exercise target into and between at least a first operative orientation and a second operative orientation, concurrent to said exercise target being secured to said target mount, said attachment assembly comprises a pivotal connection disposed and structured to pivotally dispose said exercise target into and between said at least first and said second operative orientations, said pivotal connection further comprises a pivot pin disposed and structured to pivotally connect said bracket and said target mount, and said pivotal connection further comprises an elongated slot and a stop member disposed within said slot; said slot and said stop member each disposed on a different one of said bracket and said target mount.

2. The exercise assembly as recited in claim 1 wherein said elongated slot is formed in said target mount and said stop member secured to said bracket is disposable within and along a length of said slot.

3. The exercise assembly as recited in claim 2 wherein said slot includes a curved configuration along at least a majority of a length thereof.

4. The exercise assembly as recited in claim 1 wherein said support shaft comprises a plurality of connecting apertures collectively extending along a length thereof in spaced relation to one another.

5. The exercise assembly as recited in claim 4 wherein said bracket is removably connectable in supported relation to said support shaft in substantially aligned relation to any one of said plurality of connecting apertures.

6. The exercise assembly as recited in claim 5 further comprising at least one locking pin structured to removably secure said bracket to said support shaft; said locking pin disposable through said bracket and any one of said plurality of connecting apertures, to define a removably connected disposition of said bracket in supported relation on said support shaft.

7. The exercise assembly as recited in claim 1 wherein said slot includes a curved configuration along at least a majority of a length thereof.

8. The exercise assembly as recited in claim 1 wherein said at least first and second operative orientations are at least partially defined by different angular orientations of said exercise target relative to said support shaft.

9. The exercise assembly as recited in claim 1 wherein said support shaft comprises a multi-sided exterior surface configuration.

10. The exercise assembly as recited in claim 1 wherein said bracket includes a substantially u-shaped configuration removably connected in at least partially surrounding relation to said shaft.

11. The exercise assembly as recited in claim 4 wherein said support shaft comprises a multi-sided exterior surface configuration.

12. An exercise assembly operative to be struck by a user, said exercise assembly comprising:

a support shaft having an elongated configuration, a mounting assembly including a bracket and a target mount cooperatively structured to adjustably dispose an exercise target on said support shaft, a pivotal connection collectively disposed on said bracket and said target mount and structured to pivotally adjust said target mount between at least a first and a second operative orientations, said pivotal connection comprising an elongated slot and a stop member disposed within said slot; said slot and said stop member each disposed on a different one of said bracket and said target mount, and said pivotal connection further comprising a pivot pin disposed and structured to pivotally connect said bracket and said target mount.

13. The exercise assembly as recited in claim 12 wherein said slot includes a curved configuration extending along at least a majority of a length thereof.

14. The exercise assembly as recited in claim 12 wherein said at least first and second operative orientations are at least partially defined by different angular orientations of said target mount, and said exercise target secured thereto, relative to said support shaft.

15. The exercise assembly as recited in claim 12 wherein said support shaft comprises a substantially square transverse sectional configuration.

16. The exercise assembly as recited in claim 12 wherein said support shaft comprises a plurality of connecting apertures extending therethrough and collectively extending along a length thereof in spaced relation to one another; said bracket removably connectable in supported relation to said support shaft in substantially aligned relation to any one of said plurality of connecting apertures.

17. The exercise assembly as recited in claim 16 further comprising at least one locking pin structured to removably secure said bracket to said support shaft; said locking pin disposable through said bracket and any one of said plurality of connecting apertures, to define a removably connected disposition of said bracket in supported relation on said support shaft.

* * * * *